United States Patent [19]

Koboshi et al.

[11] Patent Number: 4,738,917

[45] Date of Patent: Apr. 19, 1988

[54] METHOD FOR COLOR-DEVELOPING A SILVER HALIDE PHOTOGRAPHIC LIGHT-SENSITIVE MATERIAL WITH A COLOR DEVELOPER CONTAINING AN N-HYDROXYALKYL-P-PHENYLENEDIAMINE DERIVATIVE

[75] Inventors: Shigeharu Koboshi, Sagamihara; Satoru Kuse, Hino; Kazuhiro Kobayashi, Inagi; Masao Ishikawa, Tama; Masayuki Kurematsu, Hino, all of Japan

[73] Assignee: Konishiroku Photo Industry Co., Ltd., Tokyo, Japan

[21] Appl. No.: 863,604

[22] Filed: May 15, 1986

[30] Foreign Application Priority Data

May 16, 1985 [JP] Japan ..... 60-104698
May 24, 1985 [JP] Japan ..... 60-111693
May 24, 1985 [JP] Japan ..... 60-111694

[51] Int. Cl.[4] ..... G03C 7/16; G03C 7/32; G03C 5/24

[52] U.S. Cl. ..... 430/377; 430/351; 430/386; 430/387; 430/389; 430/390; 430/475; 430/476; 430/477; 430/484; 430/485

[58] Field of Search ..... 430/351, 377, 484, 485, 430/476, 425, 477, 386, 387, 389, 390

[56] References Cited

U.S. PATENT DOCUMENTS

| | | | |
|---|---|---|---|
| 3,656,950 | 4/1972 | Bent et al. | 430/384 |
| 3,658,525 | 4/1972 | Bent et al. | 430/362 |
| 4,623,616 | 11/1986 | Takada et al. | 430/545 |
| 4,647,528 | 3/1987 | Yamada et al. | 430/567 |
| 4,673,632 | 6/1987 | Okamura et al. | 430/510 |

*Primary Examiner*—Mukund J. Shah
*Attorney, Agent, or Firm*—Finnegan, Henderson, Farabow, Garrett & Dunner

[57] ABSTRACT

A method for processing a silver halide photographic material by processing a silver halide color photographic light-sensitive material containing at least a silver halide emulsion layer comprising a silver halide grain essentially consisting of silver chlorobromide and a binder having a swelling rate of T ½ of 2 sec. to 30 sec. The color developer contains a n-hydroxyalkyl-p-phenylenediamine derivative at a temperature not less than 30° C. for a time not more than 150 sec. The time and temperature are effective to process the silver halide color photographic light-sensitive material without decreasing the stability of the resulting dye image.

24 Claims, 1 Drawing Sheet

METHOD FOR COLOR-DEVELOPING A SILVER HALIDE PHOTOGRAPHIC LIGHT-SENSITIVE MATERIAL WITH A COLOR DEVELOPER CONTAINING AN N-HYDROXYALKYL-P-PHENYLENEDIAMINE DERIVATIVE

BACKGROUND OF THE INVENTION

The present invention relates to a method for color-developing a silver halide photographic light-sensitive material (hereinafter referred to as 'light-sensitive material'), particularly to a novel method for developing a light-sensitive material, which not only is little affected by the bromide ion concentration fluctuation caused by changes in the replenishing quantity and the influence of the evaporation of a processing solution as well as by the processing time but also by no means impair the rapidness of processing; which is capable of forming a highly preservable dye image excellent in the resistance against discoloration by light; and which produces little or no magenta color stain due to the mixing in of heavy-metallic ions, and more particularly to a developing method which can be highly stably effected, being replenished with a small amount of a replenisher.

The processing of a light-sensitive material consists basically of two processes: color developing process and desilvering process, and the desilvering process consists of bleaching and fixing processes or of a bleach-fix process. Besides, the processing includes some other additional processess such as rinsing process, stabilizing process, and the like.

In a color develoment, an exposed silver halide is reduced to become silver, and at the same time the oxidized product of an aromatic primary amine developing agent reacts with a coupler to form a dye. In this process, the halide ion produced in the field of the silver halide is dissolved out into the developing solution used and accumulated therein. Aside from this, components such as a development restrainer, etc., contained in the silver halide photographic light-sensitive material is also dissolved into the color developer solution and accumulated therein. In the desilvering process, the silver produced by the development is bleached by an oxidizing agent, and then all the silver salt is turned by a fixing agent into a soluble silver salt to be removed from the light-sensitive material. In addition, a mono-bath bleach-fix process that effects the bleaching process and fixing process simultaneously is also known.

In the color developer solution, as is afore-mentioned, such development restraining materials are gradually accumulated as a result of the development of the photographic light-sensitive material, while the color developing agent and benzyl alcohol are consumed or accumulated into the photographic light-sensitive material and carried out along with the light-sensitive material, so that the concentrations of these components become lowered. Accordingly, a developing process for continuously processing a large quantity of silver halide photographic light-sensitive materials by an automatic processor requires a means for maintaining each of the components of the color developer solution in a given concentration range in order to avoid changes in the finished characteristics by changes in the concentrations of the components. Usually used as such means is a method for replenishing the developer solution with a replenisher for the purpose of making up for the shortage of the consumed components and diluting and undesirably increased components. However, the replenishment causes necessarily a large amount of overflows and discharges of the developer solution, so that the method has now become a vital issue from the economical and environmental pollution point of view. Accordingly, in order to lessen the amount of the above-mentioned overflow, the use of a smaller amount of a concentrated replenisher, i.e., the high-concentration/low-replenishment method, has become popular, and aside from this, a method for adding a recycling agent to the overflow liquid to reuse the liquid as a replenisher has been proposed and now made practical reality.

The above-described methods are for substantially reducing the replenishing quantity. If the replenishing quantity is extremely reduced, the concentrations of the organic restrainer and halide ions being dissolved out into the developer solution are to be largely affected not only by only a small error in the replenishing quantity but also by the condensation of the solution due to its evaporation, thus usually resulting in the increase in the concentration of the foregoing exhaust accumulation. For example, such phenomena result in the problems that the increase in the halide ion concentration restrains the developing reaction, and the foot portion of the characteristic curve of the light-sensitive material being restained thereby results in the formation of an extremely high-contrast image. In order to avoid this, a method has been proposed which is such that the halide ion is removed from the overflow liquid by use of an ion exchange resin of electrodialysis and then to the liquid is added a recycling agent for making up for the shortage of the components consumed by development or in the recycling process to thereby reuse the liquid as a replenising liquid.

The recycling by such an ion exchange resin or electrodialysis and the high-concentration/low-replenishment method have the disadvantage that they are subject to the influence of evaporation or of the recycling operation and undergo the change in the bromide ion concentration, and besides, the difference in the processing quantity of the light-sensitive material, particularly the difference between the beginning of week in which the number of processing orders increases and the weekend in which the number of processing orders decreases or between the high season and the off season, appear to the extent of up to a proportion of 1:5, and in addition they are also affected by the difference in the replenishing quantity as well as by evaporation, thus causing the composition of the developer solution to become largely differed.

Therefore, in the low-replenishment method and the recycling method an effort should be made to maintain the composition constant by conducting a quantitative analysis each time of recycling, but practicing the recycling or low-replenishment process may be, in most cases, be difficult for those processing labs or small-scale photofinishers having no special skill for the analysis.

The foregoing problems are due mainly to changes in the bromide ion, a development restrainer. To improve this, for example, there have been those proposals to reduce the silver bromide content of the photographic light-sensitive material to thereby decrease the accumulated amount of bromide ions or to lessen the bromide ion concentration's fluctuation due to evaporation or to an error in the replenishing quantity (as described in Japanese Patent Publication open to Public Inspection [hereinafter referred to as Japanese Patent O.P.I. Publication] Nos. 173189/1984 and 205540/1984).

Such problems may be expected to be solved, e.g., by improving the developability through making smaller the average grain size of the silver halide contained in the photographic light-sensitive material or lowering the coating amount of silver. However, in a color developer solution containing a conventional developing agent 3-methyl-4-amino-N-ethyl-N-β-methanesulfonamidoethyl-aniline, if the developability is improved, the development, on the contrary, is easily affected by the fluctuation of the bromide ion concentration in the developer, impairing the processing stability, thus giving the results contrary to the expectation.

Nevertheless, it is essential that the processing stability is to be raised after the processing time is shortened.

A conventional processing of a color photographic paper comprised substantially of silver chlorobromide emulsions comprises color developing at 33° C. for 3 minutes and 30 seconds, bleach-fix at 33° C. for one minute and 30 seconds, washing for 3 minutes (or stabilizing for 3 minutes), and drying, totalling about 8 minutes, which is regarded as usual processing period. Although the strong needs of the times lie in the foregoing low-replenishment process from the economical point of view, the short-period processing is also strongly demanded from the standpoint of shortening the period for delivery.

However, as has been mentioned, the expeiditing and the stabilizing of the processing or the low repenishment are reciprocal problems, which have trade-off relations.

That is, if the development is made with low replenishment, the concentration of the bromide ion as a restrainer and the concentration of a sulfur compound or mercapto compound as an emulsion stabilizer increase to impair not only the rapidness but also the stability of the development.

However, various attempts have hitherto been made to expedite the color development. Particularly the foregoing developing agent, which has long been used as the most suitable agent for the development of silver chlorobromide emulsions, is slow in the permeation into the light-sensitive material because of its low hydrophilicity. In order to quicken the permeation, various types of permeating agent have been investigated, and as a result, for example, a method for expediting the color development by the addition of benzyl alcohol to a color developer solution has now been extensively used. This method, however, has the disadvantage that as long a development time as more than three minutes at 33° C. is required for an adequate color formation, and besides, the development is subject to the delicate influence of the bromide ion concentration. Increasing the pH of the color developer solution is also known as the method for improving the permeability, but it is disadvantageous in respect that, if the pH exceeds 10.5, the oxidation of the color developing agent is extremely accelerated, and the development becomes easily affected by changes in pH because of no suitable buffer available, and thus becomes unable to give any stable photographic characteristics or dependent largely upon the processing time.

Increasing the quantity of the color developing agent in the color developer solution to raise the activity thereof is also known, but makes the developer solution costly because the developing agent is much expensive, and at the same time produces such instability that the foregoing agent is less soluble and is prone to be deposited, and thus cannot be used practically.

On the other hand, other methods are known which, in order to carry out the speeding up of the color development, in advance incorporates a color developing agent into the light-sensitive material, for example, a method which incorporates a color developing agent in the form of a metallic salt thereof into the light-sensitive material is known (as described in U.S. Pat. No. 3,719,492). This method, however, is poor in the preservability of the light-sensitive material, and has the disadvantage that it is fogged before use or otherwise prone to be fogged in the course of the color development process.

Further, those methods (as described in U.S. Pat. No. 3,342,559 and Research Disclosure, 1976, No. 15159) which incorporate into the light-sensitive material a color developing agent, for example, in the form of a Schiff's salt in order to inactivate the amine portion thereof are also known. However, such methods have the disadvantage that the color developing agent can not start its color development until after its alkali hydrolysis, and on the contrary the method retards the color development.

Further, the direct incorporation of a color developing agent into the light-sensitive material has the disadvantage that the emulsion thereof tends to be fogged during the storage thereof due to the instability of the color developing agent, and in addition the incorporation causes various processing troubles due to the emulsion layer's physical quality weakened by the agent.

In addition, the acceleration of development by the addition of a 3-pyrazolidone compound to a black-and-white developer solution containing a developing agent such as hydroquinone is known (as described in, e.g., L.F.A. Mason, 'Photographic Processing Chemistry' p. 103–107, published by Focal Press, 1966). The fact of incorporating the compound into the light-sensitive material is described in British Pat. No. 767,704. However, the techniques described in the above patent specification are of the incorporation of the compound into a black-and-white light-sensitive material or into a reversal color light-sensitive material, the purpose of which incorporation is to accelerate the black-and-white image alone of such light-sensitive materials. And Japanese Patent O.P.I. Publication No. 52422/1978 describes the incorporation of a 3-pyrazolidone compound into a light-sensitive material for the purpose of preventing the deterioration of the sensitivity of an unexposed color light-sensitive material containing a two-equivalent magenta coupler having in the active site thereof an oxy-type organic split-off group. These techniques, however, are not applicable to such the speeding-up method characterized by stabilizing the color development in the low-replenishment system.

In order to expedite the color development by using conventionally known accelerating agents, these compounds have been investigated which are described in U.S. Pat. Nos. 2,950,970, 2,515,147, 2,496,903, 4,038,075 and 4,119,462, British Pat. Nos. 1,430,998 and 1,455,412, Japanese Patent O.P.I. Publication Nos. 15831/1978, 62450/1980, 62451/1980, 62452/1980 and 62453/1980, and Japanese Patent Examined Publication Nos. 12322/1976 and 49728/1980, and the like, but most of these compounds showed inadequate acceleration effects and the remaining showing high-acceleration effects not only had the disadvantage of producing a fog but were unsuitable for improving the processing stability.

The acceleration of the development by providing a silver halide emulsion layer substantially not light-sensitive in the light-sensitive material is known through the descriptions of Japanese Patent O.P.I. Publication Nos. 23225/1975 and 14236/1981, British Pat. No. 1,378,577, West German OLS Pat. No. 2,622,922, and the like. The function of the emulsion layer is to adsorb development inhibitors such as the useless halogen and useless split-off groups from the DIR couplers, DAR couplers, and the like, which all are released during the development, and is not to positively accelerate the developement, so that the emulsion layer showed little acceleration effects and no processing stability at all against the fluctuation of the bromide ion concentration, although it showed some effects against the fluctuation of the iodide ion concentration.

On the other hand, the color developing rate is said to be different according to the type of paraphenylenediamine derivatives used and to depend upon the oxidation-reduction potential of the developer solution used. Among such color developing agents the less-soluble-in-water-type color developing agent N-alkyl-substituted such as N,N-diethyl-p-phenylenediamine sulfate, 3-methyl-4-amino-N,N-diethylaniline hydrochloride, or the like, although highly active in development and capable of accelerating development, is known to be undesirable because of the low dark-discoloration characteristic of the formed dye therefrom after processing. Meanwhile, the 3-methyl-4-amino-N-ethyl-N-$\beta$-methoxyethylaniline-di-p-toluene sulfonate (described in U.S. Pat. Nos. 3,656,950 and 3,658,525) said to be favorable in respect of being highly active in development is certainly excellent in the acceleration but is not suitable for use in the rapid developing process because of the disadvantage thereof that it has no ability to stabilize the bromide ion concentration and produces a significant yellow stain in the unexposed area of the processed photographic light-sensitive material; particularly the color developing agent remains when a short-period development took place and thereby causes a coarse stain.

On the other hand, 3-methyl-4-amino-N-ethyl-$\beta$-methanesulfonamidoethylaniline-sesquisulfate-monohydrate and 3-methyl-4-amino-N-$\beta$-hydroxyethylaniline sulfate, etc., having a water-soluble alkylsulfonamido or hydroxyalkyl group-introduced N-alkyl group, as is described in Photographic Science and Engineering vol. 8, No. 3, May–June 1964, p. 125–137, have been said to be not so much different in the half-wave potential showing oxidation-reduction potential and to be both weak in the development activity.

Accordingly, there are few or no color developing agents being substantially active in the development of a silver chlorobromide emulsion and excellent in making the resulting dye image stable in aging, and in general, the foregoing purpose has been accomplished to date only by the use of 3-methyl-4-amino-N-ethyl-N-$\beta$-methanesulfonamidoethylaniline sulfate along with benzyl alcohol.

In this instance, however, the development is subject to the influence of the change in the bromide ion concentration as previously stated. And the high-concentration/low replenishment processing using a reduced amount of a replenisher has another problem of the increase in the accumulation by the mixing in of other processing liquid components. This is because the renewal rate of the tank liquid by the replenisher is lowered due to the reduced quantity of the replenisher and also because the using period of the liquid is elongated. The mixing in of other liquid components is brought about by the splash of the adjacent liquid inside a processor, or the carrying of the processing liquid components immediately after development into the color developer solution by the film transport leader, belt or film hanger, etc.,; i.e., the so-called 'back contamination'. Of such accumulated mixed-in components the thiosulfate ion as the fixing agent functions as a development accelerator. That is, this problem strongly occurs particularly when the light-sensitive material is processed in a bleach-fix bath immediately after color development. Especially, the mixing in of the thiosulfate ion accelerates the development of the shoulder portion of the photographic characteristic curve to thereby form a significantly high-contrast image. And the increase in the mixing in of a metallic salt, particularly a ferric salt, accelerates the decomposition of hydroxylamine as a preservative to thereby produce ammonia ions. The decomposition reaction is largely accelerated at a temperature above 30° C. The ammonia ion, similarly to the thiosulfate ion, has the disadvantage of accelerating physical development to form a significantly high-contrast image.

For the above reasons, it is the status quo that realization of an improved color developer solution is strongly demanded which is capable of rapidly processing by being replenished with only a small amount of a replenisher; capable of maintaining the photographic characteristics of a light-sensitive material constant; and also capable of stably processing a light-sensitive material without decomposition of the components and change in the photographic processing characteristics even when used over an extensive period of time.

SUMMARY OF THE INVENTION

It is therefore a first object of the present invention to provide a method of rapidly and stably processing a silver halide color photographic light-sensitive material, the said method using a color developer solution which is capable of always maintaining given proper photographic characteristics constant over a long period without being affected by changes in the bromide ion concentration even when used for processing being replenished with a small amount of a replenisher, and also capapble of giving an image whose dye-formed and non-color-formed portions will by no means fade away or discolor.

We studied variously for achieving the above-mentioned objects of the invention, they were resultantly successful in inventing a peculiar color developing agent almost not affected by a bromide-ion concentration when developing a specific silver halide. However, they were confronted with such an obstacle that the resulted color developing dyes are lowered in preservation stability, and they furtner studied on how to solve this obstacle.

As a result, we have now found that the above object can be accomplished by the following method: In a method for developing a silver halide color photographic light-sensitive material, said method comprising processing in a color developer solution containing an N-hydroxylalkyl-substituted p-phenylenediamine derivative for a period of equal to or less than 150 seconds at a temperature of not less than 30° C. a silver halide color photographic light-sensitive material comprising light-sensitive silver halide emulsion layers whose at least one layer is of a substantial silver chlorobromide emulsion, whose binder's layer swelling rate $T\frac{1}{2}$ is equal to or less than 30 seconds.

DETAILED DESCRIPTION OF THE INVENTION

Figure 1:
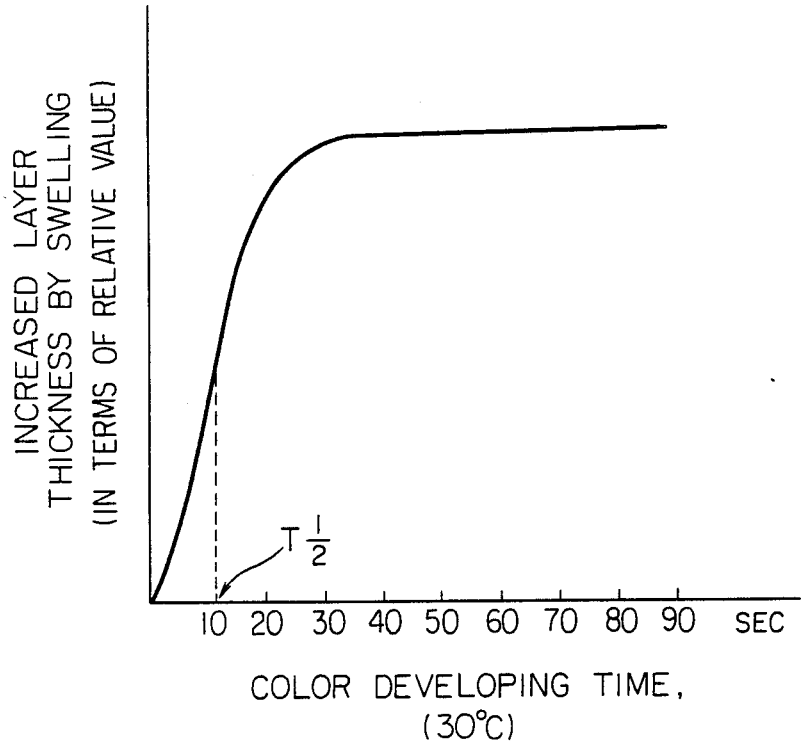
FIG. 1 is a graph showing the layer swelling rate $T\frac{1}{2}$ of the binder.

We have found a surprising fact that, in developing a color photographic light-sensitive material having a specific silver halide emulsion; i.e., an emulsion comprised principally of silver chlorobromide (particularly the silver bromide content is equal to or less than 90 mole%), the formed dye's density is hardly changed against the change in the bromide ion concentration only when an N-hydroxyalkyl-substituted-p-phenylenediamine derivative is used as the color developing agent. The foregoing feature of the color developing agent cannot be obtained in those color photographic light-sensitive materials having a substantial silver iodobromide emulsion containing not less than 0.5 mole% silver iodide, and cannot be expected from the fact that color developing agents of this type have hitherto been exclusively used for the devolopment of silver iodobromide emulsions; particularly, the fact that, in developing a color photographic light-sensitive material comprised substantially of a silver chlorobromide emulsion, the developing speed does not retard even when largely raising the bromide ion concentration is beyond our expectations, and the fact is not understood from the oxidation-reduction potential and half-wave potential of general color developing agents, and is probably impossible unless the optimum balance between the developing speed and the coupling speed is maintained; and hence surprising.

However, we have again encountered another obstacle. It is the fact that, where an N-hydroxyalkyl-substituted-p-phenylenediamine color developing agent is used, since the development can be carried out rapidly without being affected by changes in the bromide ion concentration, particularly under a high bromide ion concentration, it has the advantage that the replenishing quantity in a continuous processing can be largely reduced and the processing stability is significantly high, while on the other hand it has the disadvantage that the stability in aging, particularly the discoloration by light, of the resulting dye image is deteriorated. Deterioration of the stability in aging of the dye image, particularly in print materials, is a fatal blow, so that this is a large obstacle.

As a result of our continued effort to solve this question, we have found out that the above disadvantage is caused not by the deterioration of the stability in aging of the dye itself but by the tendency of the color developing agent to remain in the color photographic light-sensitive material, and this question can be solved particularly by shortening the color developing period of time. And we have ascertained that, although the shortening of the color developing period cannot be accomplished unless the developability of the color photographic light-sensitive material is adequately improved and therefore cannot be made unconditionally, realization of a higher development stability with use of a less quantity of replenisher without impairing the preservability of the formed dye image is accomplished on condition that the color developer solution of the present invention is used to make a development at a temperature of equal to or more than 30° C. for not longer than 150 seconds.

In this instance, however, there occurs another problem that, where a photographic light-sensitive material of the conventional type is used, the foregoing developing period is too short to obtain an adequate photographic image. Hereupon, we have further investigated and, in order to carry out the low-replenishment processing by use of the color developing agent of the present invention without being affected by changes in the bromide ion concentration, improved the developing speed by processing a color photographic light-sensitive material the silver halide emulsion of at least one layer, preferably the whole light-sensitive emulsion layers, of which is substantially a silver chlorobromide emulsion whose binder's layer swelling rate $T\frac{1}{2}$ is equal to or less than 30 seconds in and by a developer solution containing a N-hydroxyalkyl-substituted-p-phenylenediamine derivative. The above color photographic light-sensitive material is rapidly processed in the color developer solution of this invention at a temperature of equal to or more than 30° C. for not more than 150 seconds, whereby a rapid, highly stable and low-replenishment processing can be carried out without affecting the stability of the resulting dye image, and thus we have succeeded in accomplishing the foregoing object of the present invention.

In this specification, the 'substantial silver chlorobromide emulsion' implies that a slight amount of silver iodide is allowed to be contained in addition to silver chlorobromide; for example, not more than 0.3 mole%, more preferably not more than 0.1 mole% silver iodide is allowed to be contained. In this invention, however, a silver chlorobromide emulsion containing no silver iodide is most preferred.

The present invention will be further detailed below:

The hydrophilic binder for use in coating the silver halide of the color photographic light-sensitive material of the present invention is usually gelatin, but a high-molecular polymer may also be used, whose layer swelling rate $T\frac{1}{2}$ must be equal to or less than 30 seconds. The binder's layer swelling rate $T\frac{1}{2}$ may be measured and determined in accordance with any of those methods known to those skilled in the art; for example, may be measured by use of a swellometer of the type described in A. Green, Photo. Sci. Eng. vol. 19, No. 2, p. 124–129. The $T\frac{1}{2}$ is defined as the period required for the binder thickness to reach one half of the saturated thickness that is 90% of the maximum swelling thickness obtained when the light-sensitive material is color-developed at 30° C. for three minutes and thirty seconds (see FIG. 1).

The layer swelling rate $T\frac{1}{2}$ of the binder for the photographic component layers of the silver halide color photographic light-sensitive material of the present invention is equal to or less than 30 seconds and, although desirable to be as much small as possible, not allowed to be less than 2 seconds because, if less than the lower limit, the binder tends to produce a scratch trouble without being hardened, and particularly preferably equal to or less than 20 seconds, and most preferably equal to or less than 15 seconds. If more than 30 seconds, not only does the stability in aging of the formed dye image become deteriorated but no adequate dye formation can be obtained within 30 seconds. Adjustment of the coat swelling rate $T\frac{1}{2}$ can be made according to the using quantity of a hardening agent.

As for the light-sensitive emulsion layers of the silver halide color photographic light-sensitive material to be processed according to the present invention, at least one layer of the light-sensitive emulsion layers should be substantially of a silver chlorobromide emulsion, and preferably the whole light-sensitive emulsion layers should be of a silver chlorobromide emulsion. The smaller the silver bromide content mole% of the silver chlorobromide, the more adequately is the dye formed even when the color developing period is shorter, and therefore the silver bromide content is desirable to be equal to or less than 90 mole%, and most preferably from 40 mole% to 70 mole%; this range leads to the best results.

Further, the smallest possible coating amount of silver is desirable in respect that there occurs no retard of the development by the increase in the bromide and adequate dye formation can take place even in a short period, and the best effect can be obtained where the coating silver amount is not more than 1 $g/m^2$, and preferably from 0.1 to not more than 0.8 $g/m^2$, and most preferably from 0.2 to 0.7 $g/m^2$. The color development should take place at a temperature of equal to or more than 30° C. for not more than 150 seconds, preferably equal to or more than 33° C. for not more than 120 seconds, and most preferably equal to or more than 35° C. for not more than 90 seconds. If the development is made at a temperature of more than 30° C. for more than 150 seconds, the stability in aging of the formed dye becomes deteriorated. Particularly the developing period of time is more important than the temperature and, if it exceeds 150 seconds, the discoloration by light of the formed cyan dye is undesirably increased. The processing time is preferably 5 to 150 sec, and most preferably 10 to 110 sec. The purpose of using such the high developing temperature is to complete the development in a short time rather than for the stability in aging of the developed dye, and, if within the temperature range of from 33° to 50° C., the higher the temperature the more desirable because a shorter-period development is possible. The particularly preferred temperature range is from 33° C. to 48° C., and most preferably from 35° C. to 43° C.

Examples of the developing agent useful in the present invention are quaternary ammonium salts of N-hydroxyalkyl-substituted-p-phenylenediamine compounds, and particularly those having the following general formula:

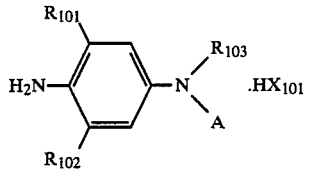

wherein $R_{101}$ is a hydrogen atom, an alkyl group having from 1 to 4 carbon atoms or an alkoxy group having from 1 to 4 carbon atoms; $R_{102}$ is a hydrogen atom or an alkyl group having from 1 to 4 carbon atoms; $R_{103}$ is a hydroxyl group-substitutable alkyl group having from 1 to 4 carbon atoms; A is an alkyl group having at least one hydroxyl group and being allowed to have a branched chain, and is more preferably

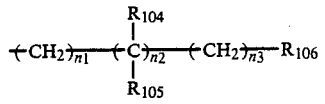

wherein $R_{104}$, $R_{105}$ and $R_{106}$ each is a hydrogen atom, a hydroxyl group or an alkyl group being allowed to have a hydroxyl group and having from 1 to 3 carbon atoms, provided that at least one of the $R_{104}$, $R_{105}$ and $R_{106}$ is a hydroxyl group or an alkyl group having a hydroxyl group; $n_1$, $n_2$ and $n_3$ each is an integer of zero, 1, 2 or 3; and $HX_{101}$ represents hydrochloric acid, sulfuric acid, p-toluenesulfonic acid, nitric acid or phosphoric acid.

Such the p-phenylenediamine color developing agent, because it is unstable in the free-amine form, is generally used in the form of a salt (most generally, in the above-defined form). The typical examples of the developing agent include 4-amino-3-methyl-N-ethyl-N-(β-hydroxyethyl)-aniline salts, 4-amino-N-ethyl-N-(β-hydroxyethyl)-aniline salts, and the like.

In the present invention, 4-amino-3-methyl-N-ethyl-N-(β-hydroxyethyl)-aniline sulfate-hydrate [this is commercially available in the name of 'CD-4', which has been used in most color photographic processes (for example, used for the development of color negative films for such the process as the Eastman Kodak Company's C41 process, the Konishiroku Photo Industry Company's CNK-4 process)] is preferred and particularly useful.

The preferred

N-hydroxyalkyl-substituted-p-phenylenediamine derivatives usable in this invention incude the following compounds, but are not limited thereto.

[Exemplified Compounds]

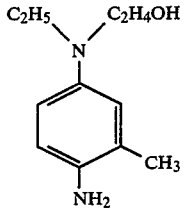

(1)

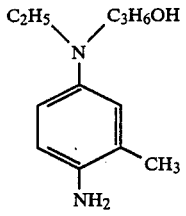

(2)

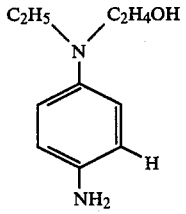

(3)

-continued (4)

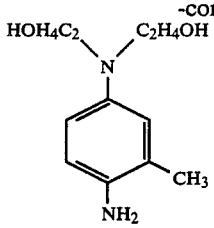

(5)

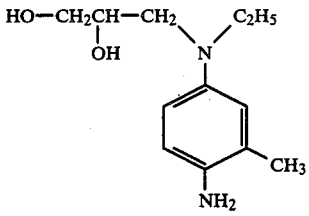

(6)

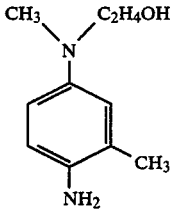

(7)

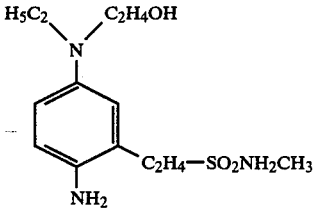

(8)

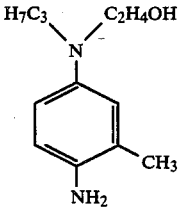

The hydrochlorides, sulfates and p-toluenesulfonates of the above compounds (1) through (8) are particularly preferred.

Of these exemplified compounds the compounds (1), (2), (6), (7) and (8) are more preferred, the (1), (2) and (6) are specially preferred, and further, the (1) is most suitably usable in this invention.

Since the solubility of these color developing agents in water is significantly high, the using quantity thereof is preferably from 1 g to 100 g per liter of the processing solution, and more preferably from 3 g to 30 g.

These N-hydroxyalkyl-substituted-p-phenylenediamine derivatives may be easily sysnthesized in accordance with the methods described in the Journal of American Chemical Society Vol. 73, Item 3100 (1951).

The bromide ion concentration of the color developer solution of this invention is preferred to be more than $5\times10^{-3}$, and in this invention the highest possible bromide ion concentration is favorable because the replenishing quantity can be so much lowered. In those conventional developing processes, since the bromide restrains the developing reaction, the smaller the bromide ion concentration, the more desirable. In the combination of the color photographic light-sensitive material with the color developer solution of the present invention, quite contrary to the above, the higher the bromide content the more preferred and the better is the object of the present invention accomplished. In other words, in this invention, the process in the above combination is hardly affected by bromide, the replenishing amount can be lowered.

The bromide content is preferably equal to or more than $1\times10^{-2}$ mole, and particularly preferably equal to or more than $1.5\times10^{2}$. The bromide ion concentration, if too high, restrains the development, so that more than $6\times10^{-2}$, the point at which the influence of the bromide ion concentration begins to appear, is undesirable. In addition, the development is not affected by the chloride concentration.

In the case of carrying our a continuous process in the methods of the invention, the developer replenishment may be used in an amount of not more than 250 ml per sq. m of a silver halide color light-sensitive material processed, and, more preferably, not more than 200 ml, and most preferably from 20 to 80 ml.

The color photographic light-sensitive material of this invention exhibits the best effect when, in a multilayer color photographic light-sensitive material comprising three or more layers including blue-sensitive, green-sensitive and red-sensitive emulsions layers, ½ of the period required for the layers' swelling time to become the maximum; i.e., the coat swelling rate $T_{\frac{1}{2}}$ is equal to or less than 30 seconds. the total thickness of the layers should be not more than 14 μm, preferably not more than 13 μm, and particularly preferably not more than 12 μm, and in any of these cases the $T_{\frac{1}{2}}$ is desirable to be equal to or less than 30 seconds.

The magenta couplers which may be used in the green-sensitive emulsion layers of the photographic light-sensitive materials relating to the invention include, more preferably, the compounds represented by the following Formula [I].

When using the compounds, magenta fog may be kept substantially lower in the unexposed areas of a light-sensitive material.

Formula [I]

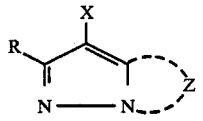

Z represents a group of nonmetallic atoms necessary to form a nitrogen-containing heterocyclic ring, and the ring formed by the Z may have a substituent.

X is a hydrogen atom or a substituent than can be split off by the reaction with the oxidized product of a color developing agent, and, R is a hydrogen atom or a substituent.

Examples of the foregoing R include halogen atoms, alkyl groups, cycloalkyl groups, alkenyl groups, cycloalkenyl groups, alkinyl groups, aryl groups, heterocyclic groups, acyl groups, sulfonyl groups, sulfinyl groups, sulfonyl groups, carbamoyl groups, sulfamoyl groups, cyano group, spiro compound residues, cross-linked hydrocarbon compound residues, alkoxy groups, aryloxy groups, heterocyclic oxy groups, siloxy groups, acyloxy groups, carbamoyloxy groups, amino groups, acylamino groups, sulfonamido groups, imido groups, ureido groups, sulfamoylamino groups, alkoxycarbonylamino groups, aryloxycarbonylamino groups, alkoxycarbonyl groups, aryloxycarbonyl groups, alkylthio groups, arylthio groups and heterocyclic thio groups.

The halogen atoms include, e.g., chlorine atom and bromine atom, and particularly the chlorine atom is preferred.

The alkyl groups represented by the R include those having from 1 to 32 carbon atoms, the alkenyl and alkinyl groups include those having from 2 to 32 carbon atoms, the cycloalkyl and cycloalkenyl groups include those having from 3 to 12 carbon atoms, particularly preferably from 5 to 7 carbon atoms, the said alkyl, alkenyl and alkinyl groups each being allowed to be straight-chain or branched-chain.

These alkyl, alkenyl, alkinyl, cycloalkyl and cycloalkinyl groups each may have a substituent [such as, e.g., an aryl, cyano, halogen, heterocyclic, cycloalkyl or cycloalkenyl group, or spiro compound residue or cross-linked hydrocarbon compound residue, or other group substituting through a carbonyl group such as an acyl, carboxy, carbamoyl, alkoxycarbonyl, aryloxycarbonyl or the like group; or a group substituting through a hetero atom {such as one substituting through an oxygen atom such as a hydroxy, alkoxy, aryloxy, heterocyclic oxy, siloxy, acyloxy, carbamoyloxy or the like group, or one substituting through a nitrogen atom such as a sulfamoylamino, alkoxycarbonylamino, aryloxycarbonylamino, acylamino, sulfonamido, imido, ureido or the like group, or one substituting through a sulfur atom such as an alkylthio, arylthio, heterocyclic thio, sulfonyl, sulfinyl, sulfamoyl or the like group, or one substituting through a phosphorus atom such as a phosphonyl group} or the like].

To be concrete, examples of the R include, e.g., methyl, isopropyl, t-butyl, pentadecyl, heptadecyl, 1-hexylnonyl, 1,1-dipentylnonyl, 2-chloro-t-butyl, trifluoromethyl, 1-ethoxytridecyl, 1-methoxyisopropyl, methanesulfonylethyl, 2,4-di-t-amylphenoxymethyl, anilino, 1-phenylisopropyl, 3-m-butanesulfonaminophenoxypropyl, 3-4'-{α-[4''(p-hydroxybenzenesulfonyl)phenoxy]dodecanoylamino}phenylpropyl, 3-{4'-[α-(2'',4''-di-t-amylphenoxy)butaneamido]phenyl}-propyl, 4-[α-(o-chlorophenoxy)tetradecaneamidophenoxy]propyl, aryl, cyclopentyl, cyclohexyl and the like groups.

The aryl group represented by the R is preferably phenyl group, which may have a substituent (such as an alkyl, alkoxy, acylamino or the like group); to be concrete, phenyl, 4-t-butylphenyl, 2,4-di-t-amylphenyl, 4-tetradecaneamidophenyl, hexadecyloxyphenyl, 4'-[α-(4''-t-butylphenoxy)tetradecaneamido]phenyl or the like group.

Examples of the heterocyclic group represented by the R are preferably those 5- to 7-member rings, which may have a substituent and may also be condensed, and include 2-furyl, 2-thienyl, 2-pyrimidinyl, 2-benzothiazolyl and the like groups.

Examples of the acyl group represented by the R include alkylcarbonyl groups such as acetyl, phenylacetyl, dodecanoyl, α-2,4-di-t-amylphenoxybutanoyl and the like groups, and arylcarbonyl groups such as benzoyl, 3-pentadecyloxybenzoyl, p-chlorobenzoyl and the like groups.

Examples of the sulfonyl group represented by the R include alkylsulfonyl groups such as methylsulfonyl, dodecylsulfonyl and the like groups, and arylsulfonyl groups such as benzenesulfonyl, p-toluenesulfonyl and the like groups.

Examples of the sulfinyl group represented by the R include alkylsulfinyl groups such as ethylsulfinyl, octylsulfinyl, 3-phenoxybutylsulfinyl and the like groups, and arylsulfinyl groups such as phenylsulfinyl, m-pentadecylsulfinyl and the like groups.

Examples of the phosphonyl group represented by the R include alkylphosphonyl groups such as butyloctylphosphonyl group, alkoxyphosphonyl groups such as octyloxyphosphonyl group, aryloxyphosphonyl groups such as phenoxyphosphonyl group, arylphosphonyl groups such as phenylphosphonyl group and the like.

The carbamoyl group represented by the R may be substituted by an alkyl or aryl group (preferably phenyl) and examples thereof include N-methylcarbamoyl, N,N-dibutylcarbamoyl, N-(2-pentadecyloctylethyl)carbamoyl, N-ethyl-N-dodecylcarbamoyl, N-{3-(2,4-di-t-amylphenoxy)propyl}carbamoyl and the like groups.

The sulfamoyl group represented by the R may be substituted by an alkyl or aryl group (preferably phenyl) and examples thereof include N-propylsulfamoyl, N,N-diethylsulfamoyl, N-(2-pentadecyloxyethyl)-sulfamoyl, N-ethyl-N-dodecylsulfamoyl, N-phenylsulfamoyl and the like groups.

Examples of the spiro compound residue represented by the R include spiro[3.3]heptane-1-yl group and the like.

Examples of the cross-linked hydrocarbon compound residue represented by the R include bicyclo[2.2.1]heptane-1-yl, tricyclo[3.3.1.1$^{3'7}$]decane-1-yl, 7,7-dimethylbicyclo[2.2.1]heptane-1-yl and the like.

The alkoxy group represented by the R may be further substituted by any one of those defined as the substituent to the foregoing alkyl groups and examples thereof include methoxy, propoxy, 2-ethoxyethoxy, pentadecyloxy, 2-dodecyloxyethoxy, phenthyloxyethoxy and the like groups.

The aryloxy group represented by the R is preferably phenyloxy and the aryl nucleus thereof may be further substituted by any one of those substituents or atoms to the foregoing aryl group, and examples thereof include phenoxy, p-t-butylphenoxy, m-pentadecylphenoxy and the like groups.

The heterocyclic oxy group represented by the R is desirable to be one having a 5- to 7-member heterocyclic ring which may have a further a substituent, and examples thereof include 3,4,5,6-tetrahydropyranyl-2-oxy, 1-phenyltetrazole-5-oxy and the like groups.

The siloxy group represented by the R may be further substituted by an alkyl or the like group, and examples thereof include trimethylsiloxy, triethylsiloxy, dimethylbutylsiloxy, and the like groups.

Examples of the acyloxy group represented by the R include alkylcarbonyloxy, arylcarbonyloxy and the like groups, each of which groups may have further a substituent, examples of which include acetyloxy, α-chloroacetyloxy, benzoyloxy and the like groups.

The carbamoyloxy group represented by the R may be substituted by an alkyl or aryl group, and examples thereof include N-ethylcarbamoyloxy, N,N-diethylcarbamoyloxy, N-phenylcarbamoyloxy and the like groups.

The amino group represented by the R may be substituted by an alkyl or aryl group (preferably phenyl), and examples thereof include ethylamino, anilino, m-chloroanilino, 3-pentadecyloxycarbonylanilino, 2-chloro-5-hexadecaneamidoanilino and the like groups.

Examples of the acylamino group represented by the R include alkylcarbonylamino, arylcarbonylamino (preferably phenylcarbonylamino) and the like groups, which each may have further a substituent, examples of which include acetamido, α-ethylpropaneamido, N-phenylacetamido, dodecaneamido, 2,4-di-t-amylphenoxyacetamido, α-3-t-butyl-4-hydroxyphenoxybutaneamido and the like groups.

Examples of the sulfonamido group represented by the R include alkylsulfonylamino, arylsulfonylamino, and the like groups, which each may have further a substituent, examples of which include methylsulfonylamino, pentadecylsulfonylamino, benzenesulfonylamino, p-toluenesulfonamido, 2-methoxy-5-t-amylbenzenesulfonamido and the like groups.

The imido group represented by the R may be either open-chain or cyclic and may have a substituent, examples thereof include succinic acid imido, 3-heptadecylsuccinic acid imido, phthalimido, glutarimido and the like groups.

The ureido group represented by the R may be substituted by an alkyl or aryl group (preferably phenyl) and examples thereof include N-ethylureido, N-methyl-N-decylureido, N-phenylureido, N-p-tolylureido and the like groups.

The sulfamoylamino group represented by the R may be substituted by an alkyl or aryl group (preferably phenyl), and examples thereof include N,N-dibutylsulfamoylamino, N-methylsulfamoylamino, N-phenylsulfamoylamino and the like groups.

The alkoxycarbonylamino group represented by the R may have further a substituent and examples thereof include methoxycarbonylamino, methoxyethoxycarbonylamino, octadecyloxycarbonylamino and the like groups.

The aryloxycarbonylamino represented by the R may have a substituent, and examples thereof include phenoxycarbonylamino, 4-methylphenoxycarbonylamino and the like groups.

The alkoxycarbonyl group represented by the R may have further a substituent, and examples thereof include methoxycarbonyl, butyloxycarbonyl, dodecyloxycarbonyl, octadecyloxycarbonyl, ethoxymethoxycarbonyloxy, benzyloxycarbonyl and the like groups.

The aryloxycarbonyl group represented by the R may have further a substituent, and examples thereof include phenoxycarbonyl, p-chlorophenoxycarbonyl, m-pentadecyloxyphenoxycarbonyl and the like groups.

The alkylthio group represented by the R may have further a substituent, and examples thereof include ethylthio, dodecylthio, octadecylthio, phenethylthio, 3-phenoxypropylthio and the like groups.

The arylthio group represented by the R is preferably phenylthio group and may have further a substituent, and examples thereof include phenylthio, p-methoxyphenylthio, 2-t-octylthio, 3-octadecylphenylthio, 2-carboxyphenylthio, p-acetaminophenylthio and the like groups.

The heterocyclic thio group represented by the R is preferably a 5- to 7-member heterocyclic thio group and may have further a condensed ring and may also have a substituent, and examples thereof include 2-pyridylthio, 2-benzothiazolylthio, 2,4-diphenoxy-1,3,5-triazole-6-thio and the like groups.

Examples of the substituent represented by the X, which can be split off by the reaction with the oxidized product of a color developing agent, include halogen atoms (such as chlorine, bromine, fluorine) and groups substituting through carbon, oxygen, sulfur or nitrogen atom.

Examples of the group substituting through a carbon atom include a carboxy group; those groups having the general formula:

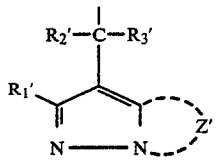

(wherein $R_1'$ is as defined in the foregoing R; Z' is as defined in the foregoing Z; and $R_2'$ and $R_3'$ each is a hydrogen atom, an aryl group, an alkyl group or a heterocyclic group); hydroxymethyl, triphenylmethyl and the like groups.

Examples of the group substituting through an oxygen atom include alkoxy, aryloxy, heterocyclic oxy, acyloxy, sulfonyloxy, alkoxycarbonyloxy, aryloxycarbonyloxy, alkyloxalyloxy, alkoxyoxalyloxy and the like groups.

The alkoxy group may have further a substituent, and examples thereof include ethoxy, 2-phenoxyethoxy, 2-cyanoethoxy, phenethyloxy, p-chlorobenzyloxy, and the like groups.

The aryloxy group is preferably a phenoxy group and may have further a substituent, and examples thereof include phenoxy, 3-methylphenoxy, 3-dodecylphenoxy, 4-methanesulfonamidophenoxy, 4-[α-(3'-pentadecylphenoxy)butaneamido]phenoxy, hexadecylcarbamoylmethoxy, 4-cyanophenoxy, 4-methanesulfonylphenoxy, 1-naphthyloxy, p-methoxyphenoxy and the like groups.

The heterocyclic oxy group is preferably a 5- to 7-member heterocyclic oxy group and may be a condensed ring and may also have a substituent, and examples thereof include 1-phenyltetrazolyloxy, 2-benzothiazolyloxy and the like groups.

Examples of the acyloxy group include alkylcarbonyloxy groups such as acetoxy, butanoloxy and the like groups, and alkenylcarbonyloxy groups such as cinnamoyloxy group, and arylcarbonyloxy groups such as benzoyloxy group.

Examples of the sulfonyloxy group include butanesulfonyloxy and methanesulfonyloxy groups.

Examples of the alkoxycarbonyloxy group include ethoxycarbonyloxy and benzyloxycarbonyloxy groups.

Examples of the aryloxycarbonyl group include phenoxycarbonyloxy group.

Examples of the alkyloxalyloxy group include methyloxalyloxy group.

Examples of the alkoxyoxalyloxy group include ethoxyoxalyloxy group.

Examples of the group substituting through a sulfur atom include alkylthio, arylthio, heterocyclic thio and alkoxythiocarbonylthio groups.

Examples of the alkylthio group include butylthio, 2-cyanoethylthio, phenethylthio, benzylthio and the like groups.

Examples of the arylthio group include phenylthio, 4-methanesulfonamidophenylthio, 4-dodecylphenethylthio, 4-nonafluoropentaneamidophenethylthio, 4-carboxyphenylthio, 2-ethoxy-5-t-butylphenylthio and the like groups.

Examples of the heterocyclic thio group include 1-phenyl-1,2,3,4-tetrazolyl-5-thio, 2-benzothiazolylthio and the like groups.

Examples of the alkylthiocarbonylthio group include dodecyloxythiocarbonylthio group.

Examples of the above group substituting through a nitrogen atom include those having the formula:

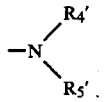

wherein $R_4'$ and $R_5'$ each is a hydrogen atom, an alkyl, aryl, heterocyclic, sulfamoyl, carbamoyl, acyl, sulfonyl or aryloxycarbonyl group, the $R_4'$ and $R_5'$ being allowed to be combined to form a heterocyclic ring, provided that the $R_4'$ and $R_5'$ each is not a hydrogen at the same time.

The alkyl group may be either straight-chain or branched-chain and has preferably from 1 to 22 carbon atoms, and may have a substituent. Examples of the substituent include aryl, alkoxy, aryloxy, alkylthio, arylthio, alkylamino, arylamino, acylamino, sulfonamido, imino, acyl, alkylsulfonyl, arylsulfonyl, carbamoyl, sulfamoyl, alkoxycarbonyl, aryloxycarbonyl, alkyloxycarbonylamino, aryloxycarbonylamino, hydroxyl, carboxyl and cyano groups and halogen atoms. Examples of the alkyl group include ethyl, hexyl, 2-ethylhexyl and 2-chloroethyl groups.

The aryl group represented by the $R_4'$ or $R_5'$ has from 6 to 32 carbon atoms and is preferably a phenyl or naphthyl group and may have a substituent. Examples of the substituent include those defined as the substituent to the alkyl groups represented by the foregoing $R_4'$ or $R_5'$; and alkyl groups. Examples of the aryl group include phenyl, 1-naphthyl and 4-methylsulfonylphenyl groups.

The heterocyclic group represented by the $R_4'$ or $R_5'$ is preferably a 5- or 6-member ring, may be a condensed ring, and may also have a substituent, and examples thereof include 2-furyl, 2-quinolyl, 2-pyrimidyl, 2-benzothiazolyl, 2-pyridyl and the like groups.

Examples of the sulfamoyl group represented by the $R_4'$ or $R_5'$ include N-alkylsulfamoyl, N,N-dialkylsulfamoyl, N-arylsulfamoyl, N,N-diarylsulfamoyl and the like groups, and the alkyl and aryl groups thereof each may have any one of those defined as the substituent to the foregoing alkyl and aryl groups. Concrete examples of the sulfamoyl group include N,N-diethylsulfamoyl, N-methylsulfamoyl, N-dodecylsulfamoyl and N-p-tolylsulfamoyl groups.

The carbamoyl group represented by the $R_4'$ and $R_5'$ include N-alkylcarbamoyl, N,N-dialkylcarbamoyl, N-arylcarbamoyl, N,N-diarylcarbamoyl and the like groups, and the alkyl and aryl groups thereof each may have any one of those defined as the substituent to the foregoing alkyl and aryl groups. Concrete examples of the carbamoyl group include N,N-diethylcarbamoyl, N-methylcarbamoyl, N-dodecylcarbamoyl and N-p-cyanophenylcarbamoyl groups.

Examples of the acyl group represented by the $R_4'$ and $R_5'$ include alkylcarbonyl, arylcarbonyl and heterocyclic carbonyl groups, and the alkyl, aryl and heterocyclic groups thereof each may have a substituent. Concrete examples of the acyl group include hexafluorobutanoyl, 2,3,4,5,6-pentafluorobenzoyl, acetyl, benzoyl, naphthoyl, 2-furylcarbonyl and the like groups.

Examples of the sulfonyl group represented by the $R_4'$ or $R_5'$ include alkylsulfonyl, arylsulfonyl and heterocyclic sulfonyl groups, which each may have a substituent. Concrete examples of the sulfonyl group include ethanesulfonyl, benzenesulfonyl, octanesulfonyl, naphthalenesulfonyl, p-chlorobenzenesulfonyl and the like groups.

The aryloxycarbonyl group represented by the $R_4'$ or $R_5'$ may have any one of those defined as the substituent to the foregoing aryl group, and examples thereof include phenoxycarbonyl group and the like.

The alkoxycarbonyl group represented by the $R_4'$ or $R_5'$ may have any one of those defined as the substituent to the foregoing alkyl group, and examples thereof include methoxycarbonyl, dodecyloxycarbonyl, benzyloxycarbonyl and the like groups.

The heterocyclic ring formed by the combination of the $R_4'$ and RHd 5' is preferably a 5- or 6-member ring and may be either saturated or unsaturated, may be either aromatic or nonaromatic, and may be a condensed ring. Examples of the heterocyclic group include N-phthalimido, N-succinic acid imido, 4-N-urazolyl, 1-N-hydantoinyl, 3-N-2,4-dioxo-oxaxolidinyl, 2-N-1,1-dioxo-3-(2H)-oxo-1,2-benzothiazolyl, 1-pyrrolyl, 1-pyrrolidinyl, 1-pyrazolyl, 1-pyrazolidinyl, 1-piperidinyl, 1-pyrrolinyl, 1-imidazolyl, 1-imidazolinyl, 1-indolyl, 1-isoindolinyl, 2-isoindolyl, 2-isoindolinyl, 1-benzotriazolyl, 1-benzimidazolyl, 1-(1,2,4-triazolyl), 1-(1,2,3-triazolyl), 1-(1,2,3,4-tetrazolyl), N-morpholinyl, 1,2,3,4,-tetrahydroquinolyl, 2-oxo-1-pyrrolidinyl, 2-1H-pyridone, phthaladione, 2-oxo-1-piperidinyl and the like groups. These heterocyclic groups each may be substituted by an alkyl, aryl, alkyloxy, aryloxy, acyl, sulfonyl, alkylamino, arylamino, acylamino, sulfonamino, carbamoyl, sulfamoyl, alkylthio, arylthio, ureido, alkoxycarbonyl, aryloxycarbonyl, imido, nitro, cyano or carboxy group or a halogen atom.

Examples of the nitrogen-containing heterocyclic ring formed by the Z or Z' include pyrazole ring, imidazole ring, triazole ring or tetrazole ring, which each may have a substituent being any one of those defined as the substituent to the foregoing R.

Where the substituent (e.g., R, $R_1$ through $R_8$) to the heterocyclic ring in the foregoing Formula [I] and Formulas [II] through [VIII] which will be described hereinafter has a portion having the following general formula

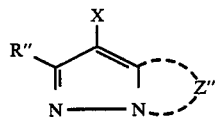

(wherein R'', X and Z'' are as defined in the R, X and Z, respectively, of Formula [I]), the compound forms a bis-type coupler, which is of course included in the present invention. The ring formed by Z, Z', Z'' or $Z_1$ may be further condensed with another ring (e.g., 5- to 7-member cycloalkene); for example, each of the pairs, the $R_5$ and $R_6$ of Formula [V] and the $R_7$ and $R_8$ of Formula [VI], may be combined with each other to form a ring (such as a 5- to 7-member cycloalkene, benzene).

Those having Formula [I] may be more concretely represented by, e.g., the following general formulas [II] through [VII]:

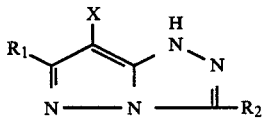

Formula [II]

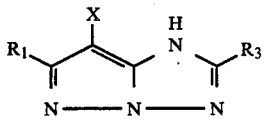

Formula [III]

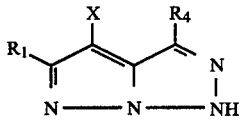

Formula [IV]

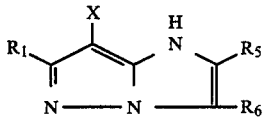

Formula [V]

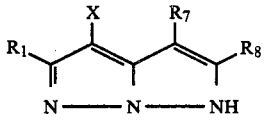

Formula [VI]

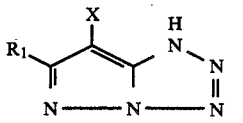

Formula [VII]

In the above Formulas [II] through [VII], $R_1$ through $R_8$ are as defined previously in the foregoing R and X, respectively. The preferred ones among those having Formula [I] are those compounds having the following general formula [VIII]:

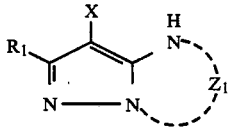

Formula [VIII]

wherein $R_1$, X and $Z_1$ are as defined in the R, X and Z of Formula [1].

The particularly preferred ones of those magenta couplers having Formulas [II] through [VII] are those having Formula [II].

In a light-sensitive material for positive image making use, regarding the substituent to the heterocyclic ring represented by Formulas [I] through [VIII], the R of Formula [I] and the $R_1$ of Formulas [II] through [VIII] should satisfy preferably the following condition 1, more preferably the following conditions 1 and 2, and most preferably the following conditions 1, 2 and 3:

Condition 1: The atom that is directly bonded to the heterocyclic ring is a carbon atom.

Condition 2: One hydrogen atom is bonded to or no hydrogen atom is bonded at all to the carbon atom.

Condition 3: The carbon atom and the adjacent atom thereto are always combined by a single bond.

The most preferred substituents represented by the R and $R_1$ to the foregoing heterocyclic ring are those having the following general formula [IX]:

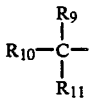

Formula [IX]

wherein $R_9$, $R_{10}$ and $R_{11}$ each is a hydrogen atom, a halogen atom, an alkyl, cycloalkyl, alkenyl, cycloalkenyl, alkinyl, aryl, heterocyclic, acyl, sulfonyl, sulfinyl, phosphonyl, carbamoyl, sulfamoyl, cyano, spiro compound residue, cross-linked hydrocarbon compound residue, alkoxy, aryloxy, heterocyclic oxy, siloxy, acyloxy, carbamoyloxy, amino, acylamino, sulfonamido, imido, ureido, sulfamoylamino, alkoxycarbonylamino, aryloxycarbonylamino, alkoxycarbonyl, aryloxycarbonyl, alkylthio, arylthio or heterocyclic thio group, provided that at least two of the $R_9$, $R_{10}$ and $R_{11}$ do not represent hydrogen at the same time.

Two of the $R_9$, $R_{10}$ and $R_{11}$, for example, the $R_9$ and $R_{10}$ may be combined to form a saturated or unsaturated ring (such as cycloalkane, cycloalkene, heterocyclic ring), and further to the ring may be combined the $R_{11}$ to constitute a cross-linked hydrocarbon compound residue.

The group represented by the $R_9$ through $R_{11}$ may have a substituent, and examples of the group represented by the $R_9$ through $R_{11}$ and of the substituent which the group may have include the same examples of the R and the substituent thereto as defined in Formula [I]

Examples of the ring formed by the combination of, e.g., the $R_9$ with $R_{10}$, of the cross-linked hydrocarbon compound residue formed by the $R_9$ through $R_{11}$, and of the substituent which they may have include the same examples of the cycloalkyl, cycloalkenyl and heterocyclic groups and cross-linked hydrocarbon compound residue as defined in the R of the foregoing Formula [I].

The preferred cases of Formula [IX] are where (i) two of the $R_9$ through $R_{11}$ are alkyl groups, and (ii) one of the $R_9$ through $R_{11}$, e.g., $R_{11}$, is a hydrogen atom and the other two, the $R_9$ and $R_{10}$, are combined to form a cycloalkyl group along with the carbon atom close thereto.

Further, the preferred case of (i) is where two of the $R_9$ through $R_{11}$ are alkyl groups and the other one is a hydrogen atom or an alkyl group.

The alkyl and cycloalkyl groups herein each may have a substituent, and examples of the alkyl and cycloalkyl groups and the substituent thereto include the same examples of the alkyl and cycloalkyl groups and the substituent thereto as defined in the R of the foregoing Formula [I].

The preferred ones as the substituent which the ring formed by the Z of Formula [I] and the ring formed by the $Z_1$ of Formula [VIII] may have and as the $R_2$ through $R_8$ of Formulas [II] through [VI] are those having the following general formula [X]:

$$-R^1-SO_2-R^2$$ Formula [X]

wherein $R^1$ is an alkylene group, $R^2$ is an alkyl, cycloalkyl or aryl group.

The alkylene group represented by the $R^1$ is one whose straight-chain portion has preferably equal to or more than 2 carbon atoms, more preferably from 3 to 6 carbon atoms, and may be either straight-chain or branched-chain. And the alkylene group may have a substituent.

Examples of the substituent include the same examples as those of the substituent which, where the R of Formula [I] is an alkyl group, the alkyl group may have.

The preferred one as the substituent is phenyl.

The preferred examples of the alkylene group represented by the $R^1$ will be given below:

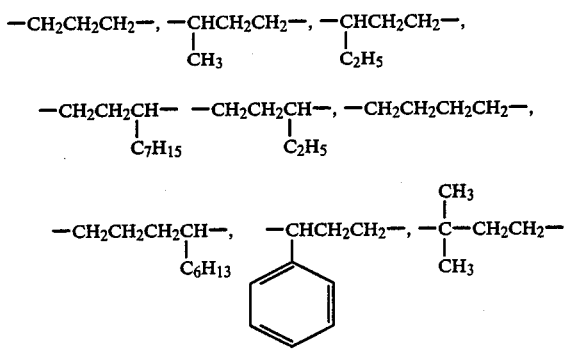

The alkylene group represented by the $R^2$ may be either straight-chain or branched-chain. Concrete examples of the group include methyl, ethyl, propyl, isopropyl, butyl, 2-ethylhexyl, octyl, dodecyl, tetradecyl, hexadecyl, octadecyl, 2-hexyldecyl and the like groups.

The cycloalkyl group represented by the $R^2$ is preferably a 5- or 6-member ring, and examples thereof include cyclohexyl group.

The alkyl and cycloalkyl groups represented by the $R^2$ each may have a substituent, and examples thereof include the examples of the substituent to the above $R^1$.

Examples of the aryl group represented by the $R^2$ include phenyl and naphthyl groups. The aryl group may have a substituent. Examples of the substituent include straight-chain and branched-chain alkyl groups and also those exemplified as the substituent to the foregoing $R^1$.

Where there are two or more substituents, these substituents may be either different or the same.

The particularly preferred ones among those compounds having the foregoing Formula [I] are those having the following general formula [XI]:

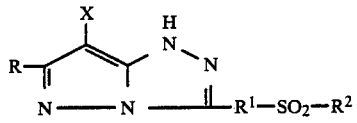

Formula [XI]

wherein R and X are as defined previously in the R and X of Formula [I], and $R^1$ and $R^2$ are as defined in the $R^1$ and $R^2$ of Formula [X].

And in a negative-type light-sensitive material, regarding the substituent to the heterocyclic ring in Formulas [I] through [VIII], the preferred case is where the R of Formula [I] and the $R_1$ of Formulas [II] through [VIII] satisfy the following Condition 1, and the more preferred case is where they satisfy the following Conditions 1 and 2:

Condition 1: The carbon atom directly bonded to the heterocyclic ring is a carbon atom.

Condition 2: At least two hydrogen atoms are bonded to or no hydrogen atom is bonded at all to the carbon atom.

The most preferred ones as the substituents R and $R_1$ to the foregoing heterocyclic ring are those having the following general formula [XII]:

$R_{12}$—$CH_2$— Formula [XII]

wherein $R_{12}$ represents a hydrogen atom, a halogen atom, an alkyl, cycloalkyl, alkenyl, cycloalkenyl, alkinyl, aryl, heterocyclic, acyl, sulfonyl, sulfinyl, phosphonyl, carbamoyl, sulfamoyl, cyano, spiro compound residue, cross-linked hydrocarbon compound residue, alkoxy, aryloxy, heterocyclic oxy, siloxy, acyloxy, carbamoyloxy, amino, acylamino, sulfonamido, imido, ureido, sulfamoylamino, alkoxycarbonylamino, aryloxycarbonylamino, alkoxycarbonyl, aryloxycarbonyl, alkylthio, arylthio or heterocyclic thio group.

The group represented by the $R_{12}$ may have a substituent. Examples of the group represented by the $R_{12}$ and of the substituent which the group may have include the same examples of the group represented by the R and of the substituent thereto as defined in the foregoing Formula [I].

Further, the preferred one as the $R_{12}$ is a hydrogen atom or an alkyl group.

The following are examples of the compound to be used in the present invention.

M-1

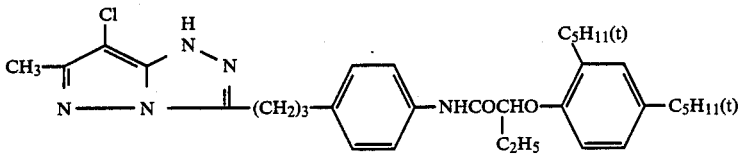

M-2

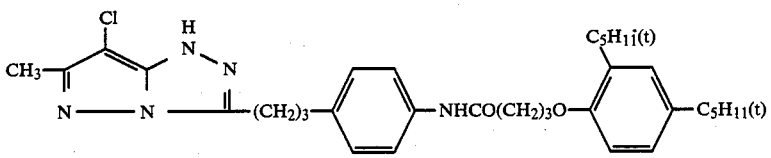

-continued
M-3
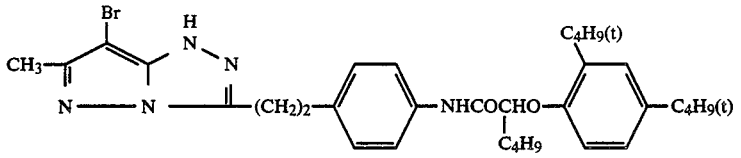
M-4
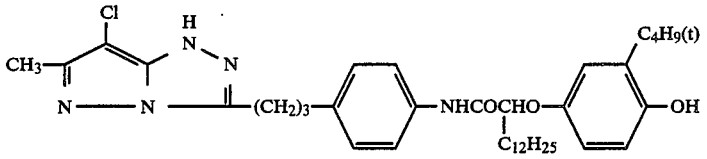
M-5
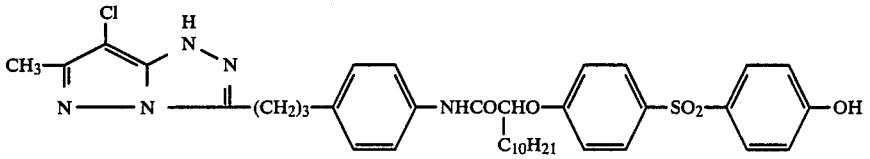
M-6
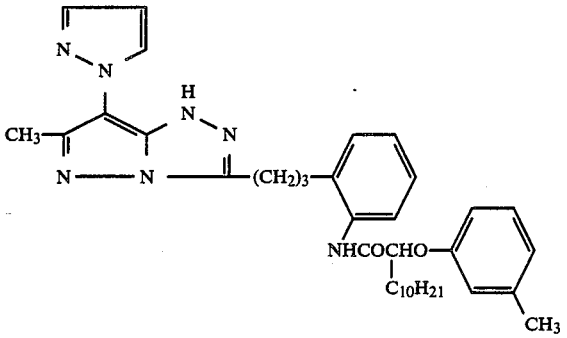
M-7
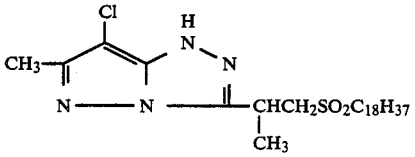
M-8
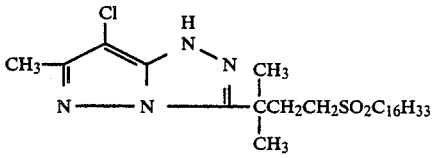
M-9
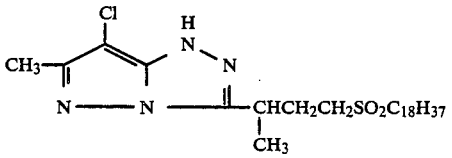
M-10
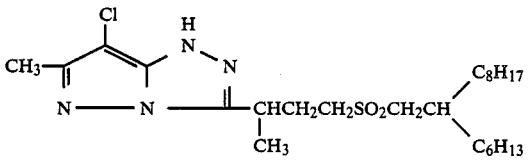

-continued
M-11
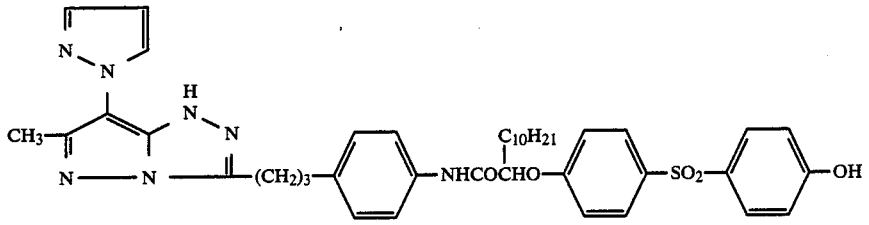
M-12
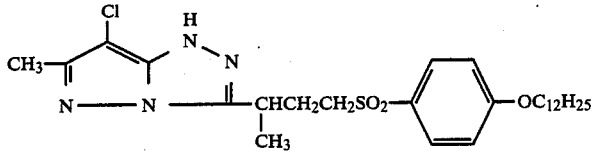
M-13
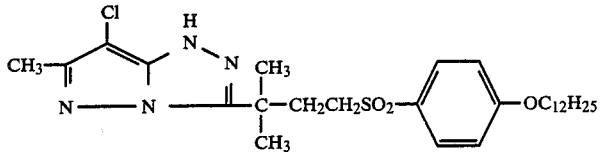
M-14
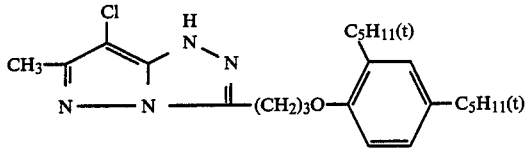
M-15
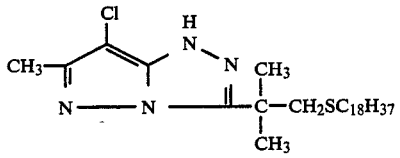
M-16
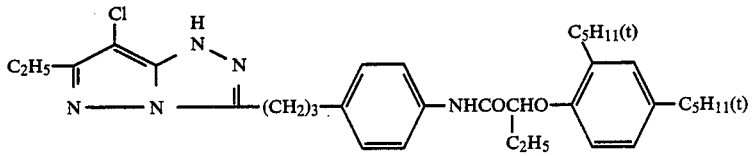
M-17
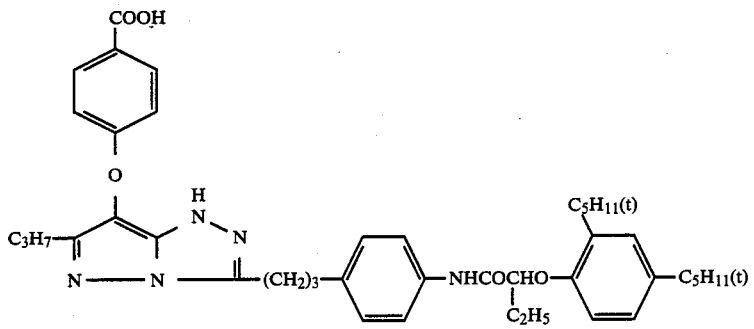
M-18
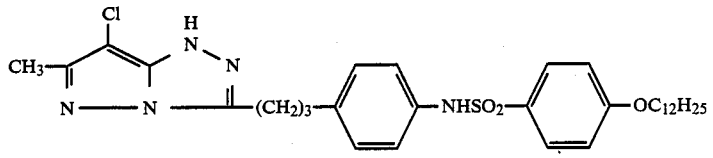

-continued
M-19
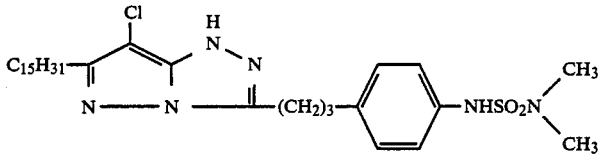
M-20
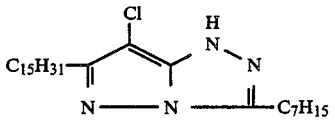
M-21
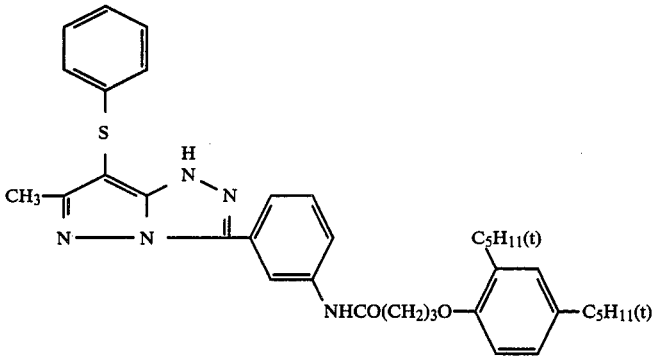
M-22
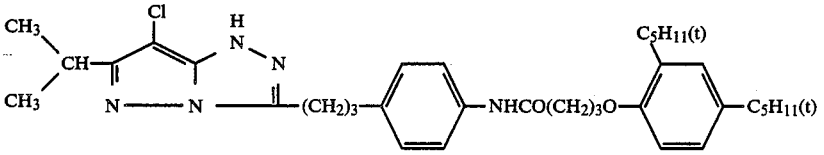
M-23
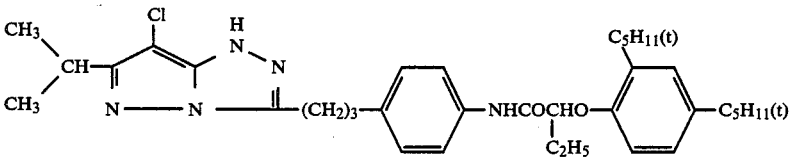
M-24
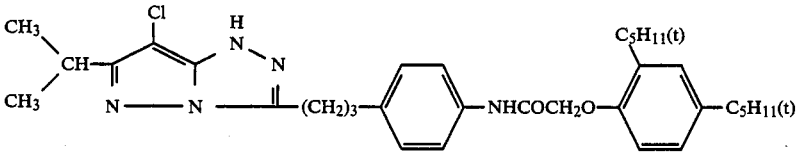
M-25
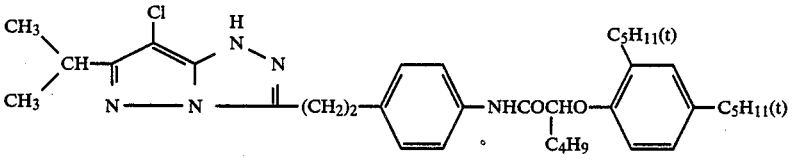
M-26
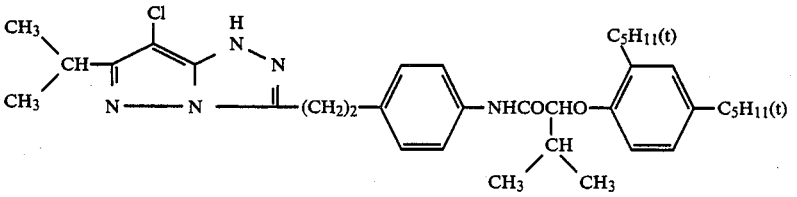

-continued
M-27
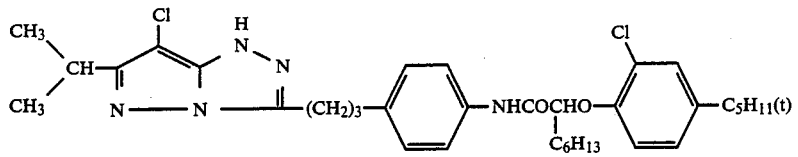
M-28
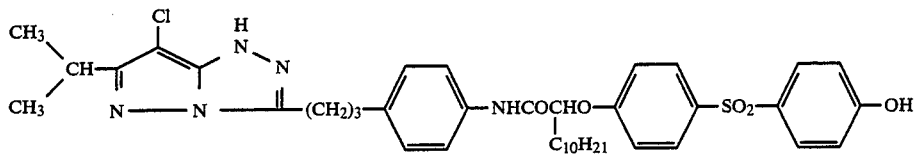
M-29
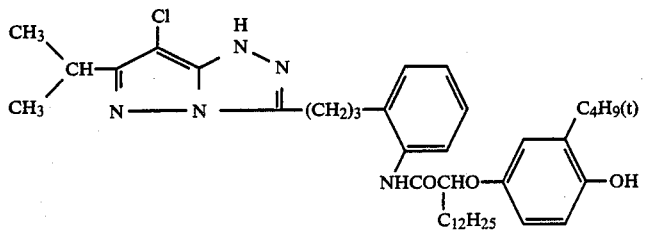
M-30
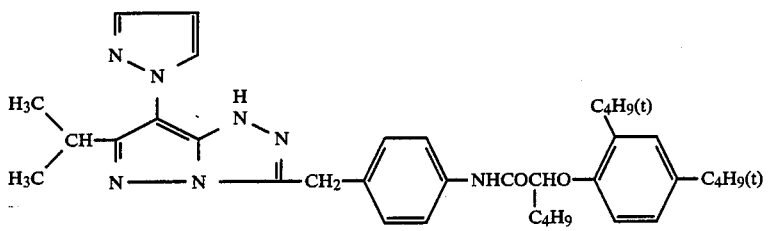
M-31
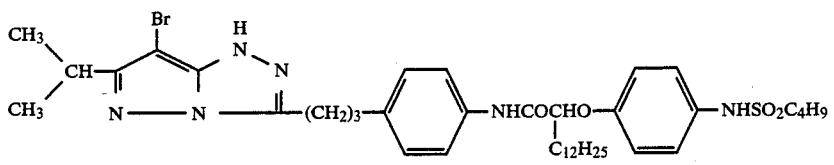
M-32
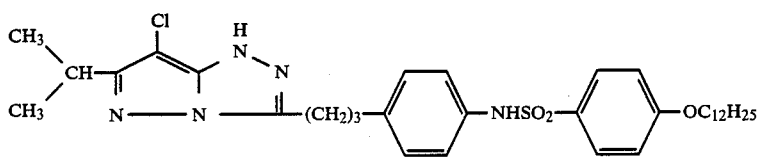
M-33
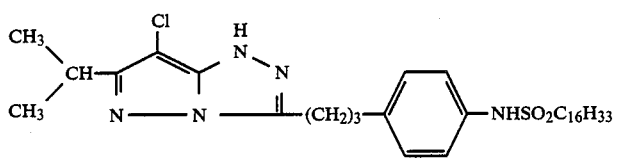
M-34
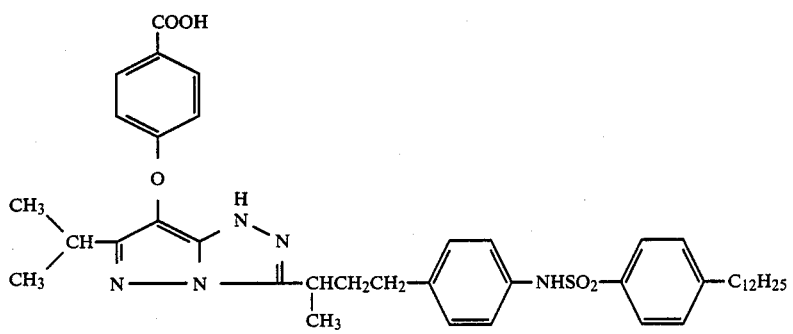

-continued
M-35
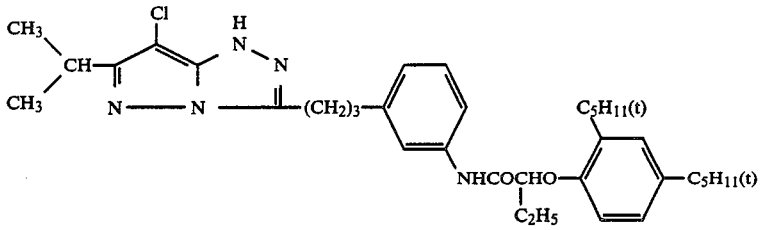
M-36
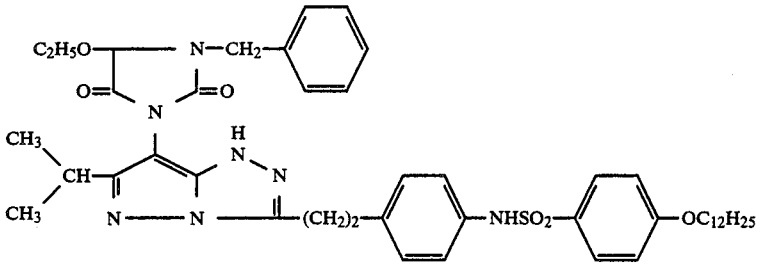
M-37
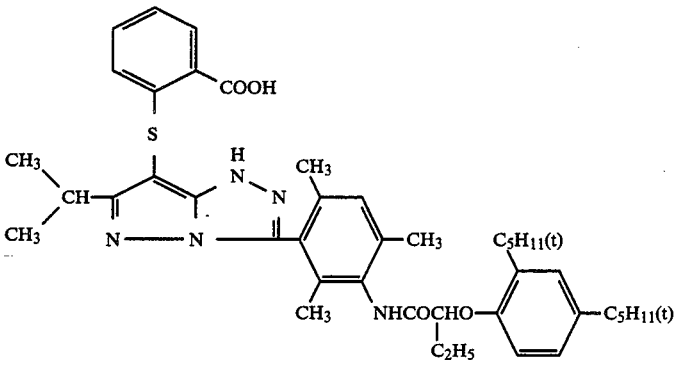
M-38
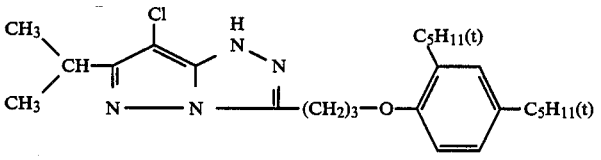
M-39
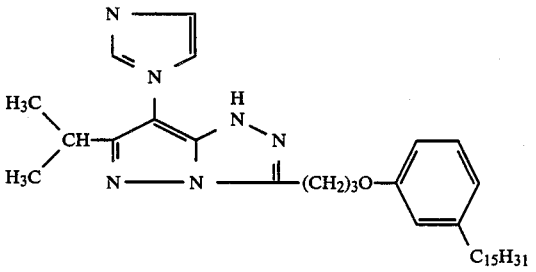
M-40
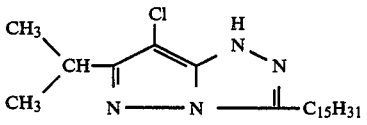
M-41
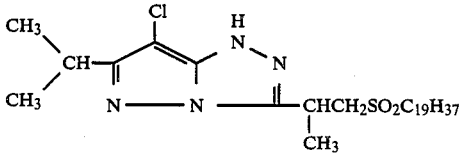

-continued
M-42
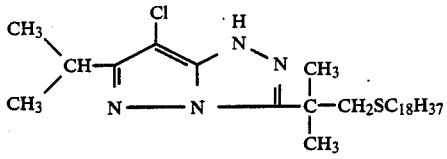
M-43
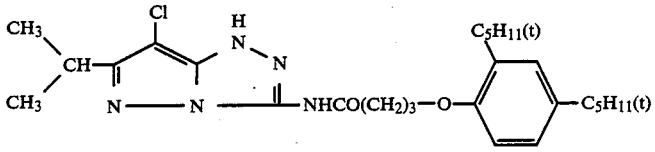
M-44
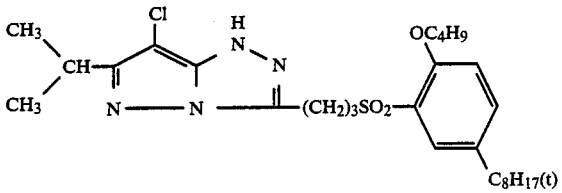
M-45
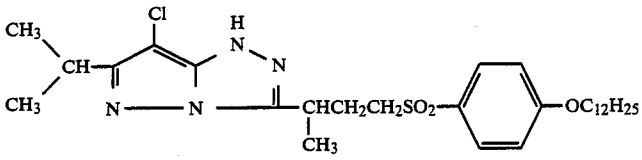
M-46
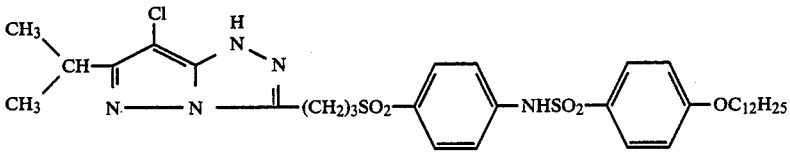
M-47
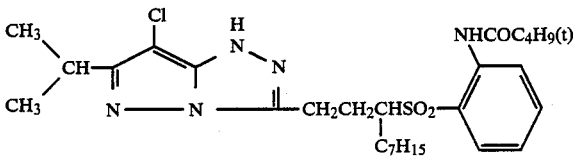
M-48
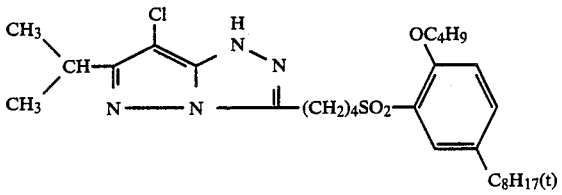
M-49
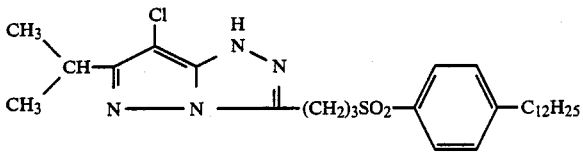
M-50
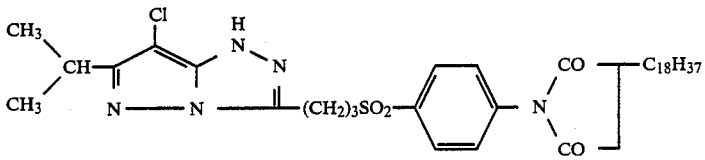

-continued
M-51
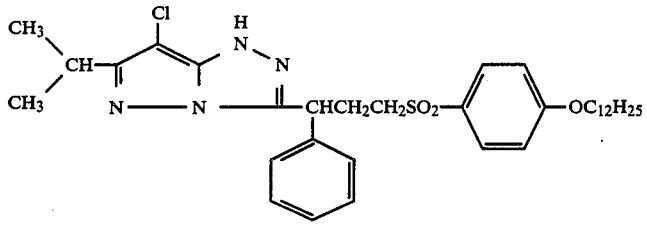
M-52
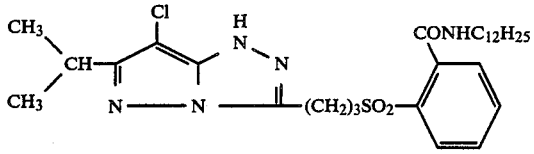
M-53
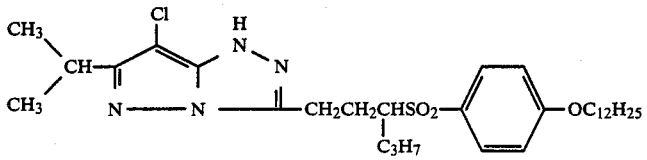
M-54
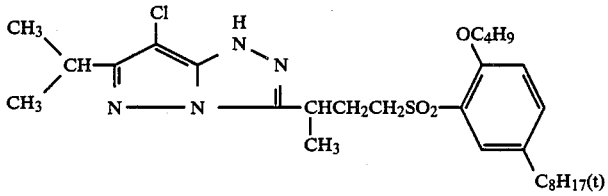
M-55
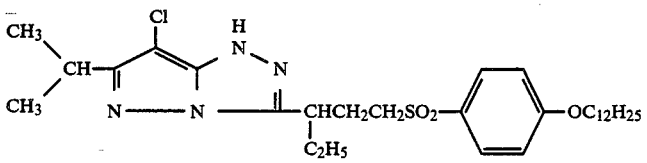
M-56
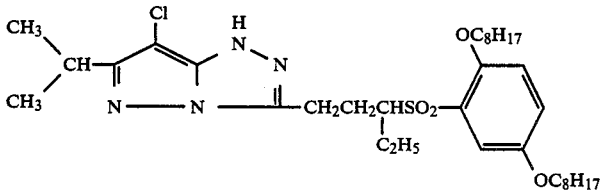
M-57
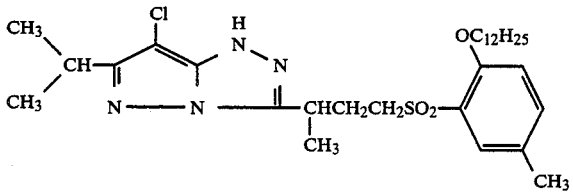
M-58
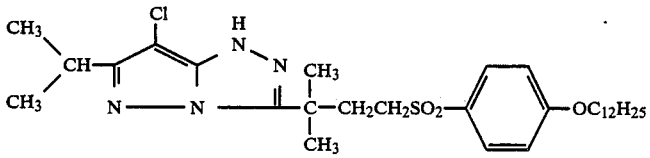
M-59
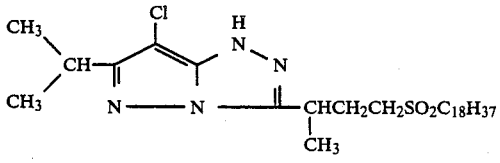

-continued
M-60
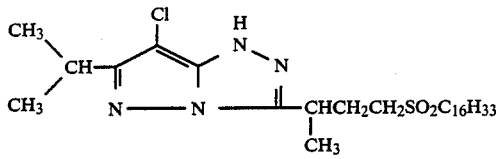
M-61
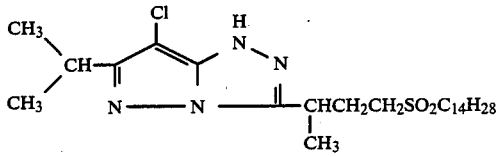
M-62
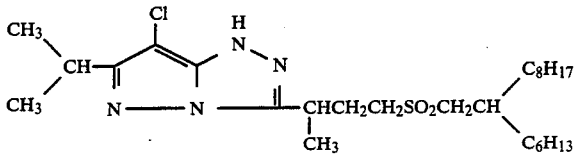
M-63
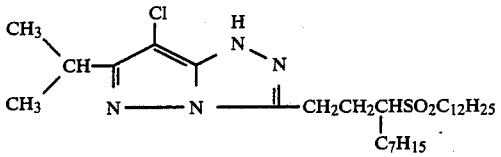
M-64
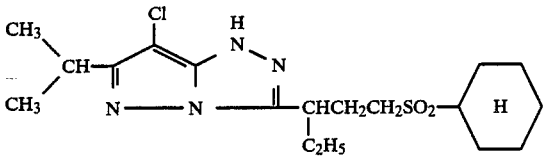
M-65
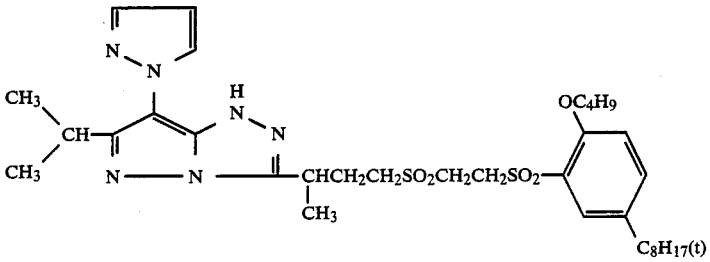
M-66
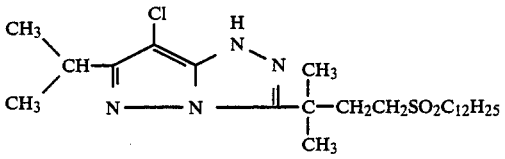
M-67
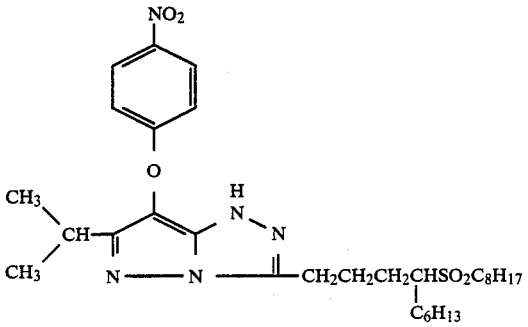

-continued
M-68
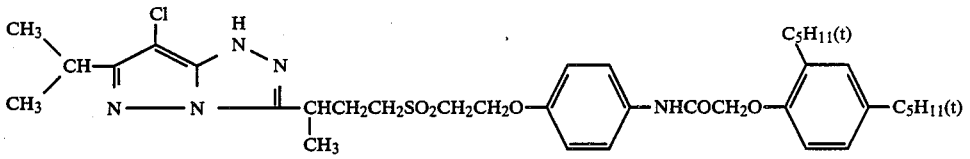
M-69
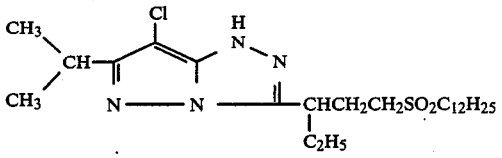
M-70
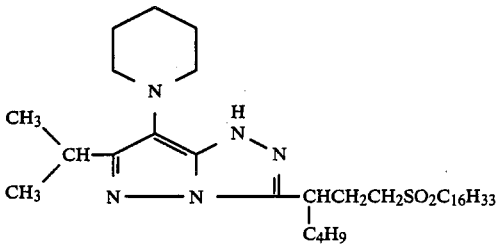
M-71
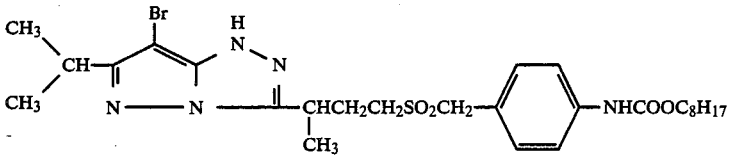
M-72
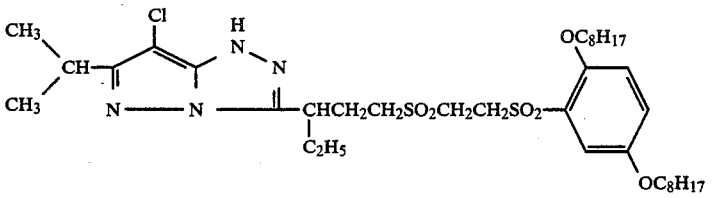
M-73
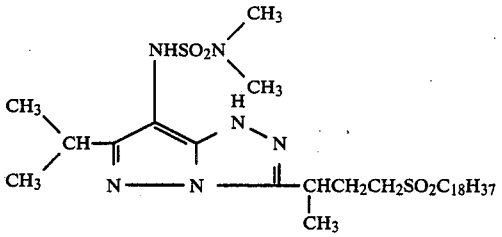
M-74
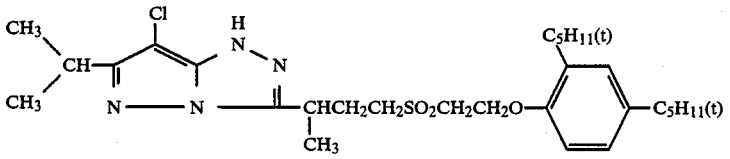
M-75
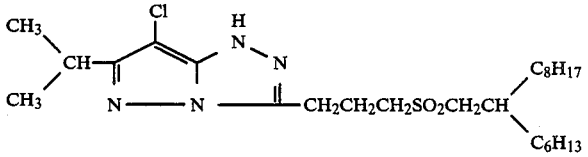

-continued
M-76
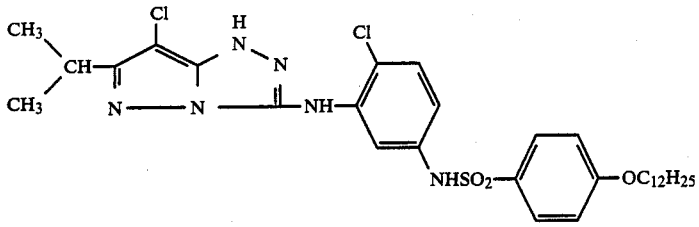
M-77
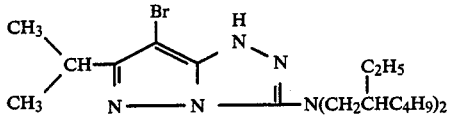
M-78
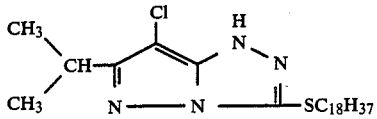
M-79
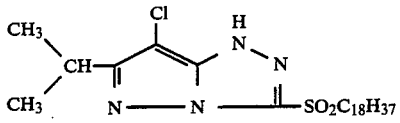
M-80
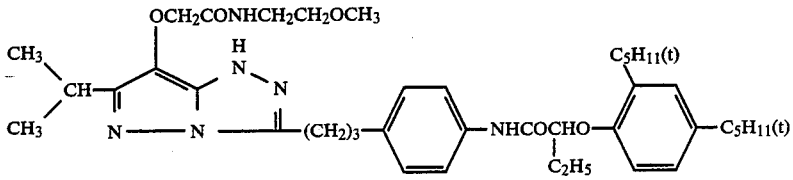
M-81
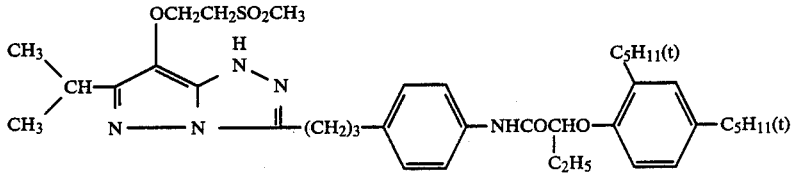
M-82
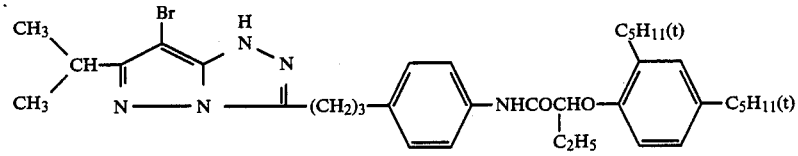
M-83
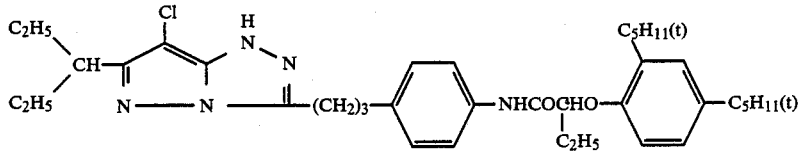
M-84
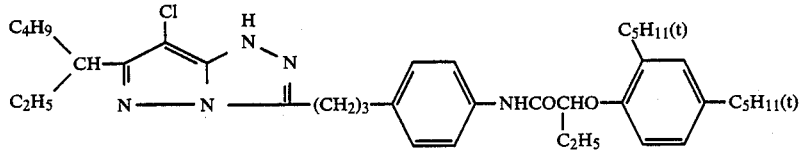

-continued
M-85
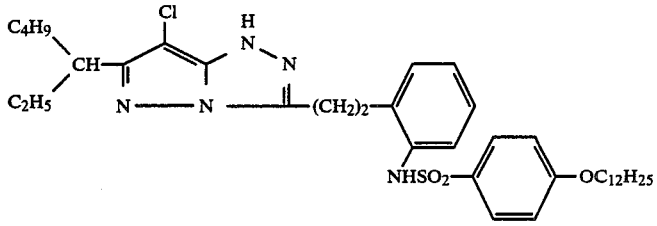
M-86
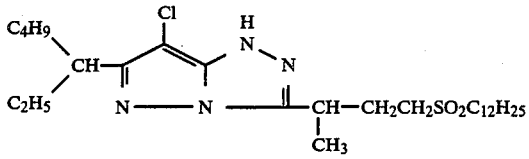
M-87
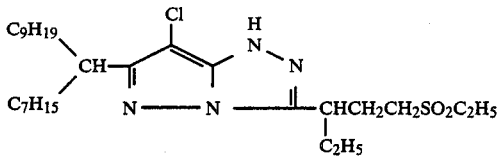
M-88
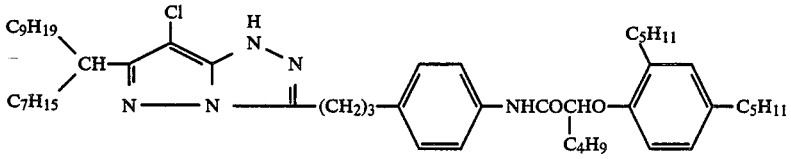
M-89
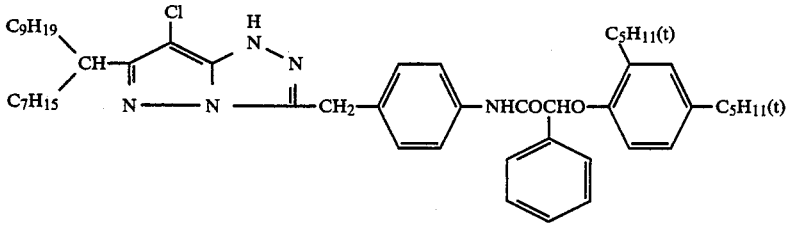
M-90
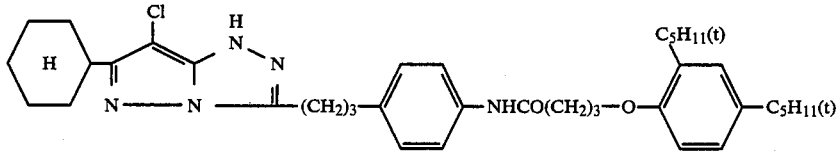
M-91
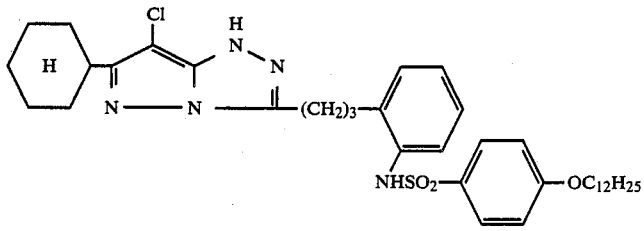

-continued
M-92
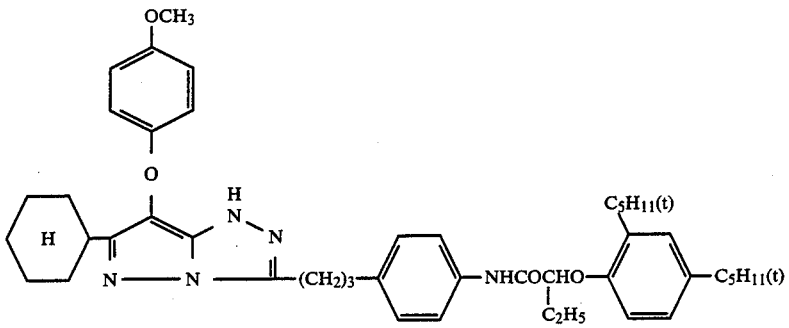
M-93
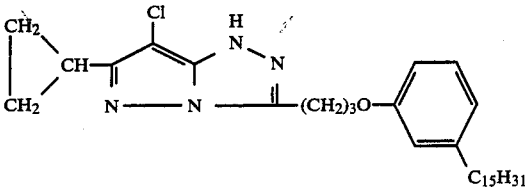
M-94
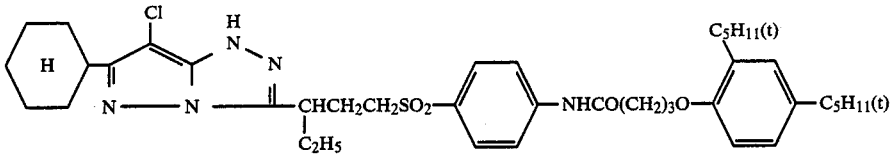
M-95
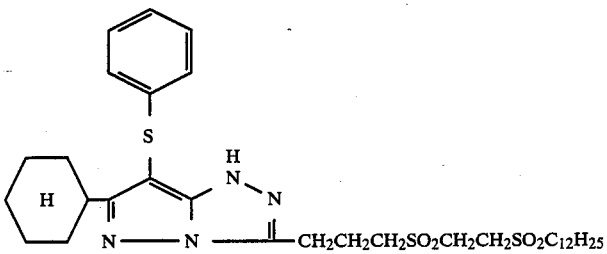
M-96
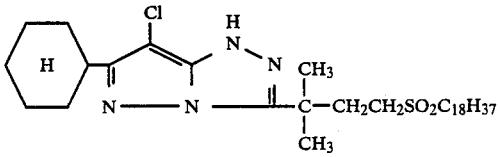
M-97
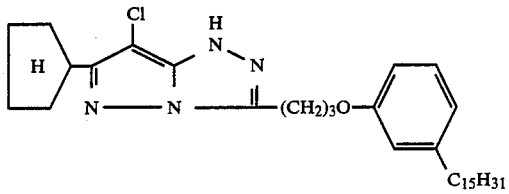
M-98
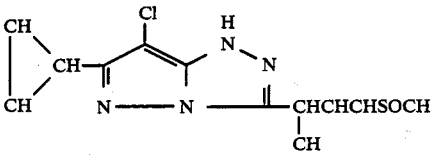
M-99
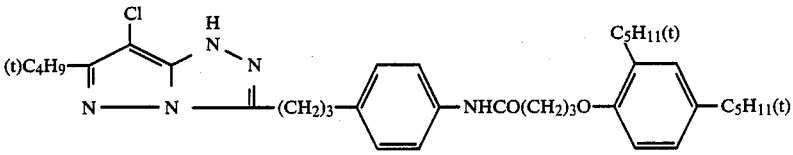

-continued
M-100
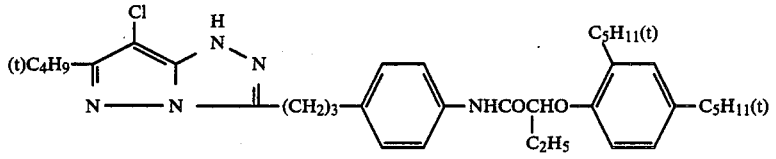
M-101
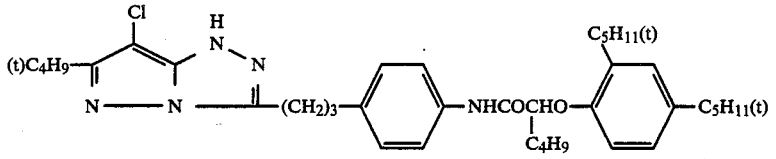
M-102
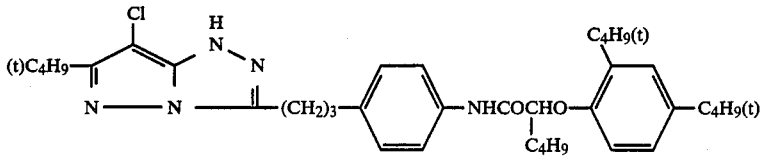
M-103
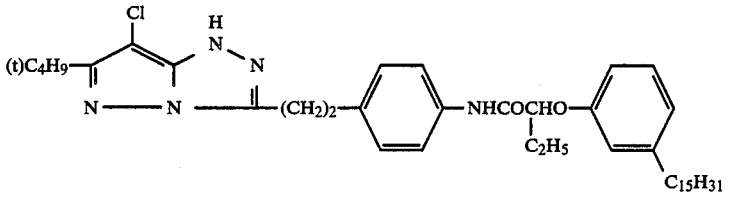
M-104
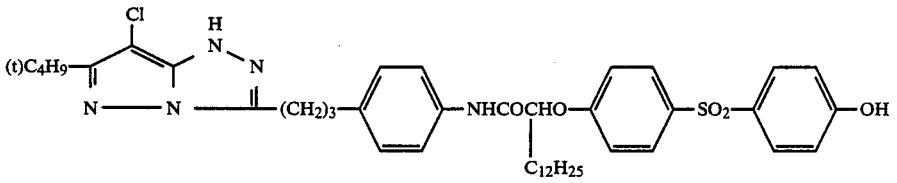
M-105
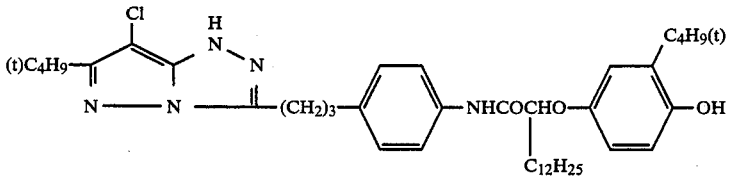
M-106
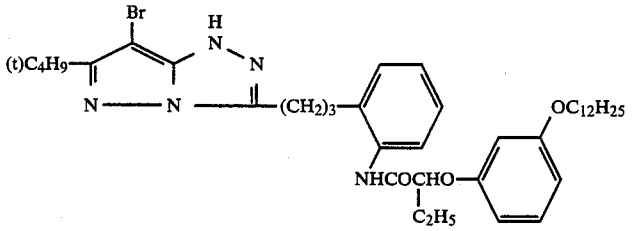
M-107
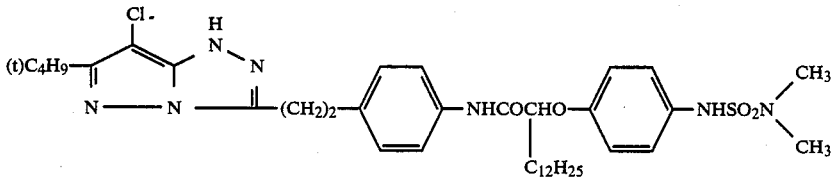

-continued
M-108
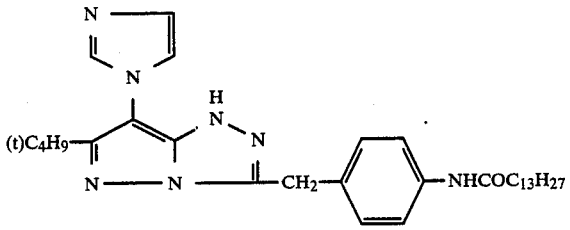
M-109
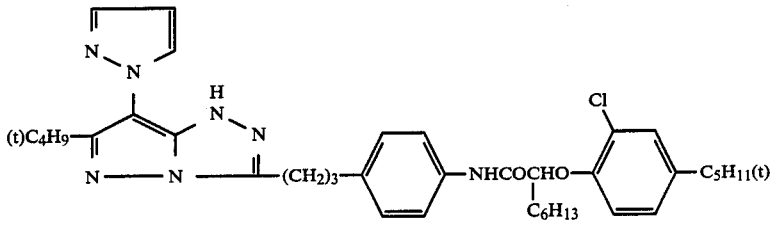
M-110
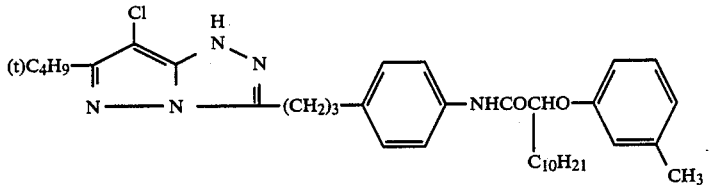
M-111
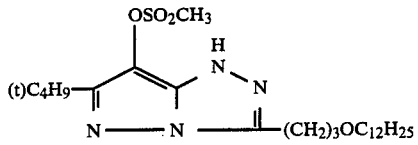
M-112
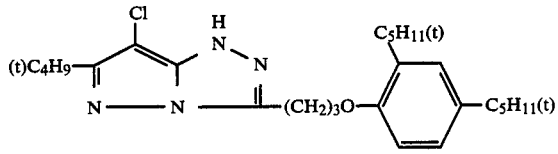
M-113
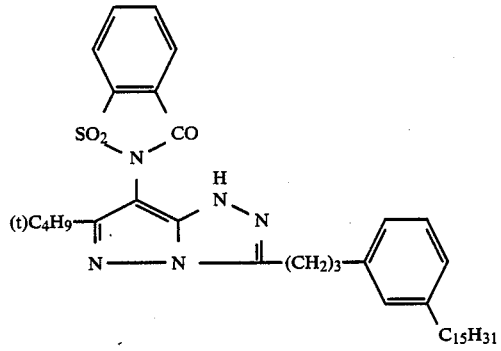
M-114
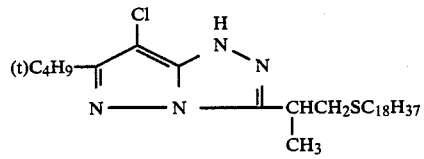

-continued
M-115
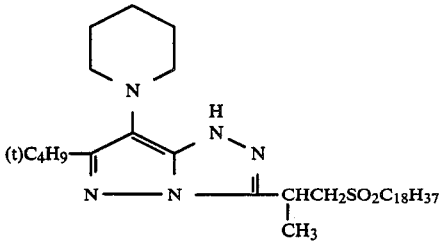
M-116
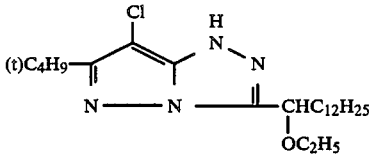
M-117
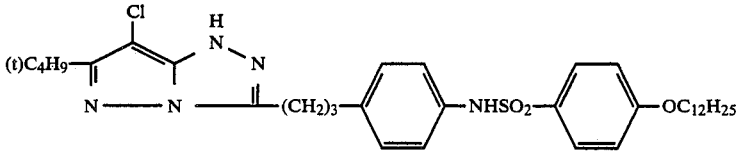
M-118
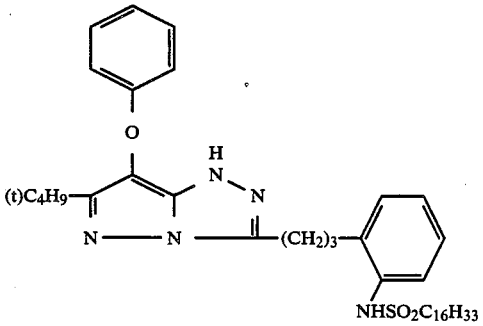
M-119
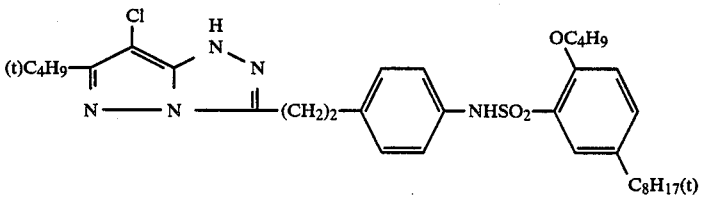
M-120
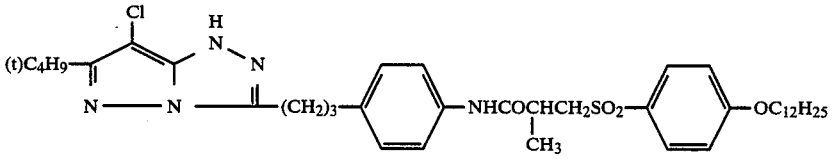
M-121
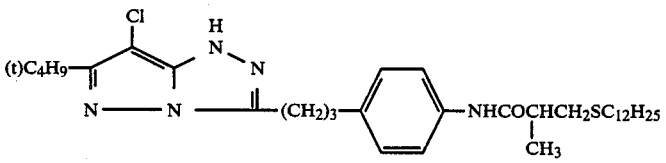
M-122
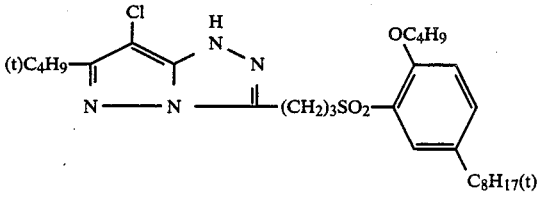

-continued
M-123
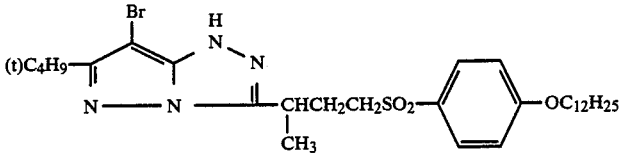
M-124
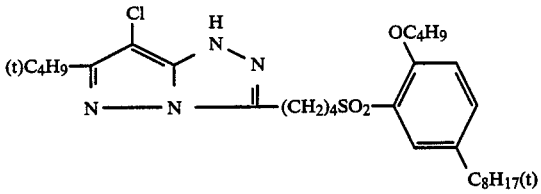
M-125
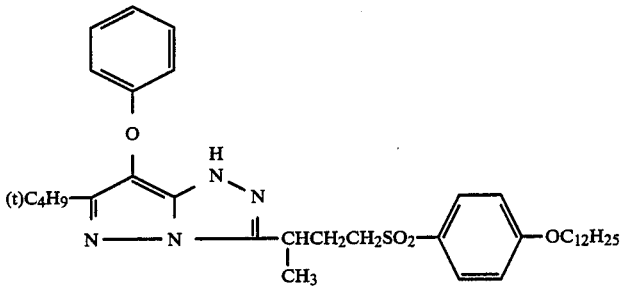
M-126
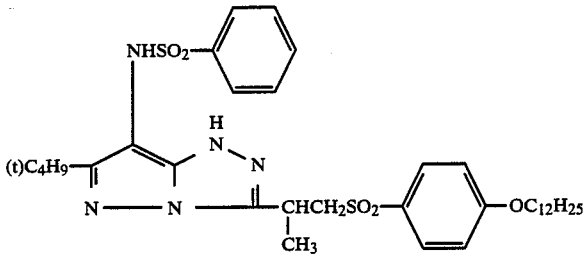
M-127
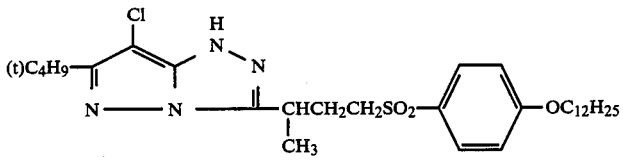
M-128
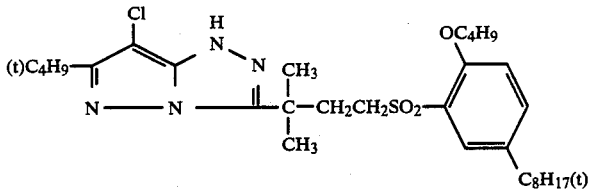
M-129
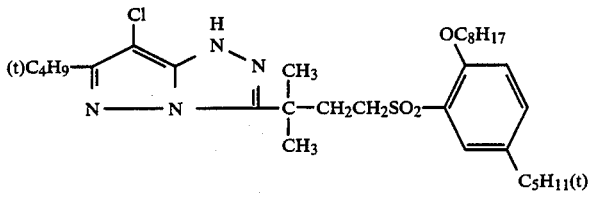

-continued
M-130
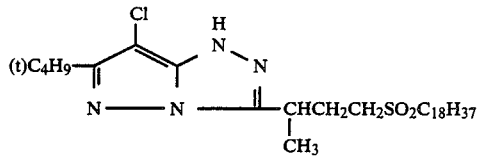
M-131
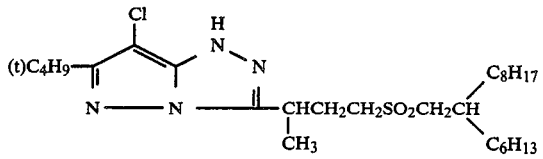
M-132
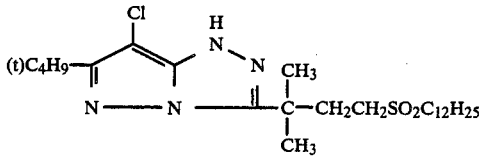
M-133
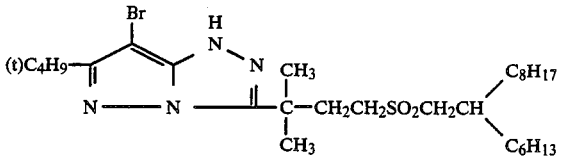
M-134
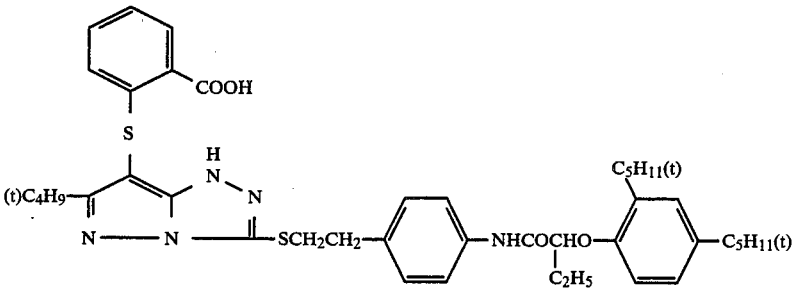
M-135
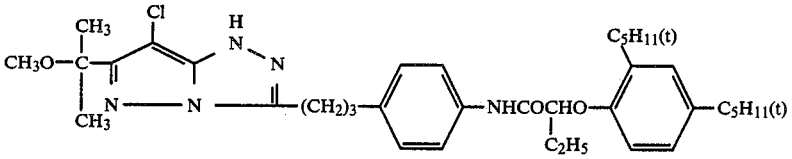
M-136
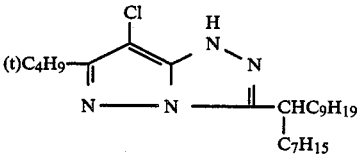
M-137
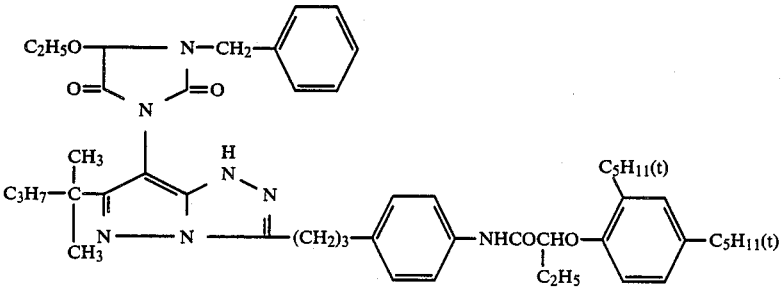

-continued
M-138
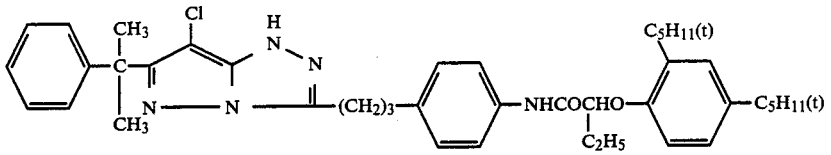
M-139
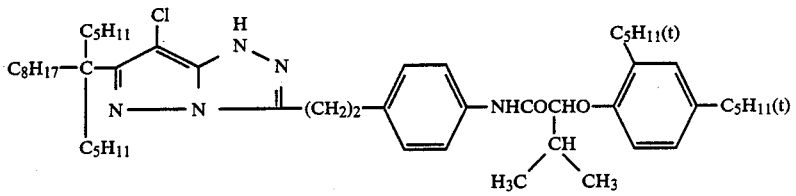
M-140
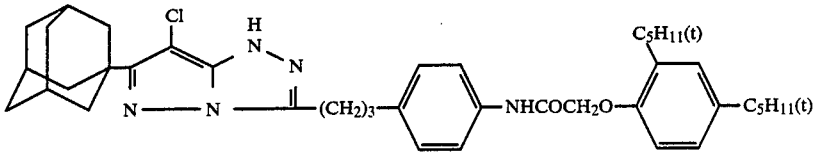
M-141
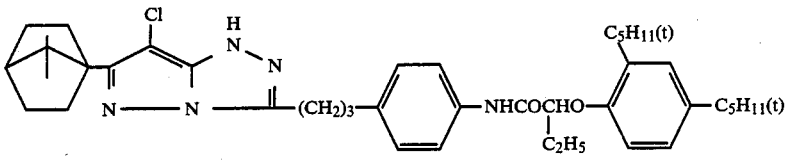
M-142
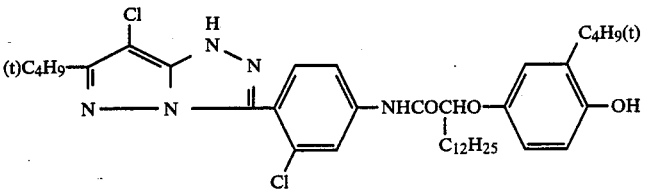
M-143
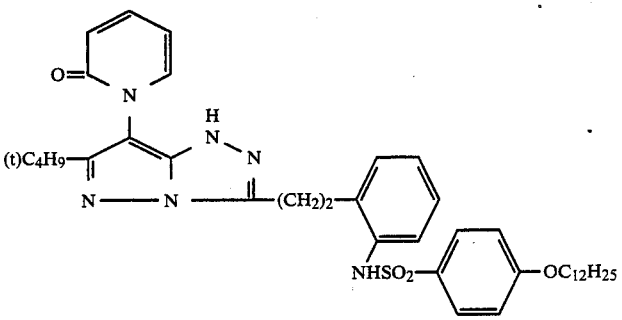
M-144
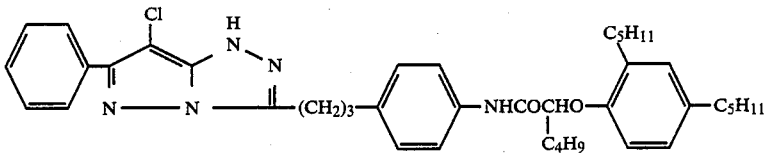
M-145
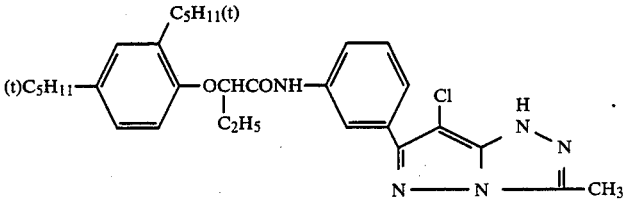

-continued
M-146
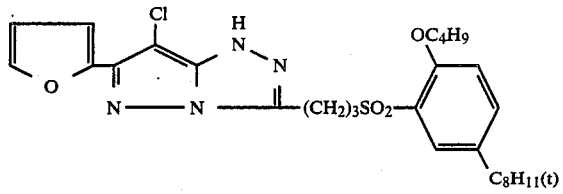
M-147
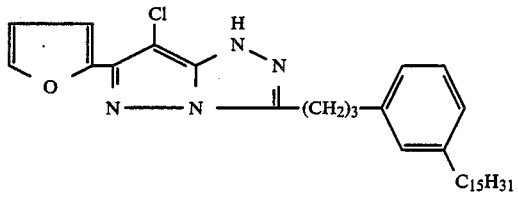
M-148
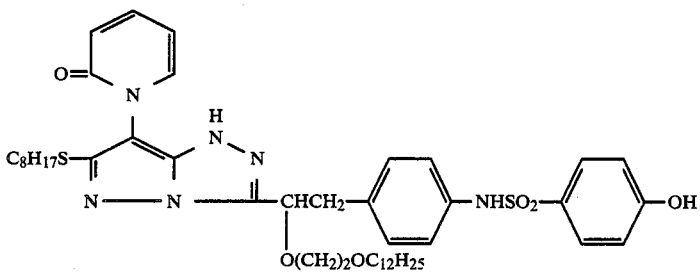
M-149
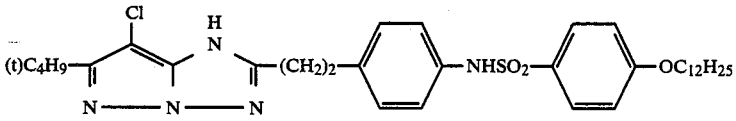
M-150
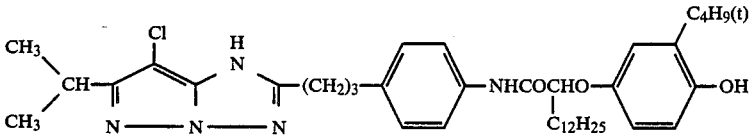
M-151
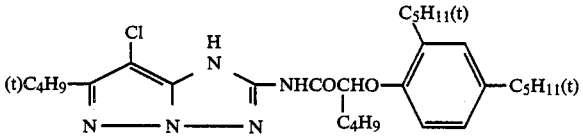
M-152
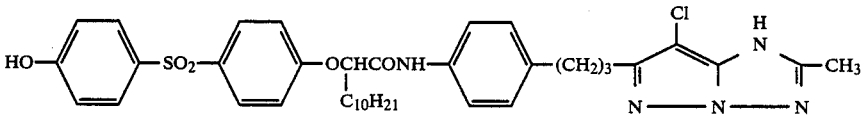
M-153
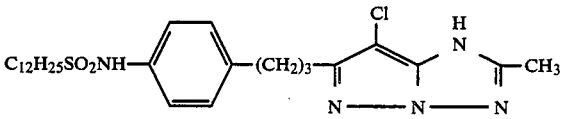
M-154
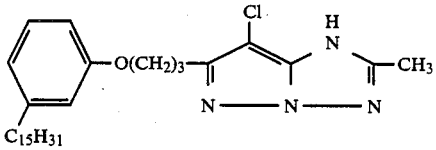

-continued
M-155
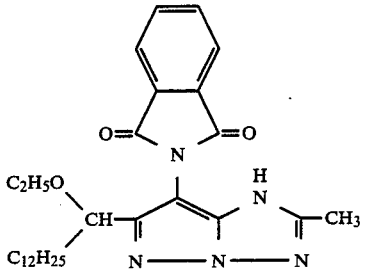
M-156
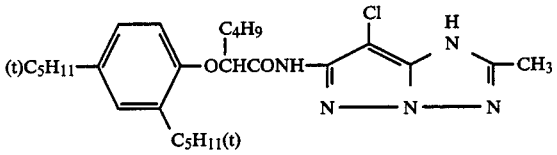
M-157
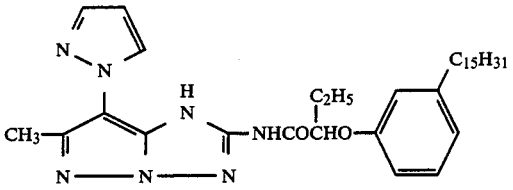
M-158
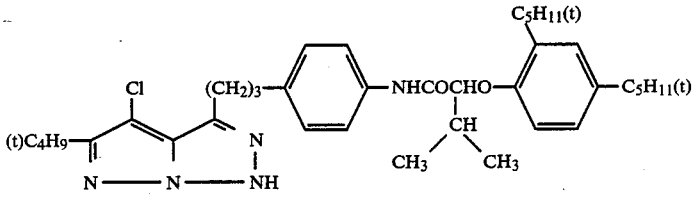
M-159
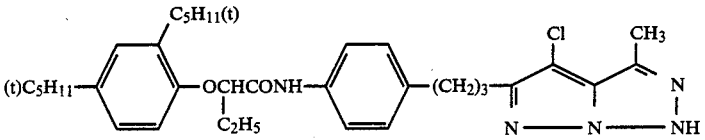
M-160
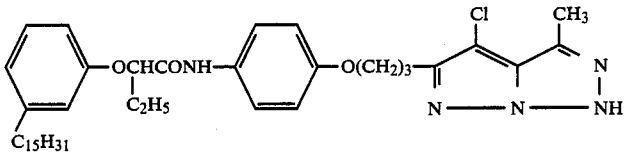
M-161
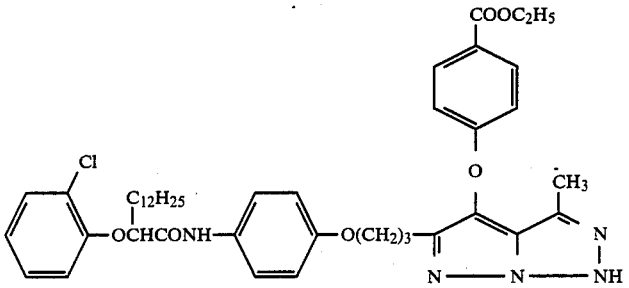

-continued
M-162
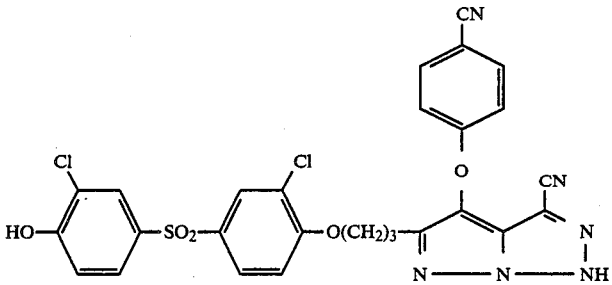
M-163
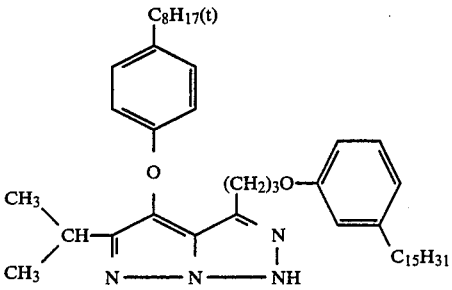
M-164
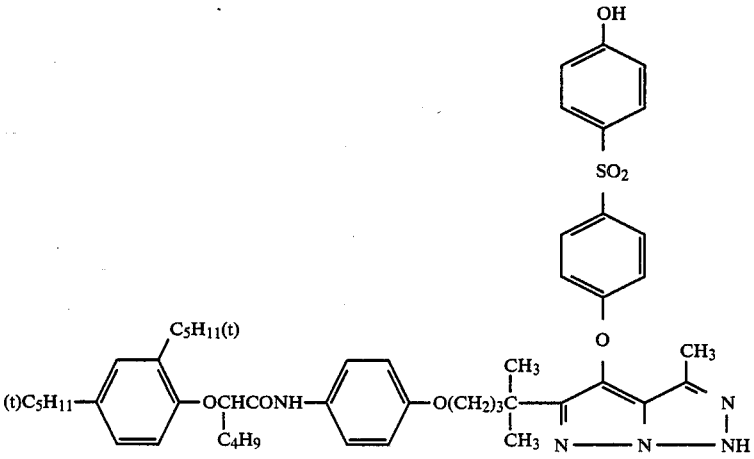
M-165
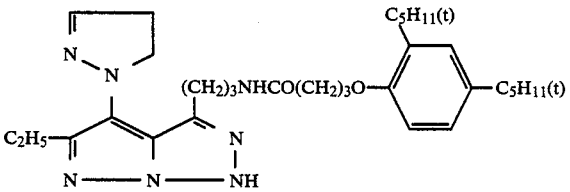
M-166
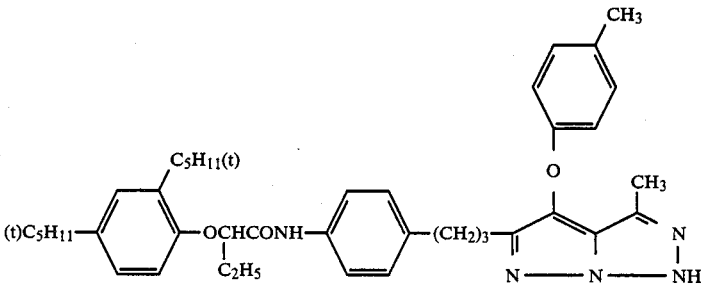

-continued
M-167
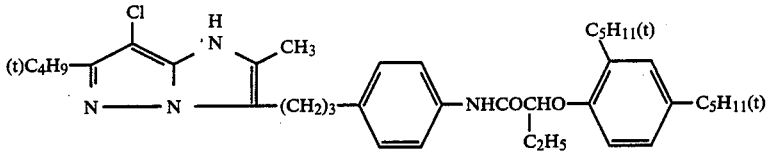
M-168
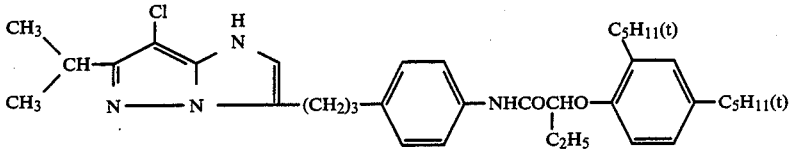
M-169
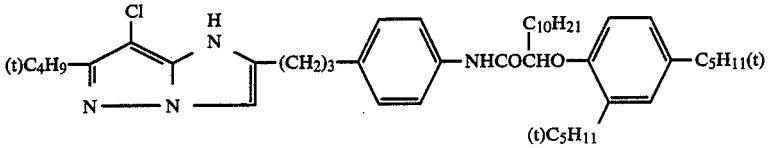
M-170
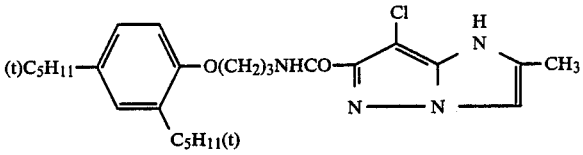
M-171
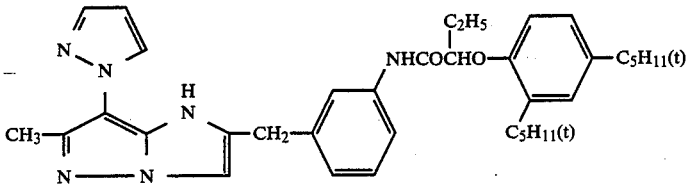
M-172
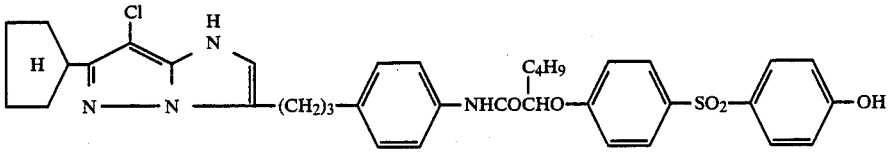
M-173
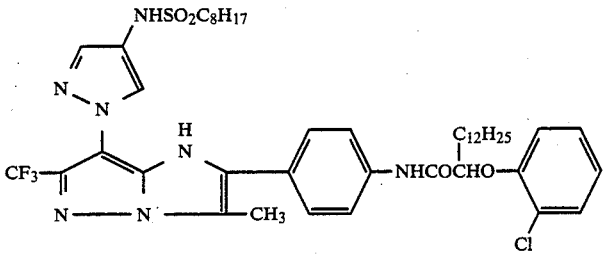
M-174
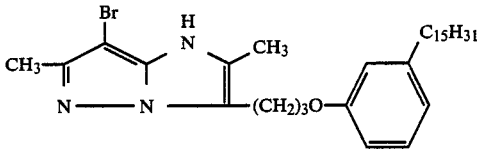
M-175
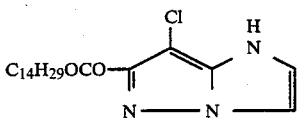

-continued
M-176
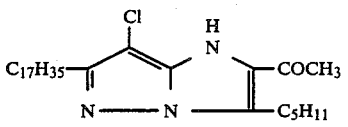
M-177
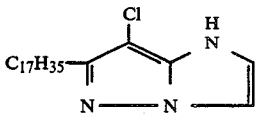
M-178
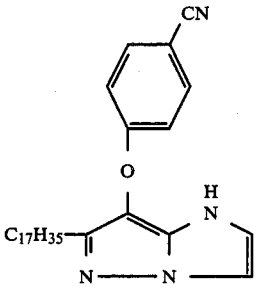
M-179
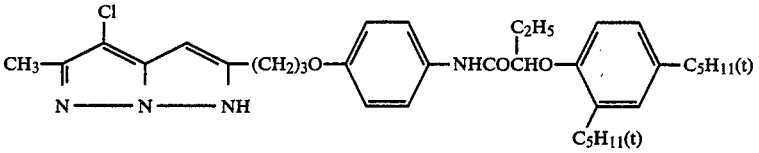
M-180
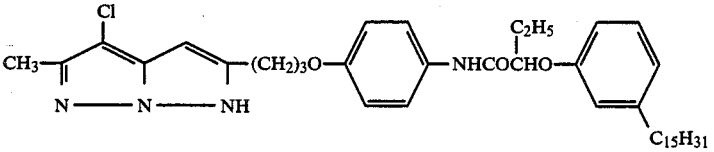
M-181
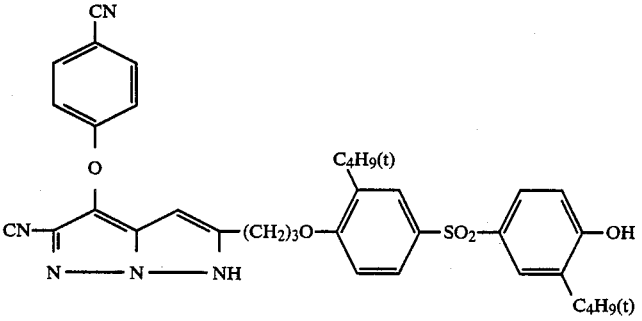
M-182
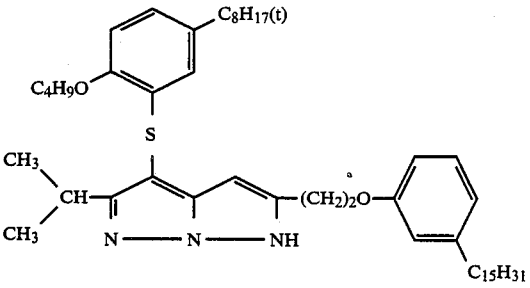
M-183
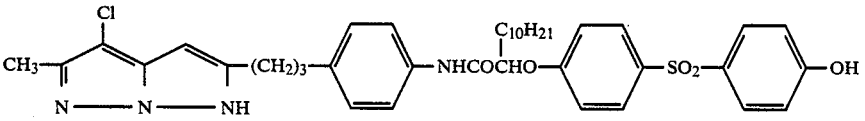

-continued
M-184
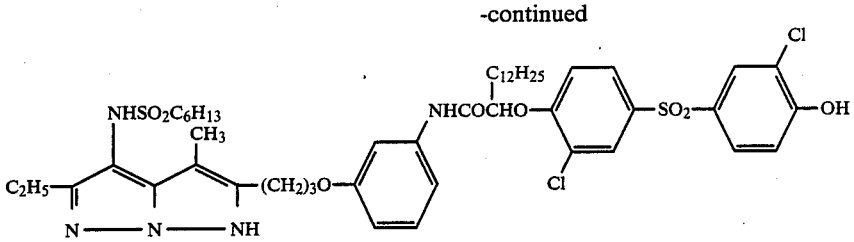
M-185
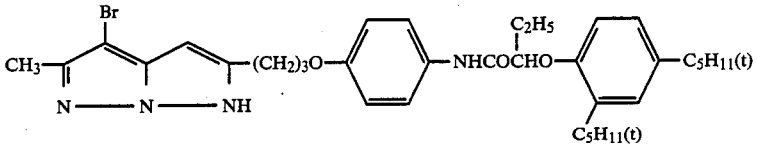
M-186
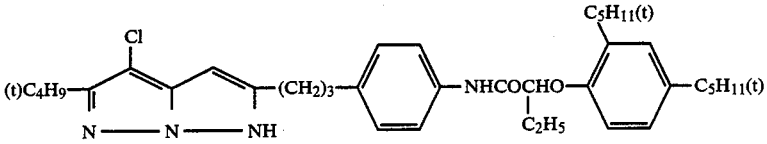
M-187
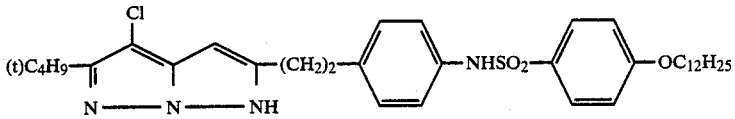
M-188
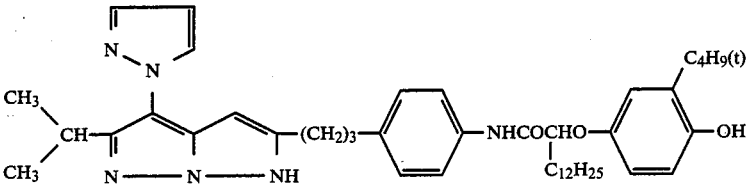
M-189
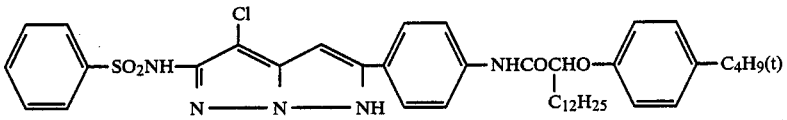
M-190
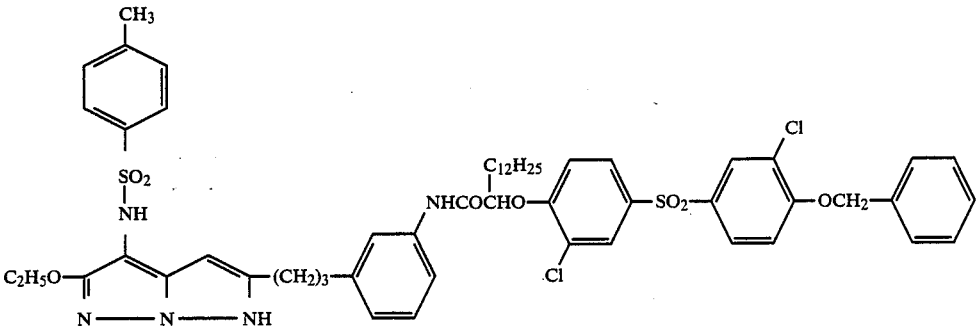
M-191
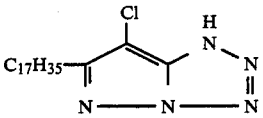
M-192
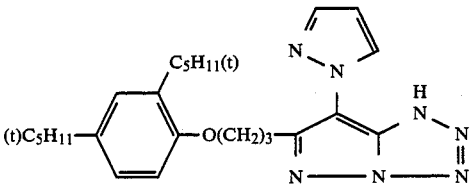

-continued

M-193

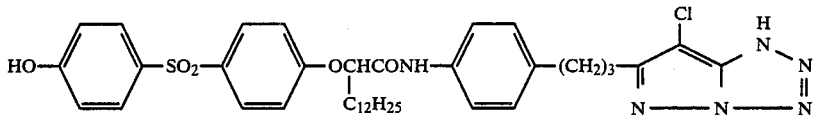

M-194

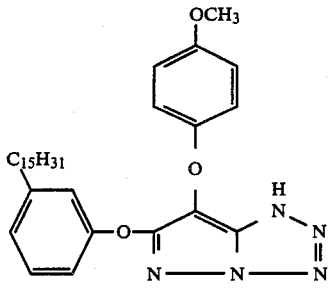

M-195

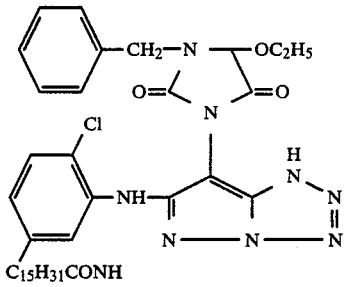

M-196

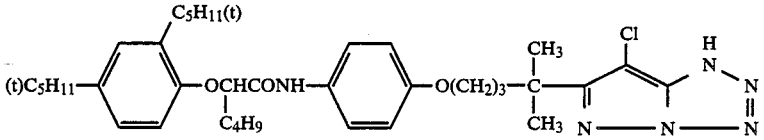

M-197

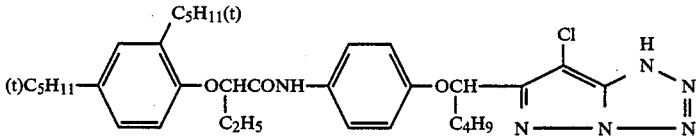

M-198

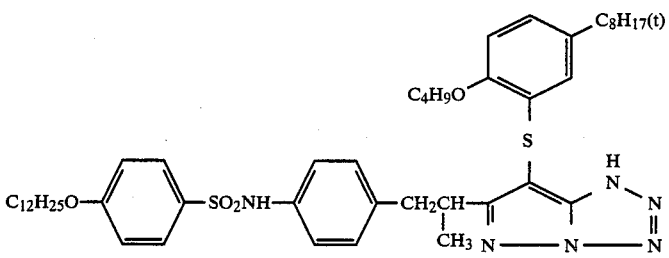

M-199

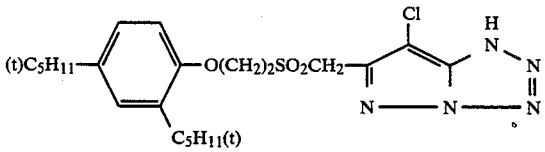

The above couplers were synthesized making reference to the Journal of the Chemical Society, Perkin I (1977), 2047–2052, U.S. Pat. No. 3,725,067, Japanese Patent O.P.I. Publication Nos. 42045/1983, 162548/1984, 171956/1984, 33552/1985 and 43659/1985, and the like.

Any of these couplers of the present invention may be usually used in the quantity range of from $1\times10^{-3}$ mole to 1 mole per mole of silver halide, preferably from $1\times10^{-2}$ to $8\times10^{-1}$.

These couplers of this invention may also be used along different other magenta couplers.

The yellow couplers which may be used in the blue-sensitive layers of the color photographic light-sensitive materials relating to the invention, include, preferably, a yellow coupler having a relative coupling reaction rate of not less than 0.3 and, more preferably, a high-speed reaction type yellow coupler having a relative coupling reaction rate of not less than 0.5. When using such high-speed reaction type yellow couplers, an image having substantially less color turbidity may be obtained.

The above-mentioned relative coupling reaction rate thereof is determined in terms of a relative value in such a manner that two kinds of couplers M and N respectively giving the different dyes each capable of separating from each other are mixed together and added to a silver halide emulsion so as to be color developed, and thereby each of the amounts of dyes in the resulted color image is measured.

If, in the coupler M, the maximum color density is represented by (DM)max and the color density in an intermediate stage is represented by DM and, in the coupler N, those corresponding color density are represented by (DN)max and DN, respectively, the reaction activity ratio, RM/RN, of these two couplers may be represented by the following formula:

$$\frac{RM}{RN} = \frac{\log\left(1 - \frac{DM}{(DM)\ \text{max.}}\right)}{\log\left(1 - \frac{DN}{(DN)\ \text{max.}}\right)}$$

In other words, the silver halide emulsions containing a mixture of the above-mentioned couplers M and N are exposed with various steps respectively and developed. The resulted some combinations of DMs and DNs obtained by the developments are plotted on a rectangular-coordinate graph, in terms of;

$$\log\left(1 - \frac{DM}{DM\text{max}}\right), \log\left(1 - \frac{DN}{DN\text{max}}\right)$$

From the inclined straight line plotted, a value of coupling activity ratio, RM/RN, may be obtained.

The respective values of the relative coupling reaction rates with respect to various couplers may be obtained in the manner that each RM/RN value of the couplers is obtained by making use of a prescribed coupler N, as mentioned above.

In the invention, an RM/RN value is specified by making use of the following coupler to serve as the above-mentioned coupler N:

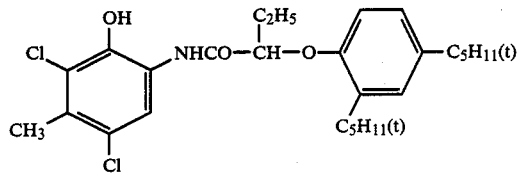

An adding amount of the high-speed reaction type yellow couplers of the invention shall not be limitative but is preferably from $2\times10^{-3}$ to $5\times10^{-1}$ mol per mol of silver used in the aforementioned blue-sensitive silver halide emulsion layer and, more preferably, from $1\times10^{-2}$ to $5\times10^{-1}$ mol.

Now, the typical examples of the high-speed reaction type yellow couplers of the invention will be given below. It is, however, to be understood that the invention shall not be limited thereto.

[Exemplified compound]

(Y-1)

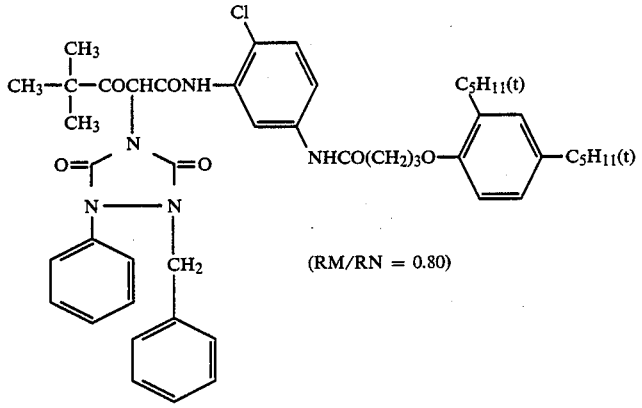

(RM/RN = 0.80)

-continued
(Y-2)
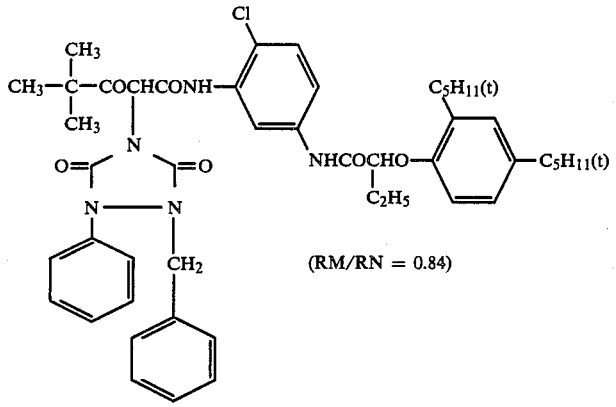
(RM/RN = 0.84)
(Y-3)
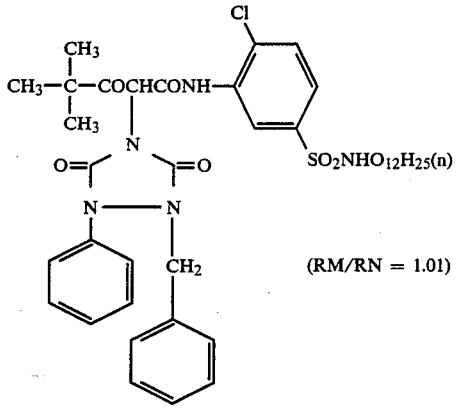
(RM/RN = 1.01)
(Y-4)
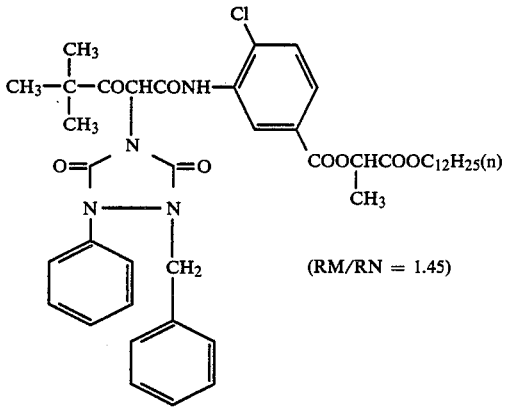
(RM/RN = 1.45)
(Y-5)
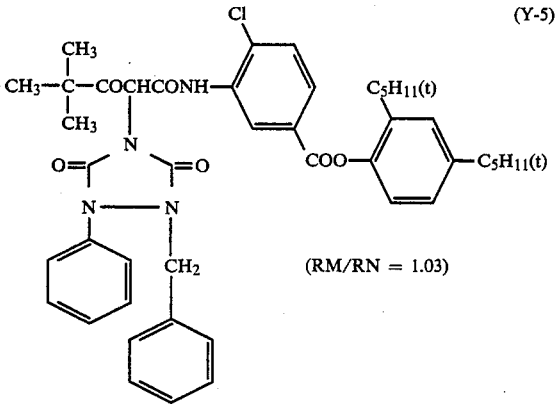
(RM/RN = 1.03)
(Y-6)
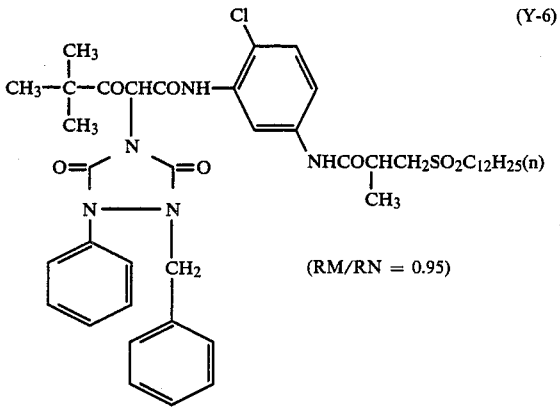
(RM/RN = 0.95)
(Y-7)
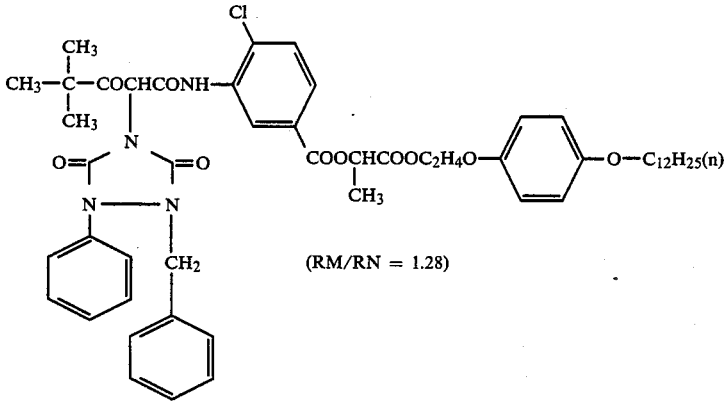
(RM/RN = 1.28)

-continued
(Y-8)
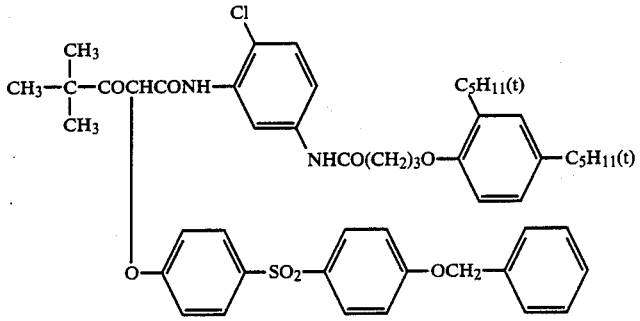
(RM/RN = 0.65)
(Y-9)
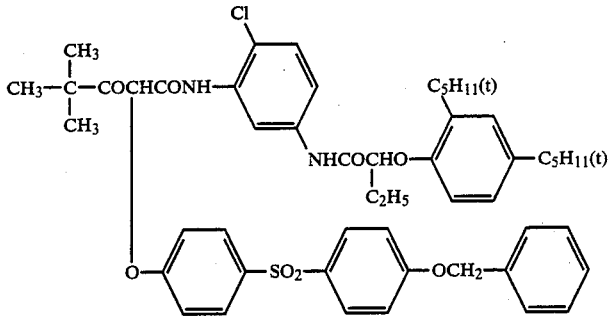
(RM/RN = 0.92)
(Y-10)
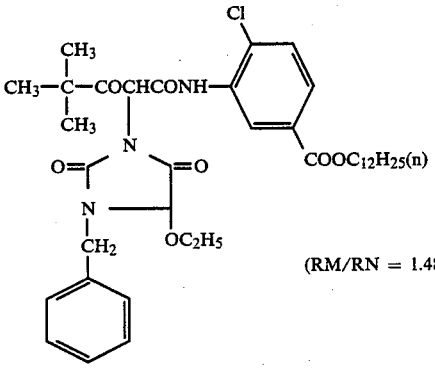
(RM/RN = 1.48)
(Y-11)
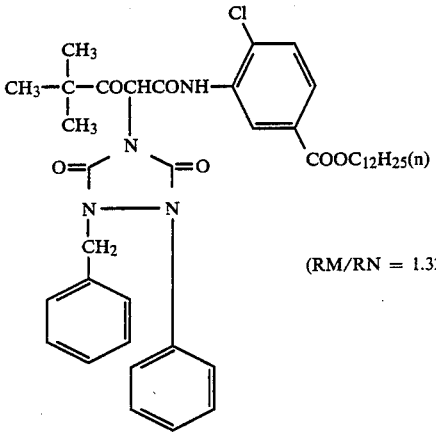
(RM/RN = 1.32)
(Y-12)
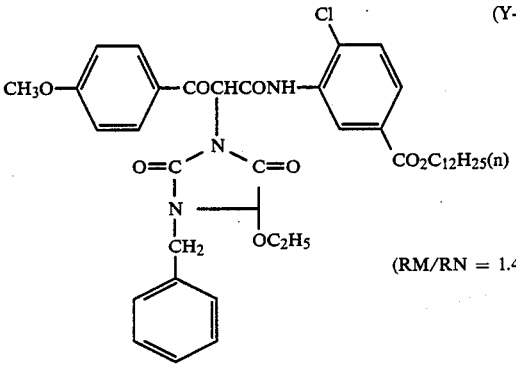
(RM/RN = 1.46)
(Y-13)
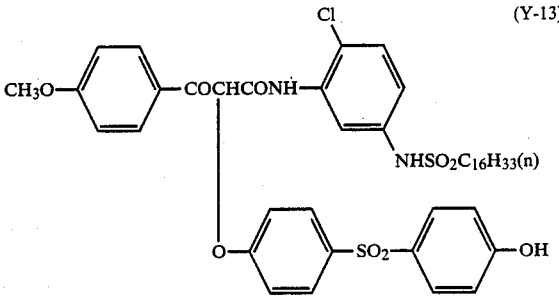
(RM/RN = 1.27)

-continued
(Y-14)
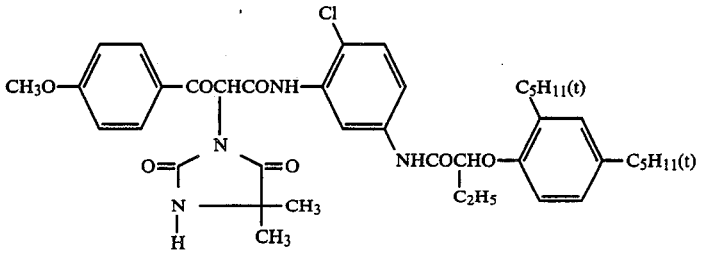
(RM/RN = 0.96)
(Y-15)
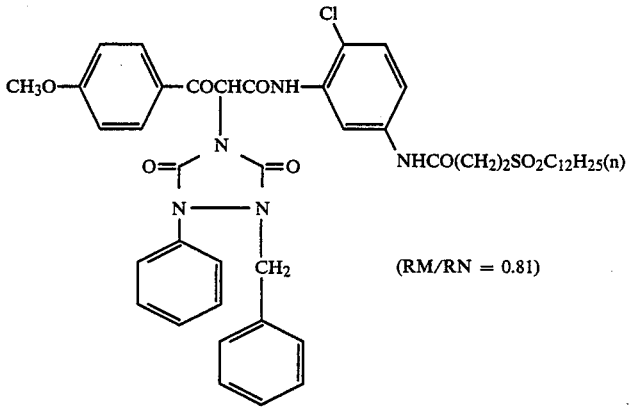
(RM/RN = 0.81)
(Y-16)
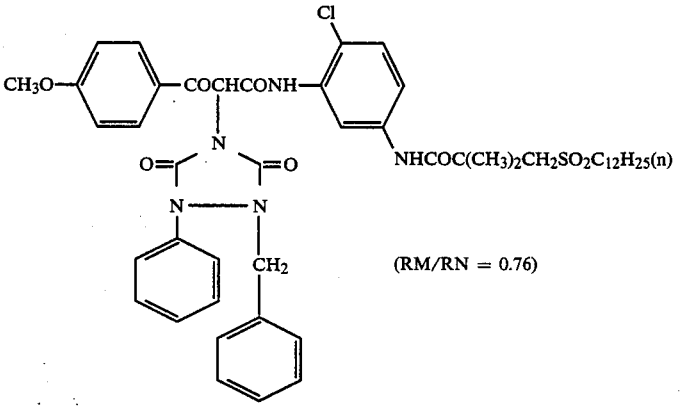
(RM/RN = 0.76)
(Y-17)
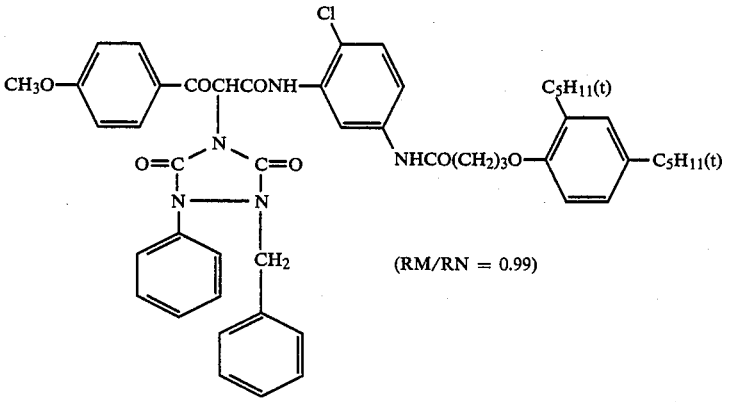
(RM/RN = 0.99)

-continued
(Y-18)
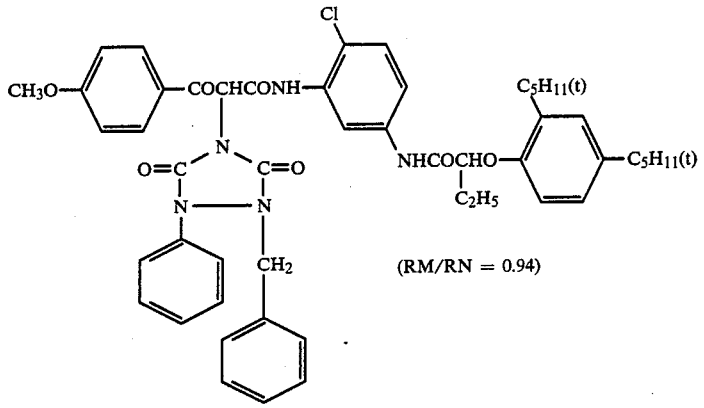
(RM/RN = 0.94)
(Y-19)
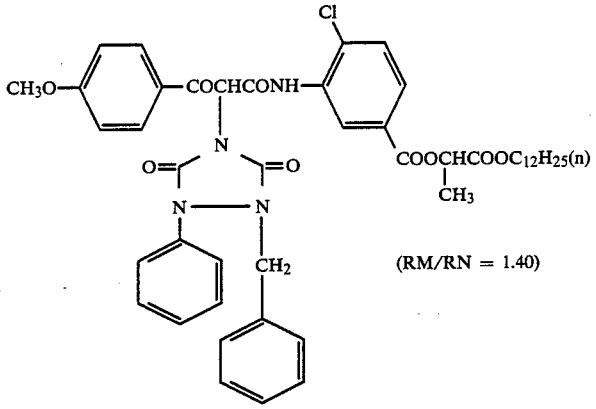
(RM/RN = 1.40)
(Y-20)
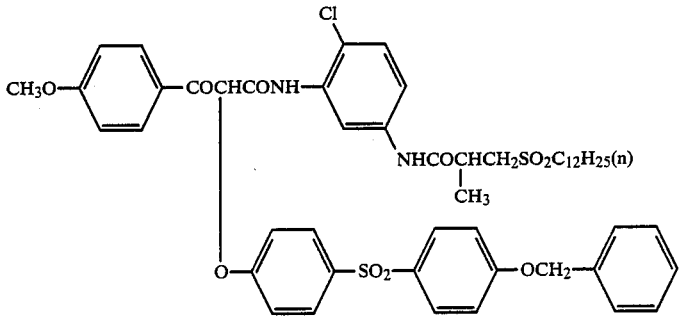
(RM/RN = 0.88)
(Y-21)
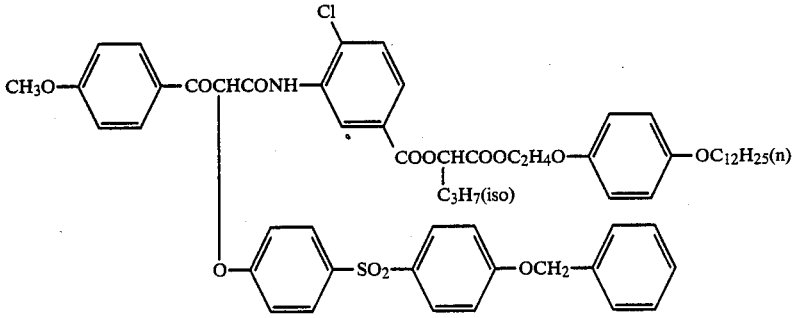
(RM/RN = 1.19)

-continued
(Y-22)
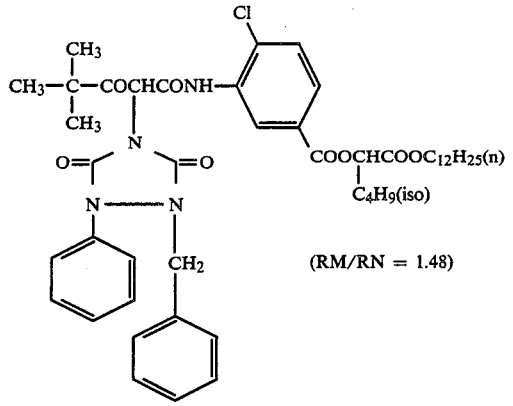
(RM/RN = 1.48)
(Y-23)
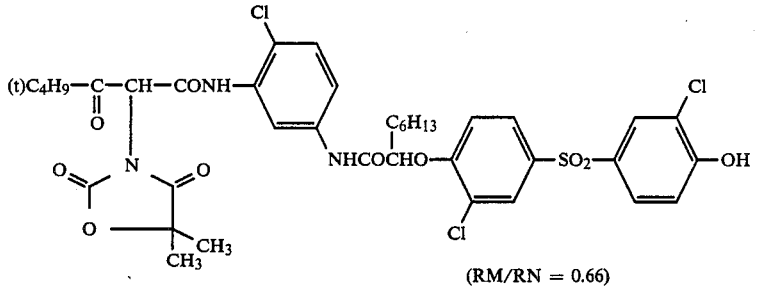
(RM/RN = 0.66)
(Y-24)
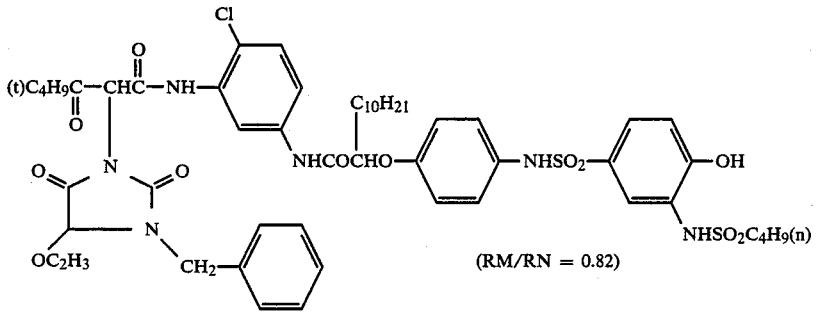
(RM/RN = 0.82)
(Y-25)
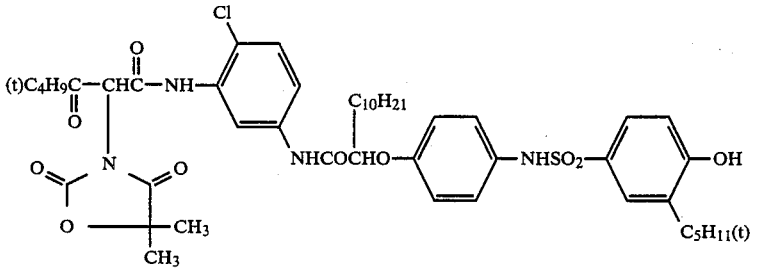
(RM/RN = 0.71)
(Y-26)
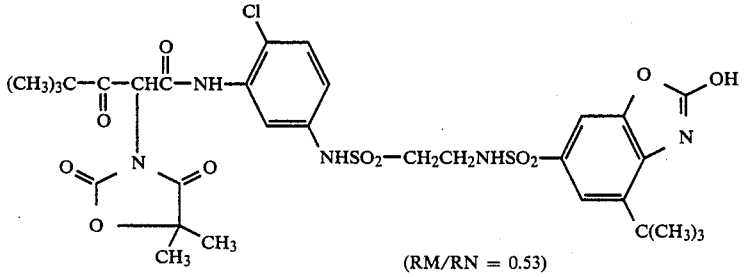
(RM/RN = 0.53)

-continued
(Y-27)
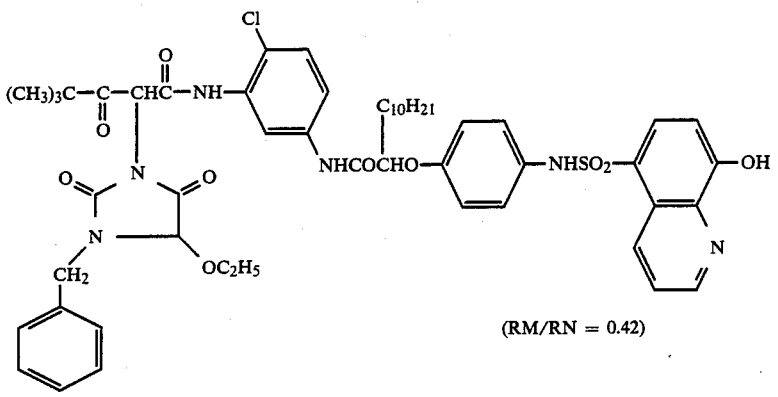
(RM/RN = 0.42)
(Y-28)
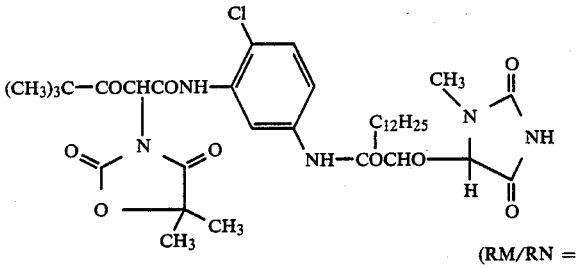
(RM/RN = 0.42)
(Y-29)
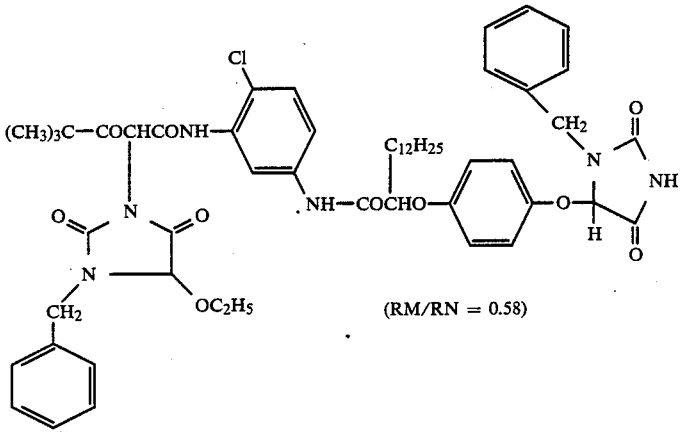
(RM/RN = 0.58)
(Y-30)
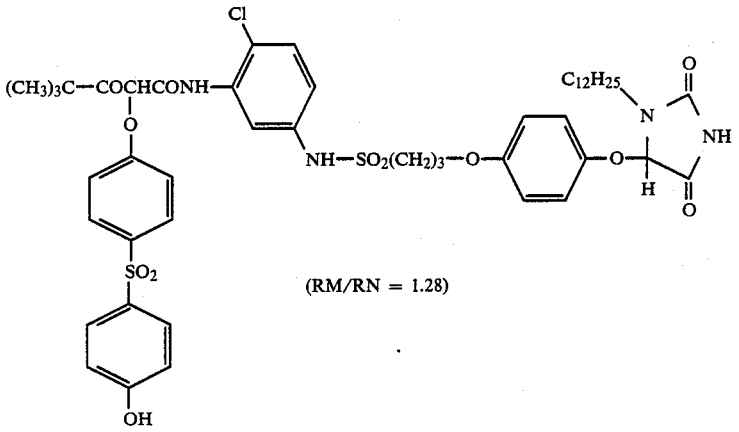
(RM/RN = 1.28)

-continued
(Y-31)
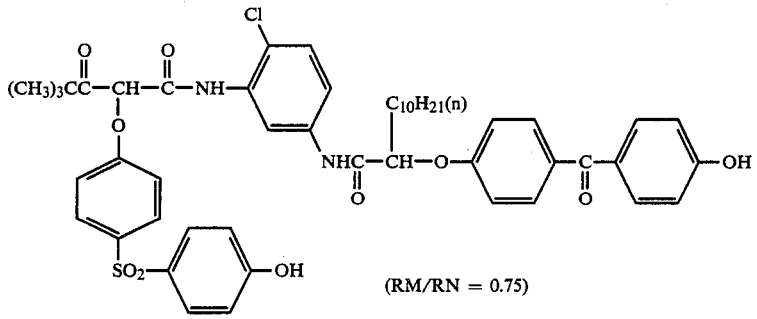
(RM/RN = 0.75)
(Y-32)
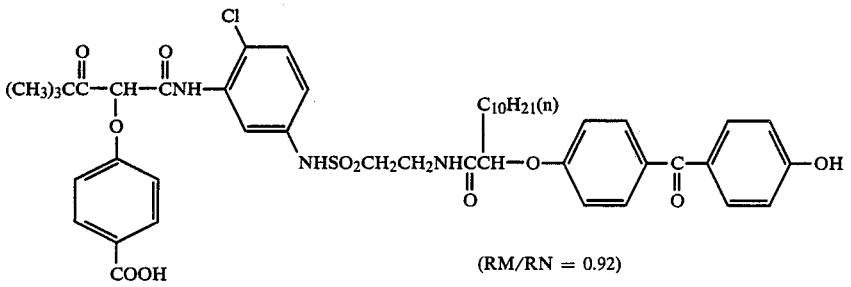
(RM/RN = 0.92)
(Y-33)
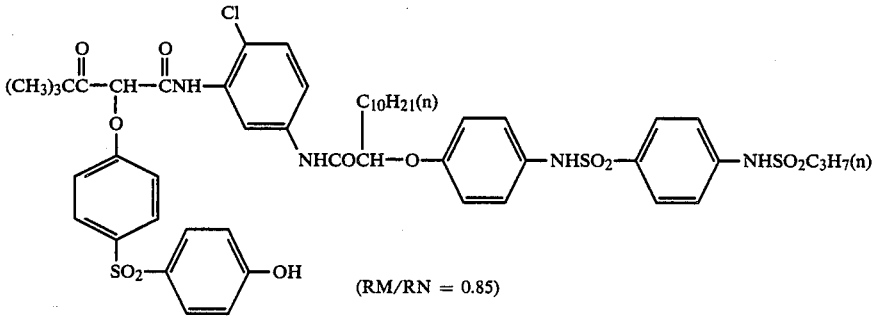
(RM/RN = 0.85)
(Y-34)
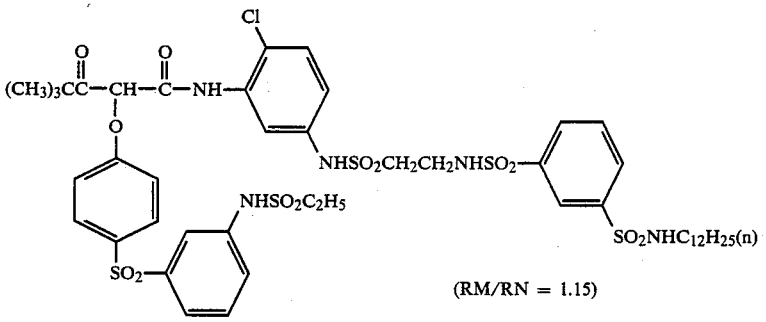
(RM/RN = 1.15)
(Y-35)
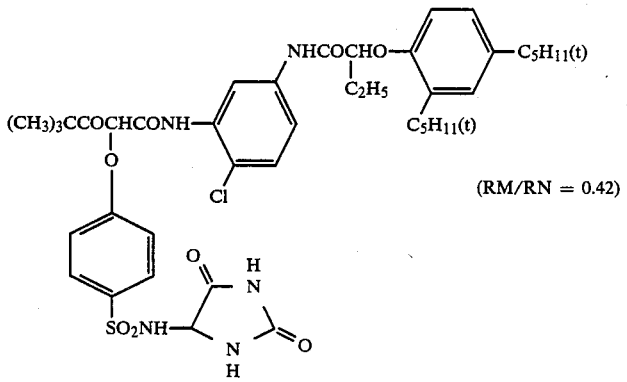
(RM/RN = 0.42)

-continued (Y-36)

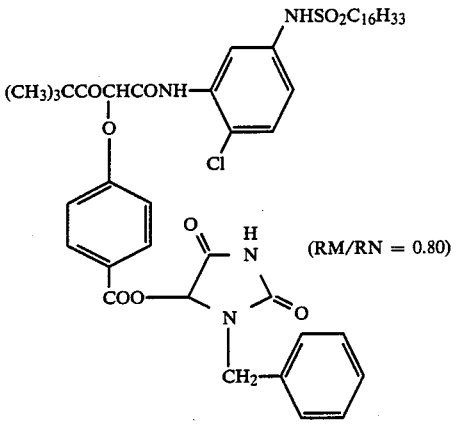

(RM/RN = 0.80)

(Y-37)

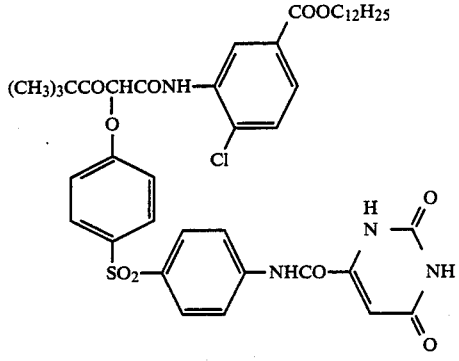

(RM/RN = 1.21)

(Y-38)

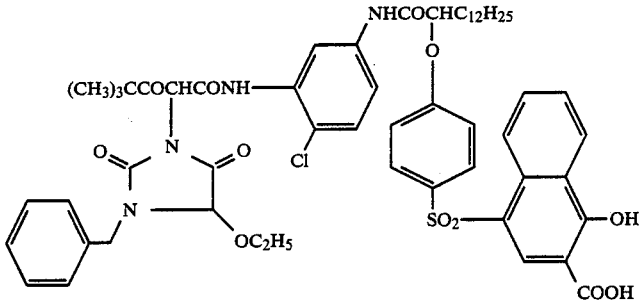

(RM/RN = 0.6)

(Y-39)

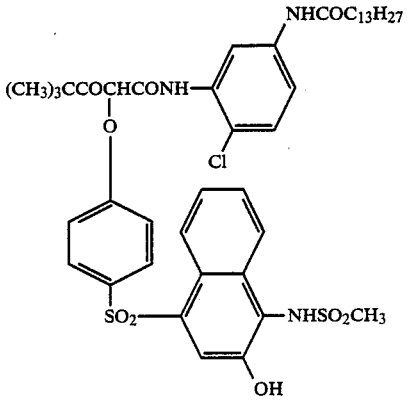

(RM/RN = 0.9)

The photographic light-sensitive material's developing method of this invention may use a color developing bath containing the color developing agent of the present invention, and, in addition to the bath processing, may also use various processes such as the spray process, the web-developing process which develops a light-sensitive material in contact with a developer solution-impregnated carrier, or the viscous developer-using development process.

Aside from the above, to the photographic light-sensitive material's developing method of the present invention may be applied all sorts of processing methods; for example, those representative thereof include a method comprising color developing, then bleach-fixing, and then, if necessary, washing and/or stabilizing; a method comprising color developing, then bleaching and fixing separately, and then, if necessary, washing and/or stabilizing; a method comprising prehardening, neutralizing, color developing, then stop-fixing, washing, bleaching, fixing, post-hardening, and then washing; a method comprising color developing, then washing, supplementary color developing, stopping, bleaching, fixing, washing, and then stabilizing; and a method comprising halogenation-bleaching the developed silver produced by color developing, and then color developing again to increase the amount of the formed dye; any of such methods can be used.

The color developer solution to be used in this invention may contain arbitrarily further various components which are those additives usually used, including alkaline agents such as, e.g., sodium hydroxide, sodium carbonate; alkali metal sulfites, alkali metal hydrogen sulfites, alkali metal thiocyanates, alkali metal halides, benzyl alcohol, water softener, thickeners, development accelerators, and the like.

Aside from the above additives, those additives additionally usable in the foregoing color developer solution include bromides such as potassium bromide, sodium bromide, etc.; compounds for rapid processing such as alkali iodide, nitrobenzimidazole, mercaptobenzimidazole, 5-methyl-benzotriazole, 1-phenyl-5-mercatotetrazole, etc.; antistain agents, antisludge agents, preservatives, inter-image effect accelerators, chelating agents, and the like.

Those typically, generally known as the bleaching agent to be used in the bleaching process or a bleach-fix bath include those metallic (such as iron, cobalt, copper) ion-coordinated organic acids such as aminopolycarboxylic acids, or oxalic acid, citric acid, etc. And those representative of the above aminopolycarboxylic acids include the following:

Ethylenediamine-tetraacetic acid,
Diethylenetriamine-pentaacetic acid,
Propylenediamine-tetraacetic acid,
Nitrilotriacetic acid,
Iminodiacetic acid,
Glycol-ether-diamine-tetraacetic acid,
Ethylenediamine-tetrapropionic acid,
Disodium ethylenediamine-tetraacetic acid,
Pentasodium diethylenetriamine-pentaacetic acid, and
Sodium nitrilotriacetic acid.

The bleaching bath may cotain various additives in addition to any of the above bleaching agents. Where the bleaching process uses a bleach-fix bath, a liquid of a composition containing a silver halide fixing agent in addition to the foregoing bleaching agent may be used. Also, the bleach-fix bath may further contain a halogenated compound such as potassium bromide. And similarly to the foregoing bleaching bath, it may contain various other additives including, e.g., pH buffers, brightening agents, defoaming agents, surfactants, preservatives, chelating agents, stabilizers, organic solvents, and the like.

In addition, examples of the silver halide fixing agent include those compounds capable of reacting with the silver halide to form a water-soluble silver salt, such as those usually used in ordinary fixing baths, e.g., sodium thiosulfate, ammonium thiosulfate, potassium thiocyanate, thiourea, thioether, and the like.

Those processes other than the color developing process for the silver halide color photographic light-sensitive material of this invention; e.g., the bleach-fixing (or the bleaching and the fixing) and the additionally-performed-at-need washing and stabilizing, are also desirable to take place at a temperature of equal to or more than 30° C. from the rapid processing point of view.

The silver halide color photographic light-sensitive material of this invention may be subjected to any of those washing-substitutive stabilizing treatments as described in Japanese Patent O.P.I. Publication Nos. 14834/1983, 105145/1983, 134634/1983 and 18631/1983, and Japanese Patent Application Nos. 2709/1983 and 89288/1984, and the like.

The photographic component layers of the silver halide color photographic light-sensitive material of this invention may contain a water-soluble or decolorable-in-color-developer dye (AI dye). Examples of the AI dye include oxonol dyes, hemioxonol dyes, merocyanine dyes and azo dyes. Above all, the oxonol dyes, hemioxonol dyes and merocyanine dyes are useful. Examples of the dyes usable in this invention are those as described in British Pat. Nos. 584,609 and 1,277,429, Japanese Patent O.P.I. Publication Nos. 85130/1973, 99620/1974, 114420/1974, 129537/1974, 108115/1977, 25845/1984, 111640/1984 and 111641/1984, U.S. Pat. Nos. 2,274,782, 2,533,472, 2,956,879, 3,125,448, 3,148,187, 3,177,078, 3,247,127, 3,260,601, 3,540,887, 3,575,704, 3,653,905, 3,718,472, 4,071,312 and 4,070,352.

Any of these AI dyes is used usually from $2\times10^{-3}$ to $5\times10^{-1}$ moles per mole of silver in the emulsion layer, and more preferably from $1\times10^{-2}$ to $1\times10^{-1}$.

The silver halide grain crystal may be in any forms such as regular, twin or other configurations, and those having any proportion between the [1.0.0] face and the [1.1.1] face may be used. Further, the crystalline structure of these silver halide grains may be either a homogeneous structure from the inside through the outside or a heterogeneous structure stratified with the inside and the outside (core/shell type). And the silver halide may also be either of the type forming a latent image on the surface of the grain thereof or of the type forming a latent image inside the grain thereof. Further, those plate-crystal-form silver halide grains as described in Japanese Patent O.P.I. Publication No. 113934/1983, Japanese Patent Application No. 170070/1984 may also be used.

The silver halide grains suitably usable in this invention are substantially monodisperse, which may be prepared in accordance with any of the acidic method, neutral method or ammonical method.

The silver halide may also be prepared, for example, in the manner that seed grains are prepared in the acidic method, and the grains are then grown rapidly by the ammoniacal method thereby to be grown up to the specified grain size. When growing the silver halide grains, it is desirable to sequentially and simultaneously pour and mix silver and halide ions in such quantities as to meet the silver halide grains' growing rate as described in, e.g., Japanese Patent O.P.I. Publication No. 48521/1979 with the pH and pAg inside the reactor being controlled.

The preparation of the silver halide grains of the present invention is desirable to be made as described above, and the composition containing the silver halide grains is called the silver halide emulsion in this specification.

The silver halide emulsion may be chemically sensitized by using active gelatin, sulfur sensitizers such as arylthiocarbamides, thiourea, cystine, etc.; selenium sensitizers; reduction sensitizers such as stannous salts, thiourea dioxide, polyamines, etc.; noble-metallic sensitizers including gold sensitizers such as potassium aurithiocyanate, potassium chloroaurate, 2-aurothio-3-methylbenzothiazolium chloride, etc., or such sensitizers as water-soluble salts of, e.g., ruthenium, palladium, platinum, rhodium, iridium, etc., such as ammonium chloropalladate, potassium chloroplatinate, sodium chloropalladate (some of these sensitizers function as sensitizers or antifoggants according to the quantity used); and the like. These sensitizers may be used alone or in arbitrary combination (for example, in combination of a gold sensitizer with a sulfur sensitizer, in combination of a gold sensitizer with a selenium sensitizer, and the like).

The silver halide emulsion of this invention may be chemically ripened with the addition of a sulfur-containing compound, and to the emulsion may be incorporated prior to, during or after the chemical ripening at least one of hydroxytetraazaindenes and at least one of mercapto group-having nitrogen-containing heterocyclic compounds.

The silver halide to be used in this invention, in order to make the silver halide sensitive to a desired wavelength region, may be optically sensitized by the addition thereto of an appropriate sensitizing dye in the quantity range of from $5\times10^{-8}$ to $3\times10^{-3}$. Various sensitizing dyes may be used as the above sensitizing dye and may be used alone or in combination of two or more thereof. Those advantageously usable as the sensitizing dye in this invention include the following:

Examples of the sensitizing dye usable in the blue-sensitive silver halide emulsion include those as described in, e.g., West German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, Japanese Patent Examined Publication Nos. 14030/1969 and 24844/1977. Examples of the sensitizing dye usable in the green-sensitive silver halide emulsion include those typical cyanine dyes, merocyanine dyes or complex cyanine dyes as described in, e.g., U.S. Pat. Nos. 1,939,201, 2,072,908, 2,739,149 and 2,945,763, British Pat. No. 505,979. And examples of the sensitizing dye usable in the red-sensitive silver halide emulsion include those typical cyanine dyes, merocyanine dyes and complex cyanine dyes as described in, e.g., U.S. Pat. Nos. 2,269,234, 2,270,378, 2,442,710, 2,454,629 and 2,776,280. Further, those cyanine dyes, merocyanine dyes and complex cyanine dyes as described in U.S. Pat. Nos. 2,213,995, 2,493,748 and 2,519,001, and West German Pat. No. 929,080 may also be advantageously used in the green-sensitive silver halide emulsion or red-sensitive silver ahlide emulsion.

These sensitizing dyes may be used alone or in combination.

The photographic light-sensitive material of the present invention may be spectrally sensitized to a desired wavelength region by an optical sensitization method using, if necessary, alone or in combination cyanine dyes or merocyanine dyes.

Examples representative of the particularly preferred spectral sensitization method include those methods as described in Japanese Patent Examined Publication Nos. 4936/1968, 22884/1968, 18433/1970, 37443/1972, 28293/1973, 6209/1974 and 12375/1978, Japanese Patent O.P.I. Publication Nos. 23931/1977, 51932/1977, 80118/1979, 153926/1983, 116646/1984 and 116647/1984, and the like.

Descriptions concerning the combined use of carbocyanine dyes having the benzimidazole nucleus with other cyanines or merocyanines are found in, e.g., Japanese Patent Examined Publication Nos. 25831/1970, 11114/1972, 25379/1972, 38406/1973, 38407/1973, 34535/1979 and 1569/1980, Japanese Patent O.P.I. Publication Nos. 33220/1975, 38526/1975, 107127/1976, 115820/1976, 135528/1976, 104916/1977 and 104917/1977.

Further, concerning the combined use of benzoxazolocarbocyanines (oxacarbocyanines) with other carbocyanines, descriptions are found in, e.g., Japanese Patent Examined Publication Nos. 32753/1969 and 11627/1971, and Japanese Patent O.P.I. Publication No. 1483/1982. With respect to merocyanines, reference is made to, e.g., Japanese Patent Examined Publication Nos. 38408/1973, 41204/1973 and 40662/1975, and Japanese Patent O.P.I. Publication Nos. 25728/1981, 10753/1983, 91445/1983, 116645/1984 and 33828/1975.

For the combined use of thiacarbocyanines with other carbocyanines reference is made to, e.g., Japanese Patent Examined Publication Nos. 4932/1968, 4933/1968, 26470/1970, 18107/1971 and 8741/1972, and Japanese Patent O.P.I. Publication No. 114533/1984. Further, for the use of zeromethine or dimethine-merocyanines, monomethine or trimethine-cyanines, those methods as described in Japanese Patent Examined Publication No. 6207/1974 may be advantageously used.

In order to incorporate such sensitizing dyes into the silver halide emulsion of this invention, the dye is used in the form of a dye solution prepared by in advance dissolving the dye into a hydrophilic organic solvent such as methyl alcohol, ethyl alcohol, acetone, dimethylformamide or such a fluorinated alcohol as described in Japanese Patent Examined Publication No. 40659/1975.

The addition of the dye may be arbitrarily made in the beginning of, during, or after the chemical ripening of the silver halide emulsion, or, as the case may be, the addition may take place in a process immediately before the emulsion coating.

The green-sensitive silver halide emulsion layer of this invention contains a pyrazolotriazole-type magenta coupler of this invention, and may also contain in combination a different magenta coupler other than the one of this invention, provided that the non-invention magenta coupler is desirable to be used in a quantity of less than 45 mole% of the total amount of the whole couplers. The blue-sensitive silver halide emulsion layer and red-sensitive halide emulsion layer of this invention may each contain an appropriate coupler; i.e., a compound capable of reacting with the oxidized product of a color developing agent to thereby form a dye.

Those effectively usable as the yellow coupler in this invention include open-chain ketomethylene compounds, and besides, those called 'two-equivalent-type couplers' such as active site-o-aryl-substituted couplers, active site-o-acyl-substituted couplers, active site hydantoin compound-substituted couplers, active site urazole compound-substituted couplers, active site succinic acid imide compound-substituted couplers, active site fluorine-substituted couplers, active site chlorine or bromine-substituted couplers, active site-o-sulfonyl-substituted couplers, and the like. Examples of the yellow coupler usable include those as described in U.S. Pat. Nos. 2,875,057, 3,256,506, 3,408,194, 3,551,155, 3,582,322, 3,725,072 and 3,891,445, West German Patent No. 1,547,868, West German OLS Patent Nos. 2,219,917, 2,261,361 and 2,414,006, British Patent No. 1,425,020, Japanese Patent Examined Publication No. 10783/1976, Japanese Patent O.P.I. Publication Nos. 26133/1972, 73147/1973, 102636/1976, 6341/1975, 123342/1975, 130442/1975, 21827/1976, 87650/1975, 82424/1977, 115219/1977 and 95346/1983.

Those magenta couplers usable in combination in this invention include the pyrazolone-type couplers and those non-invention couplers such as pyrazolotriazole-type, pyrazolinobenzimidazole-type, indazlone-type compounds. These magenta couplers, as in the case of the foregoing yellow couplers, may be not only four-equivalent couplers but also two-equivalent couplers. Examples of the magenta coupler usable in combination include those as described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German OLS Patent Nos. 2,408,665, 2,417,945, 2,418,959 and 2,424,467, Japanese Patent Examined Publication No. 6031/1965, Japanese Patent O.P.I. Publication Nos. 20826/1976, 58922/1977, 129538/1974, 74027/1974, 159336/1975, 42121/1977, 74028/1974, 60233/1975, 26541/1976 and 55122/1978, and Japanese Patent Application No. 1980.

Further, examples of the useful cyan coupler in this invention include, e.g., phenol-type and naphthol-type couplers. And these cyan couplers, as in the case of the foregoing yellow couplers, may be not only four-equivalent couplers but also two-equivalent couplers. Concrete examples of the cyan coupler include those as described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 3,772,002, 3,933,494 and 4,004,929, West German OLS Patent Nos. 2,414,830 and 2,454,329, Japanese Patent Examined Publication Nos. 59838/1973, 26034/1976, 5055/1973, 146827/1976, 69624/1977, 90932/1977 and 95346/1983, and Japanese Patent Examined Publication No. 11572/1974.

The silver halide emulsion layers and other photographic component layers of the photographic light-sensitive material of the present invention may also contain in combination those couplers including non-diffusible DIR compounds, colored magenta or cyan couplers, polymer couplers, diffusible DIR compounds, and the like. As for the non-diffusible DIR compounds and colored magenta or cyan couplers, reference can be made to the descriptions of our Japanese Patent Application No. 193611/1984, and as for the polymer couplers, reference can be made to the descriptions of our Japanese Patent Application No. 172151/1984.

The adding quantity of any of the above couplers usable in this invention, although not definitive, may be preferably from $1\times10^{-3}$ to 5 moles per mole of silver, and more preferably from $1\times10^{-1}$ to $5\times10^{-1}$.

The incorporation of any of the pyrazolotriazole magenta couplers and the like of this invention into the silver halide emulsion layer of this invention, if the coupler is alkali-soluble, may be made in the form of an alkaline solution, and, if the coupler is oil-soluble, is desirable to be made in the form of a finely particulate dispersion liquid thereof prepared by dispersing a solution thereof dissolved into a high-boiling solvent, if necessary, in combination with a low-boiling solvent. In this instance, if necessary, a hydroquinone derivative, ultraviolet absorbing agent, anti-discoloration agent, etc., may also be used in combination. And, two or more different pyrazolotriazole-type magenta couplers of this invention may be used in combination. Further, referring in detail to the adding procedure favorable in this invention of the pyrazolotriazlole-type magenta couplers of the present invention, one or two or more of the pyrazolotriazole-type magenta couplers of the present invention, if necessary, together with other couplers, hydroquinone derivative, anti-discoloration agent, ultraviolet absorbing agent, etc., are dissolved into a high-boiling solvent, any one of those including organic amides, carbamates, esters, ketones, urea derivatives, ethers, hydrocarbons, etc., such as di-n-butylphthate, tricresyl phosphate, triphenyl phosphate, diisooctyl azelate, di-n-butyl sebacate, tri-n-hexyl phosphate, N,N-di-ethyl-caprylamidobutyl, N,N-diethyl-laurylamide, n-pentadecylphenyl-ether, dioctyl phthalate, n-nonyl-phenol, 3-pentadecylphenyl-ether, 2,5-di-sec-amylphenylbutyl-ether, monophenyl-di-o-chlorophenyl-phosphate, paraffin fluoride, or the like, and/or a low-boiling solvent such as methyl acetate, ethyl acetate, propyl acetate, butyl acetate, butyl propionate, cyclohexanol, diethylene glycol monoacetate, nitromethane, carbon tetrachloride, chloroform, cyclohexanetetrahydrofuran, methyl alcohol, acetonitrile, dimethylformamide, dioxane, methyl-ethyl ketone or the like, and the solution is then mixed with an aqueous solution containing an anionic surfactant such as an alkylbenzenesulfonic acid or alkylnapthalenesulfonic acid, and/or a nonionic surfactant such as sorbitansesquioleic acid ester or sorbitanmonolauric acid ester, and/or a hydrophilic binder such as gelatin, and the mixture is subsequently emulsifiedly dispersed by means of a high-speed rotary mixer, colloid mill or ultrasonic disperser, or the like, and then added to the silver halide emulsion.

Alternatively, the above couplers and the like may also be dispersed by using the latex dispersion method. The latex dispersion method for the couplers and the effect thereof are described in Japanese Patent O.P.I Publication Nos. 74538/1974, 59943/1976 and 32552/1979, and Research Disclosure, August 1976, No. 14850, p. 77–79.

Appropriate latexes for use in the method include those homopolymers, copolymers and terpolymers of such monomers as, e.g., styrene, acrylates, n-butyl-acrylate, n-butyl-methacrylate, 2-acetoacetoxyethyl-methacrylate, 2-(methacryloyloxy)ethyl-trimethylammoniummethosulfate, sodium 3-(methacryloyloxy)propane-1-sulfonate, N-isopropylacrylamide, N-[2-(2-methyl-4-oxopentyl)]acrylamide, 2-acrylamido-2-methylpropanesulfonic acid, and the like.

The silver halide color photographic light-sensitive material of this invention may contain further various other photographic additives such as those described in Research Disclosure No. 17643, including antifoggants, stabilizers, ultraviolet absorbing agents, antistain agents, brightening agents, anti-color-image-discoloration agents, antistatic agents, hardening agents, surface active agents, plasticizers, wetting agents, and the like.

Examples of the hydrophilic colloid for used in the preparation of the emulsion for the silver halide color photographic light-sensitive material of this invention include gelatin, gelatin derivatives, graft polymers of gelatin with other high-molecular materials; proteins such as albumin, casein, etc.; cellulose derivatives such as hydroxyethyl cellulose derivatives, carboxymethyl cellulose derivatives, etc.; starch derivatives; synthetic hydrophilic high-molecular materials comprising homo- or co-polymers such as polyvinyl alcohol, polyvinylimidazole, polyacrylamide, and the like.

Materials for the support of the silver halide color photographic light-sensitive material of this invention includ, e.g., baryta paper, polyethylene-coated paper, polypropylene synthetic paper, reflective layer-coated or reflective material-provided transparent support materials using, e.g., glass plates, cellulose acetate, cellulose nitrate; polyester film such as polyethylene terephthalate; polyamide film, polycarbonate film, polystyrene film, and the like. And other usually used any transparent materials may also be applied. These support materials are to be selectively used according to the purpose for which the light-sensitive material is used.

The coating of the silver halide emulsion layers and other photographic component layers used in this invention may be carried out by use of various coating methods such as the dipping coating, air-doctor coating, curtain coating, and the like, and may also be made by those two-or-more-layers-simultaneously-coating methods as described in U.S. Pat. Nos. 2,761,791 and 2,491,898.

In the present invention, the coating positions of the respective emulsion layers may be settled arbitrarily. For example, in the case of a light-sensitive material for making full-color photographic prints, it is desirable to arrange emulsion layers in the order of a blue-sensitive silver halide emulsion layer, green-sensitive silver halide emulsion layer and red-sensitive emulsion layer from the support side. These light-sensitive silver halide emulsion layers each may be comprised of two or more layers. And the effect of the present invention is largely exhibited when all these light-sensitive silver halide emulsion layers are substantially of a silver chlorobromide emulsion.

EXAMPLES

Examples of the present invention will be detailed below. The embodiments of this invention are not restricted to and by the examples.

EXAMPLE 1

On a polyethylene-laminated paper support were coated the following layers in order from the support side, whereby silver halide color photographic light-sensitive material samples No. 1 through No. 25 were prepared.

Layer 1 . . . A blue-sensitive silver halide emulsion layer containing 1.2 g/m$^2$ of gelatin, 0.32 g/m$^2$ (in terms of silver, and the same shall apply hereinafter) of a blue-sensitive silver halide gelatin emulsion (of which the silver halide composition and the average grain size are shown in Table 1) and 0.80 g/m$^2$ of a yellow coupler (hereinafter called RY-1) dissolved in 0.50 g/m$^2$ of dioctyl phthalate.

Layer 2 . . . An interlayer comprising 0.70 g/m$^2$ of gelatin, 10 mg/m$^2$ of an antiirradiation deye (hereinafter called AI-1) and 5 mg/m$^2$ of (AI-2).

Layer 3 . . . A green-sensitive silver halide emulsion layer containing 1.25 g/m$^2$ of gelatin, 0.28 g/m$^2$ of a green-sensitive silver halide gelatin emulsion (of which the silver halide composition and the average grain size are shown in Table 1) and 0.62 g/m$^2$ of a magenta coupler (hereinafter called RM-1) dissolved in 0.30 g/m$^2$ of dioctyl phthalate.

Layer 4 . . . An interlayer comprising 1.2 g/m$^2$ of gelatin.

Layer 5 . . . A red-sensitive silver halide emulsion layer containing 1.4 g/m$^2$ of gelatin, 0.26 g/m$^2$ of a red-sensitive silver halide gelatin emulsion (of which the silver halide composition and the average grain size are shown in Table 1) and 0.45 g/m$^2$ of a cyan coupler (hereinafter called RC-1) dissolved in 0.20 g/m$^2$ of dioctyl phthalate.

Layer 6 . . . A protective layer containing 0.50 g/m$^2$ of gelatin.

There are used the respective silver halides increased in colors by making use of ordinary spectral sensitizing dyes in the blue-sensitive silver halide emulsion layer, the green-sensitive silver halide emulsion layer and the red-sensitive silver halide emulsion layer, respectively.

(RY-1)

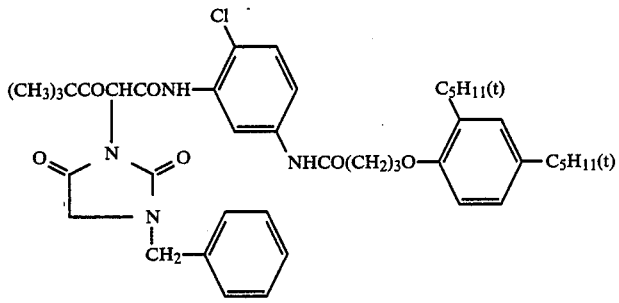

(RM-1)

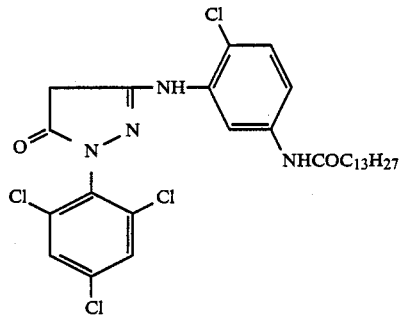

(RC-1)

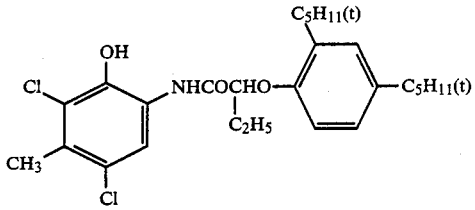

(AI-1)

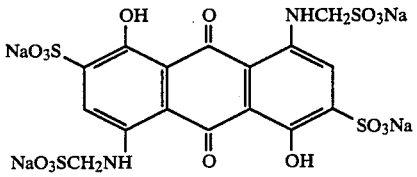

(AI-2)

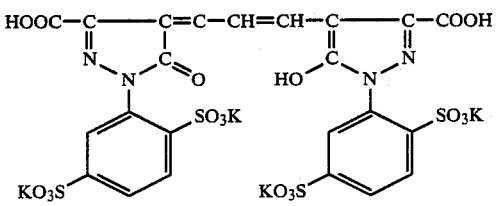

In addition, sodium 2,4-dichloro-6-hydroxy-S-triazine as a hardening agent was added to Layers 2, 4 and 6 in a quantity of 0.02 g per gram of gelatin in the respective layers, and after that, the resulting light-sensitive material was tested with respect to the layer swelling rate $T\frac{1}{2}$, using the following color developer solution, and as a result, the value of $T\frac{1}{2}$ was 7 seconds. The measurement was made by use of a Levenson-type swellometer.

Each of the light-sensitive material samples No. 1 through No. 25 given in Table 1 was exposed through an optical wedge to light, and then processed in the following procedure:

| Developing processes (38° C.) | |
|---|---|
| Color developing | 120 seconds |
| Bleach-fixing | 60 seconds |
| Washing | 60 seconds |
| Drying at 60~80° C. | 120 seconds |

The compositions of the respective processing baths are as follows:

| [Color Developer] | |
|---|---|
| Pure water | 800 ml |
| Benzyl alcohol | 15 ml |
| Hydroxylamine sulfate | 2.0 g |
| Potassium bromide | 0.6 g |
| Sodium chloride | 1.0 g |
| Potassium sulfite | 2.0 g |
| Triethanolamine | 2.0 g |
| Color developing agent (as given in Table 1) | 0.023 mole |
| 1-hydroxyethylidene—1,1'-diphosphonate (60% aqueous solution) | 1.5 ml |
| Magnesium chloride | 0.3 g |
| Potassium carbonate | 32.0 g |
| Kaycoll-PK-Conc (brightening agent, product of Shin-Nisso Kako K. K.) | 2 ml |
| Water to make 1 liter. Use 20% potassium hydroxide or 10% dilute sulfuric acid to adjust the pH to 10.1 | |
| [Bleach-Fix Bath] | |
| Pure water | 550 ml |
| Iron(III)—ammonium ethylenediamine-tetraacetate | 65.0 g |
| Ammonium thiosulfate (70% aqueous solution) | 85.0 g |
| Sodium hydrogensulfite | 10.0 g |
| Sodium metabisulfite | 2.0 g |
| Disodium ethylenediamine tetraacetate | 20.0 g |
| Add pure water to make 1 liter. Use aqueous ammonia or dilute sulfuric acid to adjust the pH to 7.0. | |

Aside from the above, the same samples No. 1 through No. 25 were processed in the same manner except that the concentration, 0.6 g/liter, of the potassium bromide in the above color developer solution was changed to 1.5 g/liter and 3.5 g/liter.

The processed samples each was subjected to sensitometry test in usual manner. The density of the exposure range in the proximity of the density 1.0 of each sample when the concentration of potassium bromide is 0.6 g/liter was regarded as 100, and changes in the density when the concentration of potassium bromide was thus changed are shown in relative values to the 100 in Table 1. In addition, the processed color densities' comparative data are given with respect to the cyan densities alone in Table 1.

Comparative Color Developing Agents

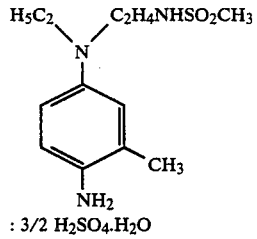

[CD-3]

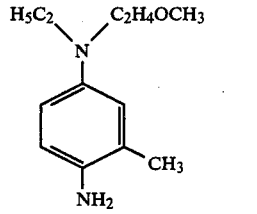

[CD-6]

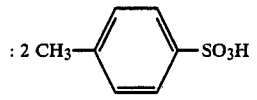

TABLE 1

| Sample No. | Average grain size (μm) | Silver halide composition: Red-sensitive emulsion layer I | Br | Cl | Green-sensitive emulsion layer I | Br | Cl | Blue-sensitive emulsion layer I | Br | Cl | Cyan density: Dev. agent CD-3, KBr concentration 0.6 | 1.5 | 3.5 | Dev. agent CD-6, KBr concentration 0.6 | 1.5 | 3.5 | Stable of dev. agent exemplified compound (1), KBr concentration 0.6 | 1.5 | 3.5 | Stable of dev. agent exemplified compound (2), KBr concentration 0.6 | 1.5 | 3.5 |
|---|---|---|---|---|---|---|---|---|---|---|---|---|---|---|---|---|---|---|---|---|---|---|
| 1 | 0.46 | 15 | 85 | — | 1 | 54 | 45 | 0.5 | 79.5 | 20 | 100 | 75 | 60 | 100 | 76 | 69 | 100 | 75 | 51 | 100 | 88 | 71 |
| 2 | 0.43 | 10 | 90 | — | 1 | 69 | 30 | 0.5 | 89.5 | 10 | 100 | 79 | 58 | 100 | 82 | 72 | 100 | 79 | 58 | 100 | 88 | 70 |
| 3 | 0.45 | 8 | 92 | — | 0.5 | 89.5 | 10 | 0.5 | 79.5 | 20 | 100 | 72 | 53 | 100 | 81 | 71 | 100 | 72 | 64 | 100 | 82 | 76 |
| 4 | 0.47 | 3 | 97 | — | 0.5 | 89.5 | 10 | 0.5 | 69.5 | 30 | 100 | 63 | 49 | 100 | 82 | 69 | 100 | 81 | 72 | 100 | 89 | 77 |
| 5 | 0.43 | 1 | 99 | — | 0.5 | 89.5 | 10 | 0.5 | 79.5 | 20 | 100 | 51 | 32 | 100 | 72 | 64 | 100 | 76 | 63 | 100 | 78 | 71 |
| 6 | 0.46 | 0.5 | 99.5 | — | 0.5 | 79.5 | 20 | 0.5 | 79.5 | 20 | 100 | 48 | 29 | 100 | 69 | 61 | 100 | 72 | 69 | 100 | 76 | 71 |
| 7 | 0.51 | — | 100 | — | 0.5 | 79.5 | 20 | 0.5 | 89.5 | 10 | 100 | 45 | 23 | 100 | 62 | 56 | 100 | 71 | 63 | 100 | 74 | 69 |
| 8 | 0.51 | 8 | 82 | 10 | 1 | 49 | 50 | 0.5 | 89.5 | 10 | 100 | 72 | 61 | 100 | 82 | 74 | 100 | 86 | 72 | 100 | 84 | 72 |
| 9 | 0.49 | 3 | 87 | 10 | 0.5 | 39.5 | 60 | 0.5 | 89.5 | 10 | 100 | 81 | 76 | 100 | 86 | 76 | 100 | 91 | 77 | 100 | 89 | 72 |
| 10 | 0.49 | 1 | 89 | 10 | 0.5 | 89.5 | 10 | 0.5 | 89.5 | 10 | 100 | 80 | 68 | 100 | 84 | 73 | 100 | 89 | 73 | 100 | 91 | 76 |
| 11 | 0.51 | 0.5 | 9.5 | 90 | 0.5 | 89.5 | 10 | 0.5 | 89.5 | 10 | 100 | 56 | 32 | 100 | 62 | 43 | 100 | 79 | 66 | 100 | 78 | 64 |
| 12 | 0.50 | — | — | 100 | 0.5 | 79.5 | 20 | 0.5 | 79.5 | 20 | 100 | 42 | 22 | 100 | 42 | 30 | 100 | 42 | 22 | 100 | 56 | 43 |
| 13 | 0.51 | 0.1 | 89.9 | 10 | 0.1 | 59.9 | 40 | 0.1 | 79.9 | 20 | 100 | 83 | 66 | 100 | 85 | 76 | 100 | 92 | 88 | 100 | 92 | 88 |
| 14 | 0.51 | 0.1 | 89.9 | 10 | 3 | 57 | 40 | 0.1 | 79.9 | 20 | 100 | 73 | 53 | 100 | 75 | 63 | 100 | 86 | 84 | 100 | 87 | 84 |
| 15 | 0.50 | 0.1 | 69.9 | 30 | — | 70 | 30 | 0.1 | 79.9 | 20 | 100 | 81 | 69 | 100 | 87 | 78 | 100 | 93 | 89 | 100 | 94 | 91 |
| 16 | 0.49 | 0.1 | 49.9 | 50 | — | 65 | 35 | — | 90 | 10 | 100 | 79 | 56 | 100 | 86 | 72 | 100 | 94 | 91 | 100 | 93 | 89 |
| 17 | 0.49 | — | 97 | 3 | — | 70 | 30 | — | 80 | 20 | 100 | 78 | 58 | 100 | 82 | 69 | 100 | 98 | 94 | 100 | 94 | 92 |

TABLE 1-continued

| Sample No. | Average grain size (μm) | Silver halide composition: Red-sensitive emulsion layer I | Br | Cl | Green-sensitive emulsion layer I | Br | Cl | Blue-sensitive emulsion layer I | Br | Cl | Cyan density: Dev. agent CD-3, KBr concentration 0.6 | 1.5 | 3.5 | Dev. agent CD-6, KBr concentration 0.6 | 1.5 | 3.5 | Stable of dev. agent exemplified compound (1), KBr concentration 0.6 | 1.5 | 3.5 | Stable of dev. agent exemplified compound (2), KBr concentration 0.6 | 1.5 | 3.5 |
|---|---|---|---|---|---|---|---|---|---|---|---|---|---|---|---|---|---|---|---|---|---|---|
| 18 | 0.51 | — | 92 | 8 | — | 70 | 30 | — | 80 | 20 | 100 | 79 | 57 | 100 | 83 | 71 | 100 | 94 | 92 | 100 | 94 | 90 |
| 19 | 0.47 | — | 90 | 10 | — | 65 | 35 | 0.1 | 89.9 | 10 | 100 | 76 | 64 | 100 | 81 | 70 | 100 | 96 | 94 | 100 | 96 | 94 |
| 20 | 0.49 | — | 80 | 20 | 0.1 | 64.9 | 35 | — | 70 | 30 | 100 | 79 | 68 | 100 | 84 | 69 | 100 | 96 | 95 | 100 | 98 | 96 |
| 21 | 0.49 | — | 70 | 30 | — | 70 | 30 | — | 90 | 10 | 100 | 81 | 72 | 100 | 82 | 72 | 100 | 97 | 96 | 100 | 97 | 97 |
| 22 | 0.51 | — | 60 | 40 | 0.1 | 39.9 | 60 | 0.1 | 79.9 | 20 | 100 | 88 | 76 | 100 | 85 | 74 | 100 | 98 | 97 | 100 | 98 | 96 |
| 23 | 0.46 | — | 50 | 50 | — | 50 | 50 | — | 80 | 20 | 100 | 82 | 69 | 100 | 86 | 73 | 100 | 99 | 99 | 100 | 99 | 96 |
| 24 | 0.43 | — | 40 | 60 | — | 45 | 50 | — | 80 | 20 | 100 | 72 | 61 | 100 | 80 | 64 | 100 | 96 | 93 | 100 | 98 | 96 |
| 25 | 0.44 | — | 30 | 70 | — | 80 | 20 | — | 90 | 10 | 100 | 64 | 49 | 100 | 71 | 54 | 100 | 94 | 89 | 100 | 95 | 91 |

As is apparent from the results shown in Table 1, Samples No. 13 through No. 25 whose silver halide is substantial silver chlorobromide and whose emulsion contains Exemplified Compound (1) or (2) as the color developing agent of this invention show little changes in the formed color density and therefore show high processing stability even when the bromide ion concentration in the color developer solution is changed from 0.5 g/liter to 1.5 g/liter and 3.5 g/liter as compared to Samples No. 1 through No. 12 whose silver halide is not substantial silver chlorobromide. In contrast, where Conventional Color Developing Agent CD-3 or CD-6 was used, there is the disadvantage that every processed sample, regardless of the silver halide composition, shows the formed color density deteriorated according to the increase in the bromide ion concentration in the color developer solution. In addition, Table 1 shows that, in this invention, the replenishing quantity can be significantly reduced, since it shows that the processing took place with a less replenishing quantity with the increase in the bromide ion concentration.

EXAMPLE 2

Silver halide photographic light-sensitive material Sample No. 20 was used and processed using the same processing solutions and exposed in the same manner as in Example 1 except that color developer solutions prepared with the color developing agent varied as shown in Table 2 were used, and the color developing took place at 38° C. for periods varied as shown in Table 2.

The resulted samples were stored at 70° C. and 90%RH and the variations of the red color density thereof were then measured. Table 2 exhibits the measurement results of the respective density lowerings in a density range selected when the initial density 1.0 of each sample was lowered by the order of about 0.3 by using CD-3 every processing time to serve as a color developing agent, such density range was the same as that obtained by processing each sample with the other color developers. Table 2 also exhibits the measurement results of the stain density in the unexposed areas of each of the same samples.

TABLE 2

| Sample No. | 38° C. second | Change in initial density 1.0 (DR) after aging: CD-3 | CD-6 | Sulfate of exemplified compound (1) | Sulfate of exemplified compound (2) | D min: CD-3 | CD-6 | Sulfate of exemplified compound (1) | Sulfate of exemplified compound (2) | Remarks |
|---|---|---|---|---|---|---|---|---|---|---|
| 31 | 300 | −0.30 | −0.39 | −0.61 | −0.58 | +0.16 | +0.38 | +0.16 | +0.18 | Comparative |
| 32 | 270 | −0.30 | −0.32 | −0.59 | −0.57 | +0.16 | +0.41 | +0.16 | +0.17 | |
| 33 | 240 | −0.30 | −0.36 | −0.58 | −0.51 | +0.16 | +0.39 | +0.16 | +0.17 | |
| 34 | 210 | −0.30 | −0.41 | −0.46 | −0.48 | +0.14 | +0.39 | +0.15 | +0.17 | |
| 35 | 180 | −0.30 | −0.39 | −0.39 | −0.37 | +0.18 | +0.36 | +0.15 | +0.18 | |
| 36 | 150 | −0.30 | −0.36 | −0.24 | −0.19 | +0.15 | +0.37 | +0.13 | +0.14 | Invention |
| 37 | 120 | −0.29 | −0.34 | −0.16 | −0.14 | +0.15 | +0.32 | +0.10 | +0.11 | |
| 38 | 90 | −0.28 | −0.38 | −0.14 | −0.13 | +0.15 | +0.31 | +0.09 | +0.10 | |
| 39 | 60 | −0.30 | −0.39 | −0.16 | −0.14 | +0.14 | +0.29 | +0.09 | +0.10 | |
| 40 | 30 | −0.29 | −0.39 | −0.14 | −0.13 | +0.14 | +0.27 | +0.09 | +0.09 | |
| 41 | 15 | −0.26 | −0.36 | −0.13 | −0.12 | +0.14 | +0.26 | +0.08 | +0.09 | |

As is apparent from the results in Table 2, where the color developer solution contains Color Developing Agent CD-3 or CD-6, no large difference in the discoloration rate between the agents is recognized whatever the color-developing time (seconds) may be, but CD-6 is larger in the discoloration than CD-3. The same thing is true to the yellow stain density (Dmin) in the unexposed area.

On the other hand, as for the color developing agent, Exemplified Compound (1) or (2) of the present invention, where the color developing time exceeds 180 seconds, the discoloration increases and the preservability in aging becomes significantly deteriorated. The same thing is true also to the yellow stain density (Dmin) in the unexposed area.

However, where the color developing time is less than 150 seconds, the preservability in aging is drastically improved to give more favorable results than in the case where the above CD-3 is used. This fact is surprising beyond the saying that the structure of the formed dye has close relations with the stability of the dye. The remaining of the color developing agent in the layer is assumed to also largely relate to the fact.

EXAMPLE 3

The respective silver halides of Samples No. 3 and No. 20 were used to prepare samples each having blue-, green- and red-sensitive emulsion layers coated so that the silver halide coating quantities are the same as those used in Example 1, and containing variously varied quantities of a hardening agent. These samples, after being dried, were immersed in the foregoing color developer solution (at a measured temperature of 35° C.) and measure with respect to the layer swelling rate $T\frac{1}{2}$ by means of a Levenson-type swellometer. From these samples those having swelling rates $T\frac{1}{2}$ of 2 seconds, 5 seconds, 10 seconds, 15 seconds, 30 seconds, 40 seconds, 60 seconds, 90 seconds and 120 seconds were selected and used. These selected samples each was exposed in the same manner as in Example 1 and processed in the same processing solutions as those used in Example 1. The maximum cyan density obtained when each sample was color-developed for 10 minutes at 38° C. was regarded as 100, and the processing period of time required for the maximum density of each sample to be 80 is given in Table 3. The results represent the rapidness of the development completing point of time.

TABLE 3

| | Color developing agent | Layer swelling rate $T\frac{1}{2}$ 2 sec. | 5 sec. | 7 sec. | 10 sec. | 15 sec. | 20 sec. | 30 sec. | 40 sec. | 60 sec. | 90 sec. | 120 sec: | |
|---|---|---|---|---|---|---|---|---|---|---|---|---|---|
| Comparative AfBrCl 80/20 | CD-3 | 125 | 128 | 128 | 130 | 136 | 143 | 158 | 178 | 189 | 195 | 196 | Silver chlorobromide |
| | CD-6 | 108 | 108 | 115 | 119 | 125 | 135 | 145 | 155 | 160 | 162 | 160 | |
| Invention AgBrCl 80/20 | Sulfate of exemplified compound (1) | 36 | 39 | 42 | 54 | 60 | 90 | 110 | 190 | 210 | 240 | 280 | |
| | Sulfate of exemplified compound (2) | 37 | 40 | 41 | 55 | 61 | 90 | 102 | 166 | 198 | 240 | 260 | |
| | Sulfate of exemplified compound (6) | 29 | 36 | 42 | 53 | 59 | 86 | 97 | 146 | 182 | 209 | 270 | |
| Comparative AgBrI 92/8 | CD-3 | 156 | 159 | 161 | 167 | 172 | 180 | 189 | 197 | 208 | 210 | 214 | Silver iodobromide |
| | CD-6 | 132 | 129 | 136 | 143 | 158 | 160 | 167 | 169 | 170 | 172 | 169 | |
| | Sulfate of exemplified compound (1) | 114 | 116 | 120 | 123 | 130 | 133 | 141 | 156 | 165 | 190 | 220 | |
| | Sulfate of exemplified compound (2) | 138 | 142 | 161 | 160 | 165 | 170 | 179 | 190 | 220 | 240 | 260 | |
| | Sulfate of exemplified compound (6) | 131 | 131 | 140 | 141 | 146 | 139 | 151 | 171 | 196 | 230 | 250 | |

As is apparent from the results in Table 3, where the silver halide is silver chloride, if the color developing agent used is of this invention and the layer swelling rate $T\frac{1}{2}$ is less than 30 seconds, the development completing time (time up to reaching the Dmax of 80) is very short, so that rapid processing is possible. On the other hand. even though the color developing agent of this invention is used, if the layer swelling rate $T\frac{1}{2}$ exceeds 40 seconds, the development completing (reaching) time becomes drastically longer, while on the other hand, in the case of the non-invention color developing agents, even if the layer swelling rate $T\frac{1}{2}$ is very small, no rapid development completing (reaching) time are obtained.

Meanwhile, where the silver halide is substantial silver iodobromide, even thought the color developing agent used is of this invention, no rapid development completing (reaching) time can be obtained regardless of whether the layer swelling rate $T\frac{1}{2}$ is longer or shorter.

EXAMPLE 4

The silver halide photographic light-sensitive material samples No. 3 and No. 20 of Example 1 were used to prepare samples each having blue-, green- and red-sensitive emulsion layers by coating so that each layer has the same quantity of silver and the total coating amounts of silver of the respective samples are 0.4 g/m$^2$, 0.75 g/m$^2$, 1.0 g/m$^2$, 2 g/m$^2$, 3 g/m$^2$, 5 g/m$^2$ and 7 g/m$^2$. The layer swelling rate $T\frac{1}{2}$ of each sample was 8 seconds. The quantities of the couplers used in Example 1 were applied intact to the sample containing the total amounts of silver of 1.0 g/m$^2$, and to the other samples were used the couplers in quantities relative to the respective total amounts of silver thereof. As for processing solutions, the same ones were used with the exception of the color developing agent varied in the same way as in Examples 1, 2 and 3.

Regarding the bromide ion concentration, 1.5 g/liter of potassium bromide were used. The maximum density obtained when each sample is processed in each color developer solution at 38° C. for 10 minutes is regarded as 100, and a processing period of time required for the maximum density to be 80 was measured, and the results, the obtained development completing time (time up to reaching the Dmax of 80), are shown in Table 4 in the same way as in Example 3.

TABLE 4

| | Amount of silver (g/m$^2$) | 0.4 | 0.75 | 1.0 | 2 | 3 | 5 | 7 |
|---|---|---|---|---|---|---|---|---|
| Comparative AgBrCl 80/20 | CD-3 | 121 | 126 | 129 | 136 | 141 | 142 | 146 |
| | CD-6 | 106 | 112 | 115 | 124 | 132 | 133 | 136 |
| Invention AgBrCl 80/20 | Sulfate of exemplified compound (1) | 36 | 38 | 42 | 54 | 72 | 88 | 104 |
| | Sulfate of exempli- | 37 | 40 | 41 | 51 | 72 | 91 | 114 |

TABLE 4-continued

| | Amount of silver (g/m²) | 0.4 | 0.75 | 1.0 | 2 | 3 | 5 | 7 |
|---|---|---|---|---|---|---|---|---|
| | fied compound (2) | | | | | | | |
| Comparative AgBrI 92/8 | CD-3 | 154 | 159 | 161 | 165 | 167 | 171 | 175 |
| | CD-6 | 125 | 130 | 136 | 138 | 141 | 143 | 148 |
| | Sulfate of exemplified compound (1) | 121 | 122 | 120 | 123 | 126 | 131 | 137 |
| | Sulfate of exemplified compound (2) | 160 | 162 | 161 | 164 | 166 | 168 | 165 |

As is apparent from Table 4, it is understood that, even in the processing method of this invention, as the total amounts of silver largely increases, the development completing time tends to become drastically longer, but the development completing time in this invention is still much shorter than that of the comparative processing.

EXAMPLE 5

On a polyethylene-laminated paper support were coated the following layers in order from the support side, whereby silver halide color photographic light-sensitive material samples No. 101 through No. 125 were prepared.

Layer 1 . . . A blue-sensitive silver halide emulsion layer comprising 0.30 g silver equivalent (the same shall apply hereinafter) of a blue-sensitive silver halide gelatin emulsion (the silver halide composition and the average grain size thereof are given in Table 1) containing 1.1 g/m² of gelatin and a solution of 0.82 g/m² of an yellow coupler (RY-1) dissolved in 0.48 g/m² of dioctyl phthalate.

Layer 2 . . . An interlayer comprising 0.72 g/m² of gelatin, and 15 mg/m² of an antiiradiation dye.

Layer 3 . . . A green-sensitive silver halide emulsion layer comprising 0.29 g/m² silver equivalent of a green-sensitive silver halide gelatin emulsion (the silver halide composition and the average grain size are given in Table 1) containing 1.25 g/m² of gelatin, and a solution of 0.60 g/m² of magenta coupler Exemplified Compound M-18 dissolved into 0.30 g of dioctyl phthalate.

Layer 4 . . . An interlayer comprising 1.2 g/m² of gelatin.

Layer 5 . . . A red-sensitive silver halide emulsion layer comprising 0.26 g/m² silver equivalent of a red-sensitive silver halide gelatin emulsion (the silver halide composition and the average grain size are given in Table 1) containing 1.3 g/m² of gelatin, and solution of 0.46 g/m² of Cyan Coupler (RC-2) dissolved into 0.21 g/m² of dioctyl phthalate.

Layer 6 . . . A protective layer comprising 0.49 g/m² of gelatin.

In addition, the above blue-sensitive silver halide emulsion layer, green-sensitive silver halide emulsion layer and red-sensitive silver halide emulsion layer were spectrally sensitized by appropriate sensitizing dyes which are generally used.

(RC-2)

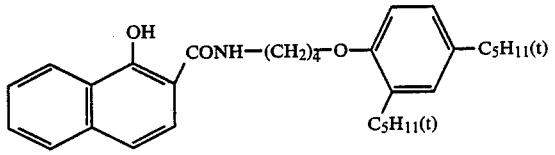

In addition, sodium 2,4-dichloro-6-hydroxy-S-triazine as a hardening agent was added to Layers 2, 4 and 6 in a quantity of 0.02 g per gram of gelatin in the respective layers, and after that, the resulting light-sensitive material was tested with respect to the layer swelling rate $T\frac{1}{2}$, using the following color developer solution, and as a result, the value of $T\frac{1}{2}$ was 8 seconds. The measurement was made in the same manner as in Example 1.

Each of the light-sensitive material samples No. 1 through No. 25 given in Table 1 was exposed through an optical wedge to light, and then processed in the same procedure as in Example 1.

Aside from the above, the same samples No. 1 through No. 25 were processed in the same manner except that the concentration, 0.6 g/liter, of the potassium bromide in the above color developer solution was changed to 1.5 g/liter and 3.5 g/liter.

The processed samples each was subjected to sensitometry test in usual manner. The density of the exposure range in the proximity of the density 1.0 of each sample when the concentration of potassium bromide is 0.6 g/liter was regarded as 100, and changes in the density when the concentration of potassium bromide was thus changed are shown in relative values to the 100 in Table 5. In addition, the processed color densities comparative data are given with respect to the cyan densities alone in Table 5.

TABLE 5

| Sample No. | Average grain size (μm) | Silver halide composition: Red-sensitive emulsion layer I | Br | Cl | Green-sensitive emulsion layer I | Br | Cl | Blue-sensitive emulsion layer I | Br | Cl | Cyan density: Dev. agent CD-3 KBr concentration 0.6 | 1.5 | 3.5 | Dev. agent CD-6 KBr concentration 0.6 | 1.5 | 3.5 | Stable of dev. agent exemplified compound (1) KBr concentration 0.6 | 1.5 | 3.5 | Stable of dev. agent exemplified compound (2) KBr concentration 0.6 | 1.5 | 3.5 |
|---|---|---|---|---|---|---|---|---|---|---|---|---|---|---|---|---|---|---|---|---|---|---|
| 101 | 0.46 | 15 | 85 | — | 1 | 54 | 45 | 0.5 | 79.5 | 20 | 100 | 74 | 58 | 100 | 74 | 68 | 100 | 73 | 49 | 100 | 82 | 70 |
| 102 | 0.43 | 10 | 90 | — | 1 | 69 | 30 | 0.5 | 89.5 | 10 | 100 | 78 | 60 | 100 | 80 | 70 | 100 | 78 | 55 | 100 | 81 | 68 |
| 103 | 0.45 | 8 | 92 | — | 0.5 | 89.5 | 10 | 0.5 | 79.5 | 20 | 100 | 71 | 54 | 100 | 80 | 71 | 100 | 70 | 61 | 100 | 80 | 75 |
| 104 | 0.47 | 3 | 97 | — | 0.5 | 89.5 | 10 | 0.5 | 69.5 | 30 | 100 | 60 | 49 | 100 | 79 | 68 | 100 | 75 | 71 | 100 | 85 | 70 |
| 105 | 0.43 | 1 | 99 | — | 0.5 | 89.5 | 10 | 0.5 | 79.5 | 20 | 100 | 51 | 32 | 100 | 72 | 62 | 100 | 70 | 60 | 100 | 72 | 70 |
| 106 | 0.46 | 0.5 | 99.5 | — | 0.5 | 79.5 | 20 | 0.5 | 79.5 | 20 | 100 | 45 | 28 | 100 | 68 | 60 | 100 | 69 | 65 | 100 | 76 | 68 |
| 107 | 0.51 | — | 100 | — | 0.5 | 79.5 | 20 | 0.5 | 89.5 | 10 | 100 | 44 | 23 | 100 | 61 | 55 | 100 | 70 | 60 | 100 | 74 | 65 |
| 108 | 0.51 | 8 | 82 | 10 | 1 | 49 | 50 | 0.5 | 89.5 | 10 | 100 | 72 | 60 | 100 | 80 | 72 | 100 | 84 | 70 | 100 | 80 | 70 |
| 109 | 0.49 | 3 | 87 | 10 | 0.5 | 39.5 | 60 | 0.5 | 89.5 | 10 | 100 | 80 | 75 | 100 | 82 | 74 | 100 | 85 | 72 | 100 | 85 | 69 |

TABLE 5-continued

| Sample No. | Average grain size (μm) | Silver halide composition: Red-sensitive emulsion layer I | Br | Cl | Green-sensitive emulsion layer I | Br | Cl | Blue-sensitive emulsion layer I | Br | Cl | Cyan density: Dev. agent CD-3 KBr concentration 0.6 | 1.5 | 3.5 | Dev. agent CD-6 KBr concentration 0.6 | 1.5 | 3.5 | Stable of dev. agent exemplified compound (1) KBr concentration 0.6 | 1.5 | 3.5 | Stable of dev. agent exemplified compound (2) KBr concentration 0.6 | 1.5 | 3.5 |
|---|---|---|---|---|---|---|---|---|---|---|---|---|---|---|---|---|---|---|---|---|---|---|
| 110 | 0.49 | 1 | 89 | 10 | 0.5 | 89.5 | 10 | 0.5 | 89.5 | 10 | 100 | 79 | 66 | 100 | 81 | 70 | 100 | 88 | 71 | 100 | 86 | 71 |
| 111 | 0.51 | 0.5 | 9.5 | 90 | 0.5 | 89.5 | 10 | 0.5 | 89.5 | 10 | 100 | 55 | 32 | 100 | 60 | 40 | 100 | 75 | 60 | 100 | 78 | 62 |
| 112 | 0.50 | — | — | 100 | 0.5 | 79.5 | 20 | 0.5 | 79.5 | 20 | 100 | 39 | 21 | 100 | 41 | 28 | 100 | 40 | 20 | 100 | 55 | 41 |
| 113 | 0.51 | 0.1 | 89.9 | 10 | 0.1 | 59.9 | 40 | 0.1 | 79.9 | 20 | 100 | 80 | 65 | 100 | 83 | 74 | 100 | 93 | 88 | 100 | 93 | 90 |
| 114 | 0.51 | 0.1 | 89.9 | 10 | 3 | 57 | 40 | 0.1 | 79.9 | 20 | 100 | 72 | 50 | 100 | 75 | 60 | 100 | 88 | 85 | 100 | 90 | 87 |
| 115 | 0.50 | 0.1 | 69.9 | 30 | — | 70 | 30 | 0.1 | 79.9 | 20 | 100 | 80 | 67 | 100 | 87 | 78 | 100 | 90 | 89 | 100 | 94 | 90 |
| 116 | 0.49 | 0.1 | 49.9 | 50 | — | 65 | 35 | — | 90 | 10 | 100 | 77 | 54 | 100 | 86 | 72 | 100 | 98 | 94 | 100 | 93 | 90 |
| 117 | 0.49 | — | 97 | 3 | — | 70 | 30 | — | 80 | 20 | 100 | 77 | 56 | 100 | 82 | 68 | 100 | 93 | 90 | 100 | 94 | 91 |
| 118 | 0.51 | — | 92 | 8 | — | 70 | 30 | — | 80 | 20 | 100 | 78 | 55 | 100 | 81 | 70 | 100 | 94 | 92 | 100 | 95 | 92 |
| 119 | 0.47 | — | 90 | 10 | — | 65 | 35 | 0.1 | 89.9 | 10 | 100 | 74 | 62 | 100 | 80 | 69 | 100 | 95 | 93 | 100 | 96 | 92 |
| 120 | 0.49 | — | 80 | 20 | 0.1 | 64.9 | 35 | — | 70 | 30 | 100 | 75 | 68 | 100 | 82 | 65 | 100 | 96 | 92 | 100 | 98 | 94 |
| 121 | 0.49 | — | 70 | 30 | — | 70 | 30 | — | 90 | 10 | 100 | 79 | 72 | 100 | 80 | 70 | 100 | 98 | 96 | 100 | 97 | 95 |
| 122 | 0.51 | — | 60 | 40 | 0.1 | 39.9 | 60 | 0.1 | 79.9 | 20 | 100 | 86 | 75 | 100 | 83 | 72 | 100 | 98 | 95 | 100 | 98 | 95 |
| 123 | 0.46 | — | 50 | 50 | — | 50 | 50 | — | 80 | 20 | 100 | 80 | 66 | 100 | 85 | 70 | 100 | 99 | 95 | 100 | 99 | 96 |
| 124 | 0.43 | — | 40 | 60 | — | 50 | 50 | — | 80 | 20 | 100 | 70 | 60 | 100 | 78 | 62 | 100 | 95 | 93 | 100 | 98 | 95 |
| 125 | 0.44 | — | 30 | 70 | — | 80 | 20 | — | 90 | 10 | 100 | 62 | 45 | 100 | 66 | 50 | 100 | 94 | 90 | 100 | 95 | 92 |

As is apparent from the results shown in Table 5, Samples No. 113 through No. 125 whose silver halide is substantial silver chlorobromide and whose emulsion contains Exemplified Compound (1) or (2) as the color developing agent of this invention show little changes in the formed color density and therefore show high processing stability even when the bromide ion concentration in the color developer solution is changed from 0.6 g/liter to 1.5 g/liter and 3.5 g/liter as compared to Samples No. 101 through No. 112 whose silver halide is not substantial silver chlorobromide. In contrast, where Conventional Color Developing Agent CD-3 or CD-6 was used, there is the disadvantage that every processed sample, regardless of the silver halide composition, shows the formed color density deteriorated according to the increase in the bromide ion concentration in the color developer solution. In addition, Table 5 shows that, in this invention, the replenishing quantity can be significantly reduced, since it shows that the processing took place with a less replenishing quantity with the increase in the bromide ion concentration.

EXAMPLE 6

Silver halide photographic light-sensitive material Sample No. 121 was used and processed using the same processing solutions and exposed in the same manner as in Example 5 except that color developer solutions prepared with the color developing agent varied as shown in Table 6 were used, and the color developing took place at 38° C. for periods varied as shown in Table 6.

The processed samples each was aged under the illumination of a xenon lamp light and changes in the cyan density were measured. That is, where the initial density 1.0 of each sample processed for each developing period in the developer containing Developing Agent CD-3 is reduced by about 0.3, the density deterioration of the same density region of the same sample processed in the other color developer containing the other Developing Agent CD-6 was measured and are shown in Table 6. At that time, the same sample's unexposed portions's yellow stain was measured and is also shown in Table 6.

TABLE 6

| Sample No. | 38° C. second | Change in initial density 1.0 (DR) after aging: CD-3 | CD-6 | Sulfate of exemplified compound (1) | Sulfate of exemplified compound (2) | D min: CD-3 | CD-6 | Sulfate of exemplified compound (1) | Sulfate of exemplified compound (2) | Remarks |
|---|---|---|---|---|---|---|---|---|---|---|
| 131 | 300 | −0.30 | −0.41 | −0.63 | −0.58 | +0.16 | +0.38 | +0.16 | +0.18 | Comparative |
| 132 | 270 | −0.30 | −0.32 | −0.60 | −0.55 | +0.16 | +0.42 | +0.16 | +0.17 | |
| 133 | 240 | −0.30 | −0.36 | −0.59 | −0.51 | +0.16 | +0.40 | +0.16 | +0.18 | |
| 134 | 210 | −0.30 | −0.41 | −0.46 | −0.47 | +0.14 | +0.39 | +0.15 | +0.17 | |
| 135 | 180 | −0.30 | −0.39 | −0.39 | −0.35 | +0.18 | +0.36 | +0.15 | +0.18 | |
| 136 | 150 | −0.30 | −0.36 | −0.25 | −0.18 | +0.15 | +0.37 | +0.12 | +0.14 | Invention |
| 137 | 120 | −0.29 | −0.34 | −0.16 | −0.15 | +0.15 | +0.32 | +0.10 | +0.11 | |
| 138 | 90 | −0.28 | −0.38 | −0.15 | −0.13 | +0.15 | +0.31 | +0.09 | +0.10 | |
| 139 | 60 | −0.30 | −0.38 | −0.15 | −0.13 | +0.14 | +0.30 | +0.09 | +0.10 | |
| 140 | 30 | −0.29 | −0.39 | −0.14 | −0.12 | +0.15 | +0.27 | +0.09 | +0.09 | |
| 141 | 15 | −0.26 | −0.36 | −0.13 | −0.12 | +0.14 | +0.26 | +0.08 | +0.08 | |

As is apparent from the results in Table 6, where the color developer solution contains Color Developing Agent CD-3 or CD-6, no large difference in the discoloration rate between the agents is recognized whatever the color-developing time (seconds) may be, but CD-6 is larger in the discoloration than CD-3. The same thing is true to the yellow stain density (Dmin) in the unexposed area.

On the other hand, as for the color developing agent, Exemplified Compound (1) or (2) of the present invention, where the color developing time exceeds 180 seconds, the discoloration increases and the preservability in aging becomes significantly deteriorated. The same thing is true also to the yellow stain density (Dmin) in the unexposed area.

However, where the color developing time is less than 150 seconds, the preservability in aging is drastically improved to give more favorable results than in the case where the above CD-3 is used. The fact is surprising beyond the saying that the structure of the formed dye has close relations with the stability of the dye. The remaining of the color developing agent in the layer is assumed to also largely relate to the fact.

EXAMPLE 7

The respective silver halides of Samples No. 103 and No. 121 were used to prepare samples each having blue-, green- and red-sensitive emulsion layers coated so that the silver halide coating quantities are the same as those used in Example 1, and containing variously varied quantities of a hardening agent. These samples, after being dried, were immersed in the foregoing color developer solution (at a measured temperature of 30° C.) and measure with respect to the layer swelling rate $T\frac{1}{2}$ in the same manner as in Example 1. From these samples those having swelling rates $T\frac{1}{2}$ of 2 seconds, 5 seconds, 10 seconds, 15 seconds, 30 seconds, 40 seconds, 60 seconds, 90 seconds and 120 seconds were selected and used. These selected samples each was exposed in the same manner as in Example 1 and processed in the same processing solutions as those used in Example 1. The maximum cyan density obtained when each sample was color-developed for 10 minutes at 38° C. was regarded as 100, and the processing period of time required for the maximum density of each sample to be 80 is given in Table 3. The results represent the rapidness of the development completing point of time.

TABLE 7

| | Color developing agent | Layer swelling rate $T\frac{1}{2}$ 2 sec. | 5 sec. | 7 sec. | 10 sec. | 15 sec. | 20 sec. | 30 sec. | 40 sec. | 60 sec. | 90 sec. | 120 sec. | |
|---|---|---|---|---|---|---|---|---|---|---|---|---|---|
| Comparative AfBrCl 70/30 | CD-3 | 127 | 130 | 130 | 133 | 140 | 144 | 161 | 180 | 191 | 196 | 197 | Silver chlorobromide |
| | CD-6 | 106 | 108 | 113 | 118 | 126 | 134 | 144 | 156 | 162 | 166 | 167 | |
| Invention AgBrCl 70/30 | Sulfate of exemplified compound (1) | 35 | 38 | 42 | 53 | 58 | 90 | 111 | 191 | 208 | 244 | 282 | |
| | Sulfate of exemplified compound (2) | 36 | 41 | 41 | 53 | 60 | 89 | 103 | 159 | 188 | 236 | 251 | |
| | Sulfate of exemplified compound (6) | 30 | 35 | 40 | 53 | 60 | 86 | 99 | 147 | 188 | 201 | 257 | |
| Comparative AgBrI 92/8 | CD-3 | 150 | 158 | 159 | 165 | 177 | 188 | 190 | 203 | 208 | 215 | 220 | Silver iodobromide |
| | CD-6 | 130 | 129 | 136 | 143 | 155 | 160 | 167 | 170 | 166 | 172 | 180 | |
| | Sulfate of exemplified compound (1) | 110 | 116 | 122 | 123 | 130 | 133 | 141 | 156 | 165 | 188 | 210 | |
| | Sulfate of exemplified compound (2) | 140 | 142 | 161 | 162 | 165 | 172 | 180 | 192 | 209 | 242 | 255 | |
| | Sulfate of exemplified compound (6) | 129 | 129 | 138 | 143 | 145 | 144 | 152 | 183 | 204 | 235 | 248 | |

As is apparent from the results in Table 7, where the silver halide is silver chloride, if the color developing agent used is of this invention and the layer swelling rate $T\frac{1}{2}$ is less than 30 seconds, the development completing time (time up to reaching the Dmax of 80) is very short, so that rapid processing is possible. On the other hand, even through the color developing agent of this invention is used, if the layer swelling rate $T\frac{1}{2}$ exceeds 40 seconds, the development completing (reaching) time becomes drastically longer, while on the other hand, in the case of the non-invention color developing agents, even if the layer swelling rate $T\frac{1}{2}$ is very small, no rapid development completing (reaching) time are obtained.

Meanwhile, where the silver halide is substantial silver iodobromide, even thought the color developing agent used is of this invention, no rapid development completing (reaching) time can be obtained regardless of whether the layer swelling rate $T\frac{1}{2}$ is longer or shorter.

EXAMPLE 8

The silver halide photographic light-sensitive material samples No. 103 and No. 121 of Example 5 were used to prepare samples each having blue-, green- and red-sensitive emulsion layers by coating so that each layer has the same quantity of silver and the total coating amounts of silver of the respective samples are 0.4 g/m$^2$, 0.75 g/m$^2$, 1.0 g/m$^2$, 2 g/m$^2$, 3 g/m$^2$, 5 g/m$^2$ and 7 g/m$^2$. The layer swelling rate $T\frac{1}{2}$ (measured at a processing temperature of 30° C.) of each sample was 8 seconds. The quantities of the couplers used in Example 5 were applied intact to the sample containing the total amounts of silver of 1.0 g/m$^2$, and to the other samples were used the couplers in quantities relative to the respective total amounts of silver thereof. As for processing solutions, the same ones were used with the exception of the color developing agent varied in the same way as in Examples 5, 6 and 7.

Regarding the bromide ion concentration, 1.5 g/liter of potassium bromide were used. The maximum density obtained when each sample is processed in each color developer solution at 38° C. for 10 minutes is regarded as 100, and a processing period of time required for the maximum density to be 80 was measured, and the results, the obtained development completing time (time up to reaching the Dmax of 80), are shown in Table 8 in the same way as in Example 7.

TABLE 8

| Amont of | 0.4 | 0.75 | 1.0 | 2 | 3 | 5 | 7 |
|---|---|---|---|---|---|---|---|

TABLE 8-continued

| | | | | | | | | |
|---|---|---|---|---|---|---|---|---|
| | silver ($g/m^2$) | | | | | | | |
| Comparative AgBrCl 70/30 | CD-3 | 126 | 130 | 133 | 140 | 143 | 150 | 155 |
| | CD-6 | 107 | 114 | 118 | 130 | 135 | 140 | 151 |
| Invention AgBrCl 70/30 | Sulfate of exemplified compound (1) | 35 | 36 | 43 | 55 | 75 | 90 | 108 |
| | Sulfate of exemplified compound (2) | 36 | 38 | 40 | 52 | 73 | 94 | 117 |
| Comparative AgBrI 92/8 | CD-3 | 154 | 160 | 163 | 166 | 170 | 174 | 181 |
| | CD-6 | 127 | 132 | 138 | 140 | 141 | 142 | 146 |
| | Sulfate of exemplified compound (1) | 119 | 120 | 121 | 121 | 125 | 130 | 137 |
| | Sulfate of exemplified compound (2) | 157 | 160 | 162 | 170 | 171 | 175 | 181 |

As is apparent from Table 8, it is understood that, even in the processing method of this invention, as the total amounts of silver largely increases, the development completing time tends to become drastically longer, but the development completing time in this invention is still much shorter than that of the comparative processing.

EXAMPLE 9

Color photographic paper samples were prepared in the same manner as in the samples of Example 5 except that the magenta coupler of the color photographic paper samples of Example 5 was replaced by the couplers shown in Table 9. These samples each was processed in the same manner as in Example 5. On the other hand, to the used color developer solution was added a bleach-fix solution so that the iron ion content of the solution is 3 ppm, and the liquid was allowed to stand in a beaker with its mouth open for five days. After that, this color developer liquid was used to develop the samples in the same way. And the difference between the magenta color stain densities on the unexposed area of each of the processed color paper samples before and after the aging of the color developer solution was measured by using a densitometer. The measured results are given in Table 9.

TABLE 9

| | Difference between magenta stains before and after aging | | | |
|---|---|---|---|---|
| Magenta coupler | CD-3 | CD-6 | Sulfate of exemplified compound (1) | Sulfate of exemplified compound (2) |
| Exemplified compound No. M-5 | 0.10 | 0.19 | 0.02 | 0.03 |
| Exemplified compound No. M-18 | 0.12 | 0.21 | 0.02 | 0.02 |
| Exemplified compound No. M-44 | 0.11 | 0.18 | 0.03 | 0.03 |
| Exemplified compound No. M-59 | 0.11 | 0.20 | 0.04 | 0.04 |
| Exemplified compound No. M-104 | 0.15 | 0.23 | 0.03 | 0.04 |
| Comparative coupler (TM-1)* | 0.21 | 0.27 | 0.12 | 0.14 |
| Comparative coupler (TM-2)** | 0.20 | 0.26 | 0.15 | 0.16 |

(TM-2)

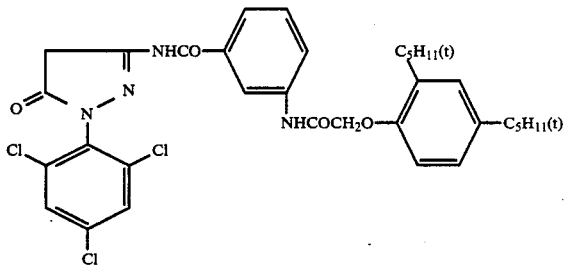

As is apparent from Table 9, it is understood that the use of these couplers having Formula [I] of this invention produces little magenta stain attributed to the mixing in of heavy-metallic ions as compared to those well-known pyrazolone-type couplers such as the ones used in comparative examples, and further, the use of the developing agent of this invention (N-hydroxyalkyl-substituted-p-phenylenediamine derivative) in combination with the above coupler is very effective in restraining particularly the occurrence of magenta stain. This fact implies that the color developer solution of this invention, even when heavy-metallic ions are mixed therein (the iron ion in the bleach-fix bath or from the water used for the preparation of the color developer solution is mixed in), causes little visually conspicuous magenta stain to appear in the white background portion, thus giving stable processing characteristics.

EXAMPLE 10

On a polyethylene-laminated paper support, the following layers were coated in order from the support side, whereby silver halide color photographic light-sensitive material samples No. 201 through No. 225 were prepared.

Layer 1 . . . A blue-sensitive silver halide emulsion layer containing 1.5 $g/m^2$ of gelatin, a blue-sensitive silver halide gelatin emulsion (of which the silver halide composition and the average grain size are shown in Table 1) in an amount of 0.35 $g/m^2$ (in terms of the silver content thereof, and so forth on), and 1.0 $g/m^2$ of an exemplified yellow coupler compound (Y-6) dissolved in 0.50 $g/m^2$ of dioctyl phthalate.

Layer 2 . . . An interlayer comprising 0.70 $g/m^2$ of gelatin.

Layer 3 . . . A green-sensitive silver halide emulsion layer containing 1.30 $g/m^2$ of gelatin, a green-sensitive silver halide gelatin emulsion (of which the silver halide composition and the average grain size are shown in Table 1) in an amount of 0.30 $g/m^2$ (in terms of the silver content thereof), and 0.70 $g/m^2$ of the magenta couplers (RM-3) dissolved in 0.30 $g/m^2$ of dioctyl phthalate.

Layer 4 . . . An interlayer comprising 1.2 $g/m^2$ of gelatin.

Layer 5 . . . A red-sensitive silver halide emulsion layer containing 1.4 g/m$^2$ of gelatin, a red-sensitive silver halide gelatin emulsion (of which the silver halide composition and the average grain size are shown in Table 1) in an amount of 0.26 g/m$^2$ (in terms of the silver content thereof), and 0.50 g/m$^2$ of the cyan couplers (RC-1) and (RC-2) (at a mol% of 2:1) dissolved in 0.20 g/m$^2$ of dioctyl phthalate.

Layer 6 . . . A protective layer containing 0.50 g/m$^2$ of gelatin.

In addition, the above blue-sensitive silver halide emulsion layer, green-sensitive silver halide emulsion layer and red-sensitive silver halide emulsion layer were spectrally sensitized by appropriate sensitizing dyes which are generally (TM-3)

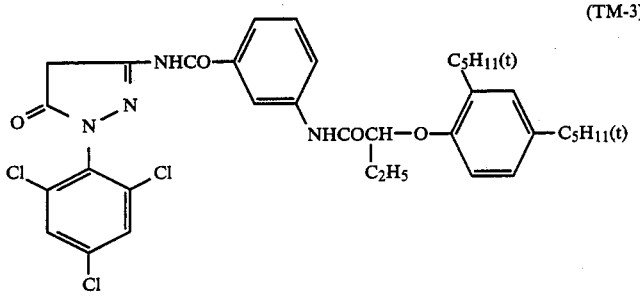

(TC-3)

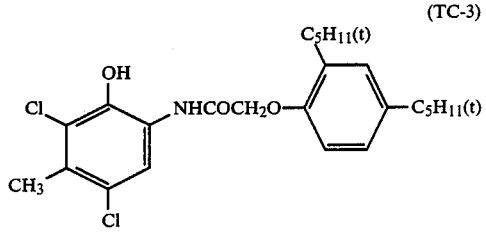

In addition, sodium 2,4-dichloro-6-hydroxy-S-triazine as a hardening agent was added to Layers 2, 4 and 6 in a quantity of 0.025 g per gram of gelatin in the respective layers, and after that, the resulting light-sensitive material was tested in the same manner as in Example 1, with respect to the layer swelling rate $T\frac{1}{2}$, using the following color developer solution, and as a result, the value of $T\frac{1}{2}$ was 12 seconds.

Each of the light-sensitive material samples No. 201 through No. 225 given in Table 1 was exposed through an optical wedge to light, and then processed in the same procedure as in Example 1:

Aside from the above, the same samples No. 201 through No. 225 were processed in the same manner except that the concentration, 0.6 g/liter, of the potassium bromide in the above color developer solution was changed to 1.5 g/liter and 3.5 g/liter.

The processed samples each was subjected to sensitometry test in usual manner. The density of the exposure range in the proximity of the density 1.0 of each sample when the concentration of potassium bromide is 0.6 g/liter was regarded as 100, and changes in the density when the concentration of potassium bromide was thus changed are shown in relative values to the 100 in Table 10. In addition, the processed color densities comparative data measured by the spectral reflectance densitometer PDA-65 (mfd. by Konishiroku Photo Ind. Co., Ltd.) are given with respect to the cyan densities alone in Table 10.

TABLE 10

| Sample No. | Average grain size (μm) | Silver halide composition: Red-sensitive emulsion layer I | Br | Cl | Green-sensitive emulsion layer I | Br | Cl | Blue-sensitive emulsion layer I | Br | Cl |
|---|---|---|---|---|---|---|---|---|---|---|
| 201 | 0.46 | 15 | 85 | — | 1 | 54 | 45 | 0.5 | 79.5 | 20 |
| 202 | 0.43 | 10 | 90 | — | 1 | 69 | 30 | 0.5 | 89.5 | 10 |
| 203 | 0.45 | 8 | 92 | — | 0.5 | 89.5 | 10 | 0.5 | 79.5 | 20 |
| 204 | 0.47 | 3 | 97 | — | 0.5 | 89.5 | 10 | 0.5 | 69.5 | 30 |
| 205 | 0.43 | 1 | 99 | — | 0.5 | 89.5 | 10 | 0.5 | 79.5 | 20 |
| 206 | 0.46 | 0.5 | 99.5 | — | 0.5 | 79.5 | 20 | 0.5 | 79.5 | 20 |
| 207 | 0.51 | — | 100 | — | 0.5 | 79.5 | 20 | 0.5 | 89.5 | 10 |
| 208 | 0.51 | 8 | 82 | 10 | 1 | 49 | 50 | 0.5 | 89.5 | 10 |
| 209 | 0.49 | 3 | 87 | 10 | 0.5 | 39.5 | 60 | 0.5 | 89.5 | 10 |
| 210 | 0.49 | 1 | 89 | 10 | 0.5 | 89.5 | 10 | 0.5 | 89.5 | 10 |
| 211 | 0.51 | 0.5 | 9.5 | 90 | 0.5 | 89.5 | 10 | 0.5 | 89.5 | 10 |
| 212 | 0.50 | — | — | 100 | 0.5 | 79.5 | 20 | 0.5 | 79.5 | 20 |
| 213 | 0.51 | 0.1 | 89.9 | 10 | 0.1 | 59.9 | 40 | 0.1 | 79.9 | 20 |
| 214 | 0.51 | 0.1 | 89.9 | 10 | 3 | 57 | 40 | 0.1 | 79.9 | 20 |
| 215 | 0.50 | 0.1 | 69.9 | 30 | — | 70 | 30 | 0.1 | 79.9 | 20 |
| 216 | 0.49 | 0.1 | 49.9 | 50 | — | 65 | 35 | — | 90 | 10 |
| 217 | 0.49 | — | 97 | 3 | — | 70 | 30 | — | 80 | 20 |
| 218 | 0.51 | — | 92 | 8 | — | 70 | 30 | — | 80 | 20 |
| 219 | 0.47 | — | 90 | 10 | — | 65 | 35 | 0.1 | 89.9 | 10 |
| 220 | 0.49 | — | 80 | 20 | 0.1 | 64.9 | 35 | — | 70 | 30 |
| 221 | 0.49 | — | 70 | 30 | — | 70 | 30 | — | 90 | 10 |
| 222 | 0.51 | — | 60 | 40 | 0.1 | 39.9 | 60 | 0.1 | 79.9 | 20 |
| 223 | 0.46 | — | 50 | 50 | — | 50 | 50 | — | 80 | 20 |
| 224 | 0.43 | — | 40 | 60 | — | 50 | 50 | — | 80 | 20 |
| 225 | 0.44 | — | 30 | 70 | — | 80 | 20 | — | 90 | 10 |

| Cyan density | | | |
|---|---|---|---|
| Dev. agent CD-3 KBr | Dev. agent CD-6 KBr | Stable of dev. agent exemplified compound (1) KBr | Stable of dev. agent exemplified compound (2) KBr |

TABLE 10-continued

| Sample | concentration | | | concentration | | | concentration | | | concentration | | |
|---|---|---|---|---|---|---|---|---|---|---|---|---|
| No. | 0.6 | 1.5 | 3.5 | 0.6 | 1.5 | 3.5 | 0.6 | 1.5 | 3.5 | 0.6 | 1.5 | 3.5 |
| 201 | 100 | 72 | 55 | 100 | 73 | 65 | 100 | 73 | 49 | 100 | 83 | 67 |
| 202 | 100 | 75 | 54 | 100 | 80 | 70 | 100 | 75 | 55 | 100 | 82 | 65 |
| 203 | 100 | 69 | 50 | 100 | 78 | 67 | 100 | 68 | 60 | 100 | 78 | 72 |
| 204 | 100 | 60 | 47 | 100 | 79 | 65 | 100 | 77 | 68 | 100 | 85 | 74 |
| 205 | 100 | 49 | 30 | 100 | 70 | 61 | 100 | 73 | 60 | 100 | 74 | 68 |
| 206 | 100 | 46 | 28 | 100 | 66 | 58 | 100 | 69 | 65 | 100 | 72 | 68 |
| 207 | 100 | 42 | 22 | 100 | 59 | 53 | 100 | 67 | 60 | 100 | 71 | 65 |
| 208 | 100 | 67 | 58 | 100 | 80 | 70 | 100 | 82 | 67 | 100 | 81 | 69 |
| 209 | 100 | 76 | 72 | 100 | 80 | 71 | 100 | 85 | 72 | 100 | 84 | 69 |
| 210 | 100 | 75 | 65 | 100 | 81 | 69 | 100 | 84 | 69 | 100 | 85 | 73 |
| 211 | 100 | 54 | 30 | 100 | 59 | 40 | 100 | 75 | 61 | 100 | 74 | 61 |
| 212 | 100 | 40 | 21 | 100 | 40 | 29 | 100 | 40 | 20 | 100 | 52 | 41 |
| 213 | 100 | 77 | 62 | 100 | 80 | 71 | 100 | 91 | 87 | 100 | 91 | 87 |
| 214 | 100 | 70 | 50 | 100 | 73 | 59 | 100 | 86 | 83 | 100 | 87 | 84 |
| 215 | 100 | 75 | 66 | 100 | 82 | 74 | 100 | 92 | 87 | 100 | 93 | 90 |
| 216 | 100 | 73 | 54 | 100 | 83 | 66 | 100 | 92 | 89 | 100 | 93 | 87 |
| 217 | 100 | 72 | 55 | 100 | 79 | 69 | 100 | 97 | 91 | 100 | 94 | 91 |
| 218 | 100 | 72 | 55 | 100 | 79 | 67 | 100 | 93 | 90 | 100 | 92 | 88 |
| 219 | 100 | 70 | 62 | 100 | 78 | 66 | 100 | 94 | 89 | 100 | 94 | 92 |
| 220 | 100 | 68 | 65 | 100 | 80 | 68 | 100 | 94 | 92 | 100 | 95 | 94 |
| 221 | 100 | 73 | 69 | 100 | 78 | 70 | 100 | 95 | 94 | 100 | 95 | 94 |
| 222 | 100 | 75 | 72 | 100 | 81 | 70 | 100 | 95 | 94 | 100 | 98 | 94 |
| 223 | 100 | 73 | 65 | 100 | 82 | 70 | 100 | 98 | 97 | 100 | 98 | 95 |
| 224 | 100 | 65 | 58 | 100 | 76 | 62 | 100 | 94 | 91 | 100 | 97 | 93 |
| 225 | 100 | 60 | 47 | 100 | 68 | 51 | 100 | 93 | 97 | 100 | 95 | 91 |

As is apparent from the results shown in Table 10, Samples No. 13 through No. 25 whose silver halide is substantial silver chlorobromide and whose emulsion contains Exemplified Compound (1) or (2) as the color developing agent of this invention show little changes in the formed color density and therefore show high processing stability even when the bromide ion concentration in the color developing solution is changed from 0.6 g/liter to 1.5 g/liter and 3.5 g/liter as compared to Samples No. 201 through No. 212 whose silver halide is not substantial silver chlorobromide. In contrast, where Conventional Color Developing Agent CD-3 or CD-6 was used, there is the disadvantage that every processed sample, regardless of the silver halide composition, shows the formed color density deteriorated according to the increase in the bromide ion concentration in the color developing solution. In addition, Table 1 shows that, in this invention, the replenishing quantity can be significantly reduced, since it shows that the processing took place with a less replenishing quantity with the increase in the bromide ion concentration.

EXAMPLE 11

Silver halide photographic light-sensitive material Sample No. 221 was used and processed using the same processing solutions and exposed in the same manner as in Example 10 except that color developer solutions prepared with the color developing agent varied as shown in Table 11 were used, and the color developing took place at 38° C. for periods varied as shown in Table 11.

The processed samples each was aged under the illumination of a xenon lamp light and changes in the cyan density were measured. That is, where the initial density 1.0 of each sample processed for each developing period in the developer containing Developing Agent CD-3 is reduced by about 0.3, the density deterioration of the same density region of the same sample processed in the other color developer containing the other Developing Agent was measured and are shown in Table 11. At that time, the same sample's unexposed portion's yellow stain was measured and is also shown in Table 11.

TABLE 11

| Sample No. | 38° C. second | Change in initial density 1.0 (DR) after aging | | | | D min | | | | Remarks |
|---|---|---|---|---|---|---|---|---|---|---|
| | | CD-3 | CD-6 | Sulfate of exemplified compound (1) | Sulfate of exemplified compound (2) | CD-3 | CD-6 | Sulfate of exemplified compound (1) | Sulfate of exemplified compound (2) | |
| 231 | 300 | −0.35 | −0.43 | −0.67 | −0.59 | +0.18 | +0.39 | +0.18 | +0.19 | Comparative |
| 232 | 270 | −0.35 | −0.43 | −0.65 | −0.57 | +0.18 | +0.38 | +0.17 | +0.18 | |
| 233 | 240 | −0.35 | −0.43 | −0.60 | −0.53 | +0.18 | +0.38 | +0.17 | +0.17 | |
| 234 | 210 | −0.35 | −0.43 | −0.48 | −0.48 | +0.17 | +0.37 | +0.15 | +0.17 | |
| 235 | 180 | −0.34 | −0.43 | −0.39 | −0.36 | +0.16 | +0.36 | +0.14 | +0.15 | |
| 236 | 150 | −0.33 | −0.42 | −0.27 | −0.23 | +0.15 | +0.34 | +0.13 | +0.14 | Invention |
| 237 | 120 | −0.32 | −0.41 | −0.20 | −0.19 | +0.15 | +0.31 | +0.11 | +0.13 | |
| 238 | 90 | −0.31 | −0.41 | −0.17 | −0.16 | +0.14 | +0.27 | +0.10 | +0.12 | |
| 239 | 60 | −0.31 | −0.39 | −0.16 | −0.14 | +0.14 | +0.26 | +0.10 | +0.11 | |
| 240 | 30 | −0.30 | −0.39 | −0.16 | −0.14 | +0.14 | +0.25 | +0.09 | +0.11 | |
| 241 | 15 | −0.28 | −0.37 | −0.15 | −0.13 | +0.13 | +0.25 | +0.09 | +0.11 | |

As is apparent from the results in Table 11, where the color developer solution contains Color Developing Agent CD-3 or CD-6, no large difference in the discoloration rate between the agents is recognized whatever the color-developing time (seconds) may be, but CD-6 is larger in the discoloration than CD-3. The same thing is true to the yellow stain density (Dmin) in the unexposed area.

On the other hand, as for the color developing agent, Exemplified Compound (1) or (2) of the present invention, where the color developing time exceeds 180 seconds, the discoloration increases the the preservability in aging becomes significantly deteriorated. The same thing is true also to the yellow stain density (Dmin) in the unexposed area.

However, where the color developing time is less than 150 seconds, the preservability in aging is drastically improved to give more favorable results than in the case where the above CD-3 is used. This fact is surprising beyond the saying that the structure of the formed dye has close relations with the stability of the dye. The remaining of the color developing agent in the layer is assumed to also largely relate to the fact.

EXAMPLE 12

The respective silver halides of Samples No. 203 and No. 221 were used to prepare samples each having blue-, green- and red-sensitive emulsion layers coated so that the silver halide coating quantities are the same as those used in Example 1, and containing variously varied quantities of a hardening agent. These samples, after being dried, were immersed in the foregoing color developer solution (at a measured temperature of 30° C.) and measure with respect to the layer swelling rate $T\frac{1}{2}$ in the same manner as in Example 1. From these samples those having swelling rates $T\frac{1}{2}$ of 2 seconds, 5 seconds, 10 seconds, 15 seconds, 30 seconds, 40 seconds, 60 seconds, 90 seconds and 120 seconds were selected and used. These selected samples each was exposed in the same manner as in Example 1 and processed in the same processing solutions as those used in Example 1. The maximum cyan density obtained when each sample was color-developed for 10 minutes at 38° C. was regarded as 100, and the processing period of time required for the maximum density of each sample to be 80 is given in Table 12. The results represent the rapidness of the development completing point of time.

TABLE 12

| | Color developing agent | Layer swelling rate $T\frac{1}{2}$ 2 sec. | 5 sec. | 7 sec. | 10 sec. | 15 sec. | 20 sec. | 30 sec. | 40 sec. | 60 sec. | 90 sec. | 120 sec. | |
|---|---|---|---|---|---|---|---|---|---|---|---|---|---|
| Comparative AfBrCl 70/30 | CD-3 | 132 | 135 | 137 | 140 | 142 | 147 | 158 | 180 | 191 | 201 | 203 | Silver chlorobromide |
| | CD-6 | 113 | 115 | 118 | 123 | 130 | 141 | 151 | 157 | 163 | 165 | 167 | |
| Invention AgBrCl 70/30 | Sulfate of exemplified compound (1) | 40 | 41 | 43 | 56 | 65 | 94 | 122 | 193 | 232 | 263 | 290 | |
| | Sulfate of exemplified compound (2) | 39 | 42 | 44 | 59 | 66 | 93 | 118 | 179 | 205 | 233 | 265 | |
| | Sulfate of exemplified compound (6) | 33 | 38 | 45 | 58 | 65 | 93 | 115 | 183 | 219 | 241 | 273 | |
| Comparative AgBrI 92/8 | CD-3 | 162 | 164 | 169 | 175 | 179 | 186 | 193 | 203 | 214 | 220 | 227 | Silver iodobromide |
| | CD-6 | 138 | 141 | 145 | 151 | 160 | 171 | 180 | 187 | 193 | 198 | 202 | |
| | Sulfate of exemplified compound (1) | 116 | 117 | 123 | 125 | 134 | 138 | 148 | 163 | 171 | 198 | 229 | |
| | Sulfate of exemplified compound (2) | 141 | 145 | 165 | 173 | 178 | 184 | 190 | 202 | 219 | 243 | 265 | |
| | Sulfate of exemplified compound (6) | 135 | 137 | 144 | 148 | 152 | 158 | 165 | 180 | 203 | 239 | 260 | |

As is apparent from the results in Table 12, where the silver halide is silver chloride, if the color developing agent used is of this invention and the layer swelling rate $T\frac{1}{2}$ is less than 30 seconds, the development completing time (time up to reaching the Dmax of 80) is very short, so that rapid processing is possible. On the other hand, even though the color developing agent of this invention is used, if the layer swelling rate $T\frac{1}{2}$ exceeds 40 seconds, the development completing (reaching) time becomes drastically longer, while on the other hand, in the case of the non-invention color developing agents, even if the layer swelling rate $T\frac{1}{2}$ is very small, no rapid development completing (reaching) time are obtained.

Meanwhile, where the silver halide is substantial silver iodobromide, even thought the color developing agent used is of this invention, no rapid development completing (reaching) time can be obtained regardless of whether the layer swelling rate $T\frac{1}{2}$ is longer or shorter.

EXAMPLE 13

The silver halide photographic light-sensitive material samples No. 203 and No. 221 of Example 1 were used to prepare samples each having blue-, green- and red-sensitive emulsion layers by coating so that each layer has the same quantity of silver and the total coating amounts of silver of the respective samples are 0.4 $g/m^2$, 0.75 $g/m^2$, 1.0 $g/m^2$, 2 $g/m^2$, 3 $g/m^2$, 5 $g/m^2$ and 7 $g/m^2$. The layer swelling rate $T\frac{1}{2}$ (measured at a processing temperature of 30° C.) of each sample was 12 seconds. The quantities of the couplers used in Example 1 were applied intact to the sample containing the total amounts of silver of 1.0 $g/m^2$, and to the other samples were used the couplers in quantities relative to the respective total amounts of silver thereof. As for processing solutions, the same ones were used with the exception of the color developing agent varied in the same way as in Examples 10, 11 and 12.

Regarding the bromide ion concentration, 1.5 g/liter of potassium bromide were used. The maximum density obtained when each sample is processed in each color developer solution at 38° C. for 10 minutes is regarded as 100, and a processing period of time required for the maximum density to be 80 was measured, and the results, the obtained development completing time (time up to reaching the Dmax of 80), are shown in Table 13 in the same way as in Example 12.

TABLE 13

| | Amont of silver ($g/m^2$) | 0.4 | 0.75 | 1.0 | 2 | 3 | 5 | 7 |
|---|---|---|---|---|---|---|---|---|
| Comparative AgBrCl 70/30 | CD-3 | 122 | 128 | 130 | 139 | 140 | 142 | 150 |
| | CD-6 | 108 | 115 | 118 | 125 | 130 | 134 | 140 |
| Invention AgBrCl 70/30 | Sulfate of exemplified compound (1) | 37 | 40 | 43 | 55 | 75 | 90 | 105 |
| | Sulfate of exemplified compound (2) | 39 | 41 | 44 | 53 | 72 | 92 | 116 |
| Comparative AgBrI 92/8 | CD-3 | 159 | 163 | 164 | 170 | 173 | 175 | 182 |
| | CD-6 | 128 | 135 | 140 | 143 | 148 | 155 | 159 |
| | Sulfate of exemplified compound (1) | 123 | 126 | 129 | 134 | 138 | 140 | 142 |
| | Sulfate of exemplified compound (2) | 162 | 164 | 165 | 169 | 173 | 176 | 180 |

As is apparent from Table 13, it is understood that, even in the processing method of this invention, as the total amounts of silver largely increases, the development completing time tends to become drastically longer, but the development completing time in this invention is still much shorter than that of the comparative processing.

EXAMPLE 14

The Sample No. 221 of the color light-sensitive materials used in the Example 1 was used herein with the exception that the yellow couplers were replaced by those shown in Table 14. Wherein, the amounts of the same hardener as was used in the Example 2 were variously changed to be added, and the layer swelling rates $T\frac{1}{2}$ (at a temperature of 30° C., for measurements and treatments) were selected to be 2 sec., 5 sec., 10 sec., 15 sec., 30 sec., 40 sec., 60 sec., 90 sec. and 120 sec., respectively, so that the samples were prepared to be used for the experiments. The resulted samples were exposed through an interference filter (KL-46) and an optical wedge and then treated with the same processing liquids as those used in the Example 1, provided that the Exemplified Compound (1) was used as the color developing agent in the treatments.

Each of the treated samples was measured on the green and blue density (at the maximum color density) by making use of a spectral reflectance densitometer, Model PDA-65 (manufactured by Konishiroku Photo Ind. Co., Ltd., Japan). The results thereof are shown in Table 5.

TABLE 14

| Yellow couper | Max. density, B, G | Layer swelling rate $T\frac{1}{2}$ 2 sec. | 5 sec. | 7 sec. | 10 sec. | 15 sec. | 20 sec. | 30 sec. | 40 sec. | 60 sec. | 90 sec. | 120 sec. |
|---|---|---|---|---|---|---|---|---|---|---|---|---|
| Comparative (RY-1) | Blue density | 2.16 | 2.16 | 2.16 | 2.14 | 2.12 | 2.09 | 2.03 | 1.85 | 1.65 | 1.30 | 0.89 |
| | Green density | 0.75 | 0.74 | 0.74 | 0.70 | 0.61 | 0.52 | 0.43 | 0.27 | 0.22 | 0.16 | 0.11 |
| Comparative (RY-2) | Blue density | 2.12 | 2.12 | 2.11 | 2.10 | 2.08 | 2.04 | 1.95 | 1.80 | 1.61 | 1.24 | 0.85 |
| | Green density | 0.82 | 0.81 | 0.81 | 0.74 | 0.66 | 0.59 | 0.47 | 0.30 | 0.23 | 0.15 | 0.13 |
| Comparative (RY-3) | Blue density | 2.14 | 2.14 | 2.13 | 2.11 | 2.10 | 2.06 | 1.98 | 1.84 | 1.61 | 1.25 | 0.87 |
| | Green density | 0.80 | 0.80 | 0.80 | 0.72 | 0.63 | 0.52 | 0.43 | 0.28 | 0.21 | 0.15 | 0.12 |
| Exemplified compound (Y-4) | Blue density | 2.40 | 2.40 | 2.40 | 2.39 | 2.38 | 2.35 | 2.32 | 2.15 | 1.95 | 1.55 | 1.05 |
| | Green density | 0.38 | 0.38 | 0.37 | 0.35 | 0.31 | 0.28 | 0.25 | 0.23 | 0.20 | 0.17 | 0.14 |
| Exemplified compound (Y-6) | Blue density | 2.33 | 2.33 | 2.32 | 2.30 | 2.27 | 2.24 | 2.16 | 2.00 | 1.83 | 1.46 | 1.01 |
| | Green density | 0.40 | 0.40 | 0.38 | 0.38 | 0.34 | 0.29 | 0.26 | 0.22 | 0.20 | 0.19 | 0.17 |
| Exemplified compound (Y-22) | Blue density | 2.42 | 2.42 | 2.42 | 2.42 | 2.40 | 2.37 | 2.33 | 2.20 | 2.01 | 1.73 | 1.29 |
| | Green density | 0.35 | 0.35 | 0.35 | 0.33 | 0.30 | 0.28 | 0.24 | 0.22 | 0.20 | 0.18 | 0.14 |

[Comparative yellow couplers shown in Table 14]

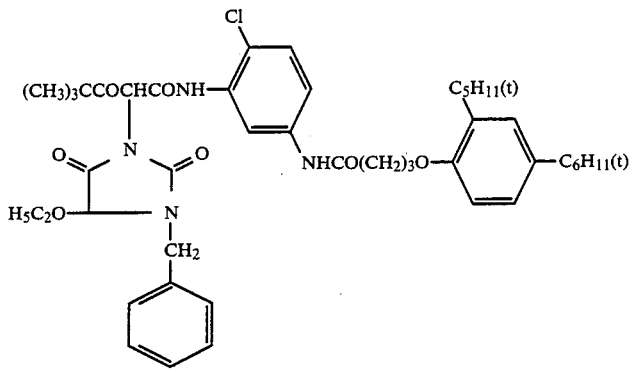

Comparative (TY-2)

(RM/RN = 0.22)

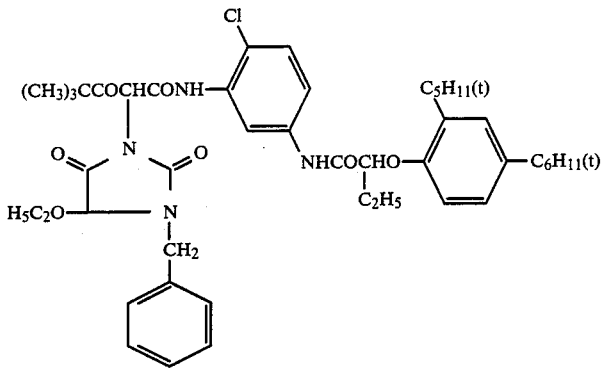

Comparative (RY-3)

(RM/RN = 0.23)

As is obvious from the results shown in Table 14, when using the other yellow couplers than those of the invention, which have a relative coupling reaction rate of less than 0.3, the green density thereof are increased and, the layer swelling rates thereof $T\frac{1}{2}$ are remarkably increased particularly when it is not faster than 30 seconds. These facts indicate that some magenta dyes are apt to produce as the yellow couplers are produced and, that is, a color turbidity is caused. On the other hand, when using the Exemplified Compounds (Y-4), (Y-6) and (Y-22) of the invention each having a relative coupling reaction rate of not slower than 0.3, it indicates the facts that the green density thereof are much lower and the color turbidity thereof are apparently less, than those of the comparative examples, and, in addition to the above, such an excellent result can be enjoyed as that a color turbidity can be lessed without much depending upon a layer swelling rate $T\frac{1}{2}$.

What is claimed is:

1. A method for processing a silver halide photographic light-sensitive material, comprising the step of processing a silver halide color photographic light-sensitive material containing at least a silver halide emulsion layer comprising a silver halide grain consisting essentially of silver chlorobromide and a binder having a swelling rate $T\frac{1}{2}$ of from 2 sec. to not more than 30 sec. with a color developer containing a N-hydroxyalkyl-p-phenylenediamine derivative at a temperature not less than 30° C. for a time not more than 150 sec., the time and temperature being effective to process the silver halide color photographic light sensitive material without decreasing the stability of the resulting dye image.

2. The method of claim 1, wherein said silver halide grain contains not more than 90 mol% of silver bromide.

3. The method of claim 1, wherein the total amount of silver coated on said silver halide color photographic light-sensitive material is not more than 1 $g/m^2$.

4. The method of claim 3, wherein the total amount of silver coated is within the range of 0.1 to 0.8 $g/m^2$.

5. The method of claim 4, wherein the total amount of silver coated is within the range of 0.2 to 0.7 $g/m^2$.

6. The method of claim 1, wherein said silver halide emulsion layer contains a magenta coupler represented by the general formula (I) and the silver halide grain contained in said emulsion layer is green-sensitive, formula (I) having the formula:

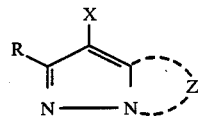

wherein, Z represents a group of non-metallic atoms necessary to complete a nitrogen-containing heterocyclic ring, X represents a hydrogen atom or a substituent capable of being released upon reaction with an oxidation product of a color developing agent, R represents a hydrogen atom or a substituent.

7. The method of claim 1, wherein said silver halide emulsion layer contains a yellow coupler having a relative coupling rate not less than 0.3 and the silver halide grain contained in said silver halide emulsion layer is blue-sensitive.

8. The method of claim 7, wherein the coupling rate of said yellow coupler is not less than 0.5.

9. The method of claim 1, wherein said color developer contains at least $5\times10^{-3}$ mol bromide ion per liter.

10. The method of claim 9, wherein said color developer contains the bromide ion at a proportion of at least $1\times10^{-2}$ mol/l.

11. The method of claim 10, wherein said color developer contains the bromide ion within the range of $1.5\times10^{-2}$ to $6\times10^{-2}$ mol/l.

12. The method of claim 1, wherein the swelling rate $T\frac{1}{2}$ of said binder is within the range of 2 to 20 sec.

13. The method of claim 1, wherein the processing is carried out at a temperature within the range of 30° to 50° C.

14. The method of claim 1, wherein the time for the processing being within the range of 5 to 150 sec.

15. The method of claim 14, wherein the time for the processing being within the range of 10 to 110 sec.

16. The method of claim 1, wherein said N-hydroalkyl-p-phenylenediamine derivative is 3-methyl-4-amino-N-ethyl-N-β-hydroxyethylaniline salt.

17. The method of claim 1, wherein an amount of a developer replenishment is not more than 250 ml per $m^2$ of the silver halide light-sensitive material processed.

18. The method of claim 17, wherein the amount of a developer replenishment is not more than 200 ml per $m^2$ of the silver halide light-sensitive material processed.

19. The method of claim 18, wherein the amount of a developer replenishment is from 20 to 180 ml per $m^2$ of the silver halide light-sensitive material processed.

20. The method of claim 1, wherein the swelling rate $T\frac{1}{2}$ of said binder is within the range of 2 to 15 seconds.

21. The method of claim 1, wherein the processing is carried out at a temperature within the range of 33° C. to 48° C.

22. The method of claim 1, wherein the processing is carried out at a temperature within the range of 35° C. to 43° C.

23. The method of claim 1, wherein the processing is carried out at a temperature within the range of 33° C. to 48° C. and a time within the range of 5 to 120 seconds.

24. The method of claim 1, wherein the processing is carried out at a temperature within the range of 35° C. to 43° C. and for a time within the range of 5 to 90 seconds.

* * * * *